US006748886B2

(12) United States Patent
Shimizu

(10) Patent No.: US 6,748,886 B2
(45) Date of Patent: Jun. 15, 2004

(54) WORKPIECE FORMED WITH PATTERN AND METHOD AND APPARATUS FOR MANUFACTURING THE SAME

(75) Inventor: Yasuhiro Shimizu, Gifu-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 253 days.

(21) Appl. No.: 09/897,393

(22) Filed: Jul. 3, 2001

(65) Prior Publication Data

US 2002/0014191 A1 Feb. 7, 2002

(30) Foreign Application Priority Data

| | | |
|---|---|---|
| Jul. 3, 2000 | (JP) | 2000-201244 |
| Jul. 3, 2000 | (JP) | 2000-201246 |
| Nov. 24, 2000 | (JP) | 2000-357426 |
| May 16, 2001 | (JP) | 2001-146495 |

(51) Int. Cl.[7] ..... D05C 15/14; D05C 15/28; D05B 21/00

(52) U.S. Cl. ..... 112/80.16; 112/80.23; 112/470.06; 112/475.23

(58) Field of Search ..... 112/475.18, 475.19, 112/475.23, 470.06, 470.13, 470.12, 102.5, 103, 80.16, 80.23

(56) References Cited

U.S. PATENT DOCUMENTS

| | | | | |
|---|---|---|---|---|
| 1,452,632 A | * | 4/1923 | Barnett | 112/80.16 |
| 2,984,196 A | * | 5/1961 | Cooper et al. | 112/80.16 |
| 3,361,095 A | * | 1/1968 | Short | 112/80.16 |
| 3,385,247 A | | 5/1968 | Johnson et al. | |
| 3,749,039 A | | 7/1973 | Fritts | |
| 4,077,339 A | | 3/1978 | Bass et al. | |
| 4,100,867 A | | 7/1978 | Bass et al. | |
| 4,319,532 A | * | 3/1982 | Fogarty et al. | 112/169 X |
| 4,549,496 A | | 10/1985 | Kile | |
| 5,429,853 A | * | 7/1995 | Darrieux et al. | 112/470.13 X |
| 5,543,005 A | * | 8/1996 | Monget et al. | 112/470.06 X |
| 5,803,001 A | | 9/1998 | Shimizu et al. | |

FOREIGN PATENT DOCUMENTS

| | | |
|---|---|---|
| JP | 10-151287 | 6/1998 |

* cited by examiner

*Primary Examiner*—Peter Nerbun
(74) *Attorney, Agent, or Firm*—Oliff & Berridge, PLC

(57) ABSTRACT

A patterned cloth is made by which a pattern is formed on a surface of a work cloth by passing a thread through the work cloth a number of times and forming a plurality of free loops on the reverse side of the work cloth. A double-sided adhesive tape is provided to fix the free loops on the reverse side of the work cloth. The work cloth has an elastic film member, the elastic film member allowing the free loops to be retained on the reverse side of the work cloth.

17 Claims, 59 Drawing Sheets

WORKPIECE FORMED WITH PATTERN AND METHOD AND APPARATUS FOR MANUFACTURING THE SAME

BACKGROUND OF THE INVENTION

1. Field of Invention

The invention relates to a workpiece formed with a pattern and a method and an apparatus for manufacturing the workpiece formed with a pattern, more particularly, to a technique of leaving free loops on a reverse side of a workpiece.

2. Description of Related Art

Conventionally, a sewing apparatus, such as a sewing machine, includes a needle that holds an upper thread and passes the upper thread through a work cloth, a thread take-up that tightens the upper thread, a device for driving the needle and the thread take-up, a thread loop taker that accommodates a lower thread bobbin, forms an upper thread loop in cooperation with the needle and the thread take-up and crosses the upper thread and the lower thread to each other, a feed dog that feeds the work cloth, and a device that drives the feed dog. A sewing operation is performed by which the work cloth is fed by driving the needle and the thread take-up vertically.

A general home embroidery machine includes an embroidery frame to which a work cloth is attached and a device for moving the embroidery frame in orthogonal directions (an X direction and a Y direction) in a horizontal plane, instead of the feed dog. The sewing operation is performed by which the embroidery frame is independently moved in the X direction and the Y direction, by a controller, based on embroidery data.

Recently, compact and lightweight sewing apparatuses and sewing equipment have been sold. It is expected that a sewing apparatus for children, having an embroidery function, will be in practical use in the near future. It is conceivable that such a sewing apparatus having the embroidery function will be a compact and lightweight sewing apparatus that has a relatively simple structure and sews an embroidery pattern using only an upper thread.

When a sewing operation is performed using an upper thread and a lower thread, the upper thread and the lower thread pull at each other in stitches formed on a work cloth. Therefore, free loops are not formed on a reverse side of the work cloth. Even when the sewing operation is performed using only the upper thread, no free loops are formed, because the thread is tightened by means of the thread in a stitch and the thread in a following stitch in continuous stitches pulling each other.

Conventionally, a pattern is formed on a work cloth in a state where a thread is under tension (no free loops), and then an adhesive, such as a double-sided adhesive tape, is adhered on a reverse side of the work cloth formed with a pattern. However, good adhesion of the work cloth can not be obtained when the work cloth is adhered to clothes.

When a sewing operation is performed using the upper thread and the lower thread as in a general sewing apparatus, the thread loop taker, the driving device for the thread loop taker, and the like are needed. Accordingly, the structure of the sewing apparatus becomes complicated. It is difficult to reduce size and weight of such a sewing apparatus. There has been proposed sewing equipment that performs a sewing operation using only the upper thread. However, stitches are liable to unravel because the upper thread does not cross the lower thread. Therefore, the stitches are far from perfect stitches and are not practical.

To date, there has been no proposed simple and practical technique of fixing free loops formed on a reverse side of a work cloth to the work cloth when the sewing operation is performed using only an upper thread. Further, there has been no idea put forth for a work cloth, having a special structure, that is sewn such that stitches and embroidery patterns do not unravel when the sewing operation is performed using only an upper thread.

SUMMARY OF THE INVENTION

The invention provides a workpiece formed with a pattern by which a plurality of free loops are fixed on a reverse side of the workpiece, and a method and an apparatus for manufacturing the workpiece formed with the pattern.

An apparatus that manufactures a patterned cloth such that an embroidery pattern is formed on its surface includes a sewing tool that passes a thread through a workpiece, a sewing tool driving device that reciprocates the sewing tool up and down, a moving device that relatively moves a workpiece holder having the workpiece and the sewing tool in a direction in a horizontal plane perpendicular to a reciprocating direction of the sewing tool, and a controller that controls the sewing tool driving device and the moving device to cause a thread to pass through the workpiece a number of times in different positions so that a plurality of free loops are left on a reverse side of the workpiece by frictional resistance between the workpiece and the thread passed therethrough, thereby forming an embroidery pattern on a surface of the workpiece. The apparatus for manufacturing the workpiece formed with a pattern is of the same structure as a sewing apparatus. However, the apparatus is not restricted to general sewing machines. The apparatus may be sewing apparatuses having various structures different from general sewing machines.

The workpiece holder, to which the workpiece is attached, and the sewing tool are moved relatively in orthogonal directions in the horizontal plane by controlling the driving device by means of the controller while the sewing tool is moved up and down by the sewing tool moving device. Accordingly, an embroidery pattern can be formed on the workpiece with free loops left on the reverse side of the workpiece.

When a thread forming a pattern is fixed using elasticity of the workpiece to which the pattern is applied, without using other thread or a thread in a previous or a following stitches, an embroidery pattern can be formed using only an upper thread. Further, an embroidery pattern can be formed using a workpiece including an elastic film member by which a plurality of free loops are left on a reverse side of the workpiece via resistance acting between the elastic film member and a thread while the thread is passed through the workpiece a number of times.

When the sewing tool is a hollow needle, a pattern and free loops can be beautifully formed. When a cut surface having an arc shape in cross section is formed in a workpiece, a thread can be surely fixed to the workpiece as a force to fix the thread to the workpiece is enhanced as compared with a cut surface having a circular shape, i.e., a round hole, in cross section. When a tip of the hollow needle is inclined with respect to its axis, a cut surface having an arc shape is formed in a workpiece as the hollow needle swings and passes through the workpiece.

When the cut surfaces having the arc shape in cross section are successively formed so that a tangent to a middle of the arc of the cut surfaces is not perpendicular to an arrangement direction of the cut surfaces, the possibility of cutting a thread by the hollow needle can be reduced to a minimum. When the fixing material is a sheet-type material having tackiness on both sides, a workpiece can be easily adhered to clothes and the like.

When the fixing material for fixing the free loops is applied on the reverse side of the workpiece, after processing on the workpiece is completed, the free loops do not come out. Accordingly, a pattern formed on a surface of the workpiece does not unravel. The fixing material may be adhesives applied to the workpiece in layers. Further, the fixing material may be a tape or a double-sided adhesive tape formed of adhesives.

BRIEF DESCRIPTION OF THE DRAWINGS

Embodiments of the invention will be described in detail with reference to the following figures wherein.

DETAILED DESCRIPTION OF PREFERRED EMBODIMENTS

Embodiments of the invention will be described with reference to the accompanying drawings.

A first embodiment of the invention will be described below.

Figure 1:
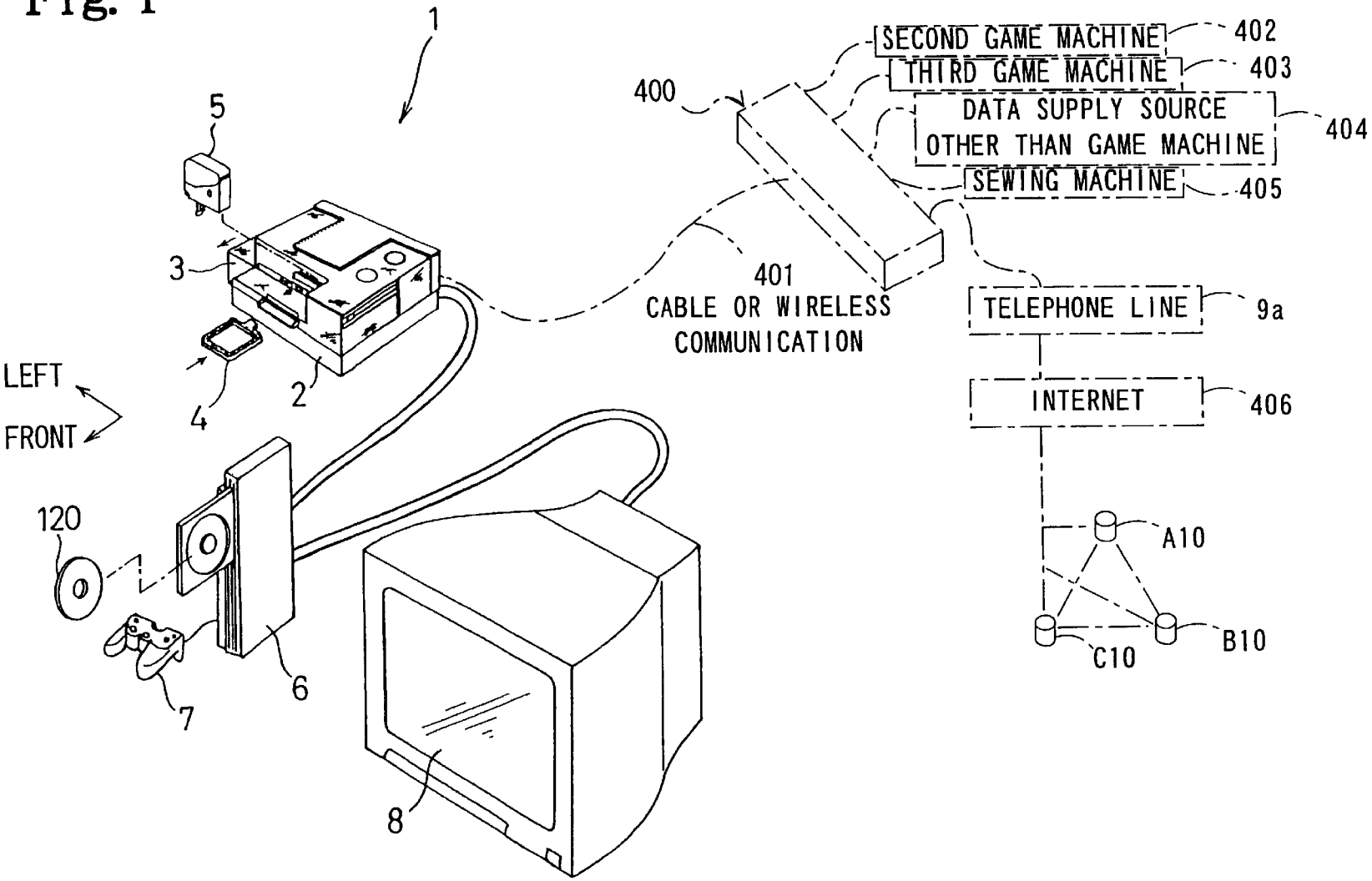
FIG. 1 is a perspective view showing a sewing apparatus according to a first embodiment of the invention and a game machine.

As shown in FIG. 1, a sewing apparatus 1 of a first embodiment is connected to a home video game machine 6 including a controller 7 via a connecting cable. In the sewing apparatus 1, an embroidery pattern is selected/edited using the game machine 6 while the embroidery pattern is observed on a screen of a CRT 8 (a home television). The selected/edited embroidery pattern can be embroidered on a predetermined work cloth. A description will be made in the embodiments using directions shown in FIG. 1 of the sewing apparatus 1 and as are applied throughout several drawings. Orientation of a sewing cartridge is defined in a state where the sewing cartridge is attached to the sewing apparatus 1 shown in FIG. 1.

Figure 2:
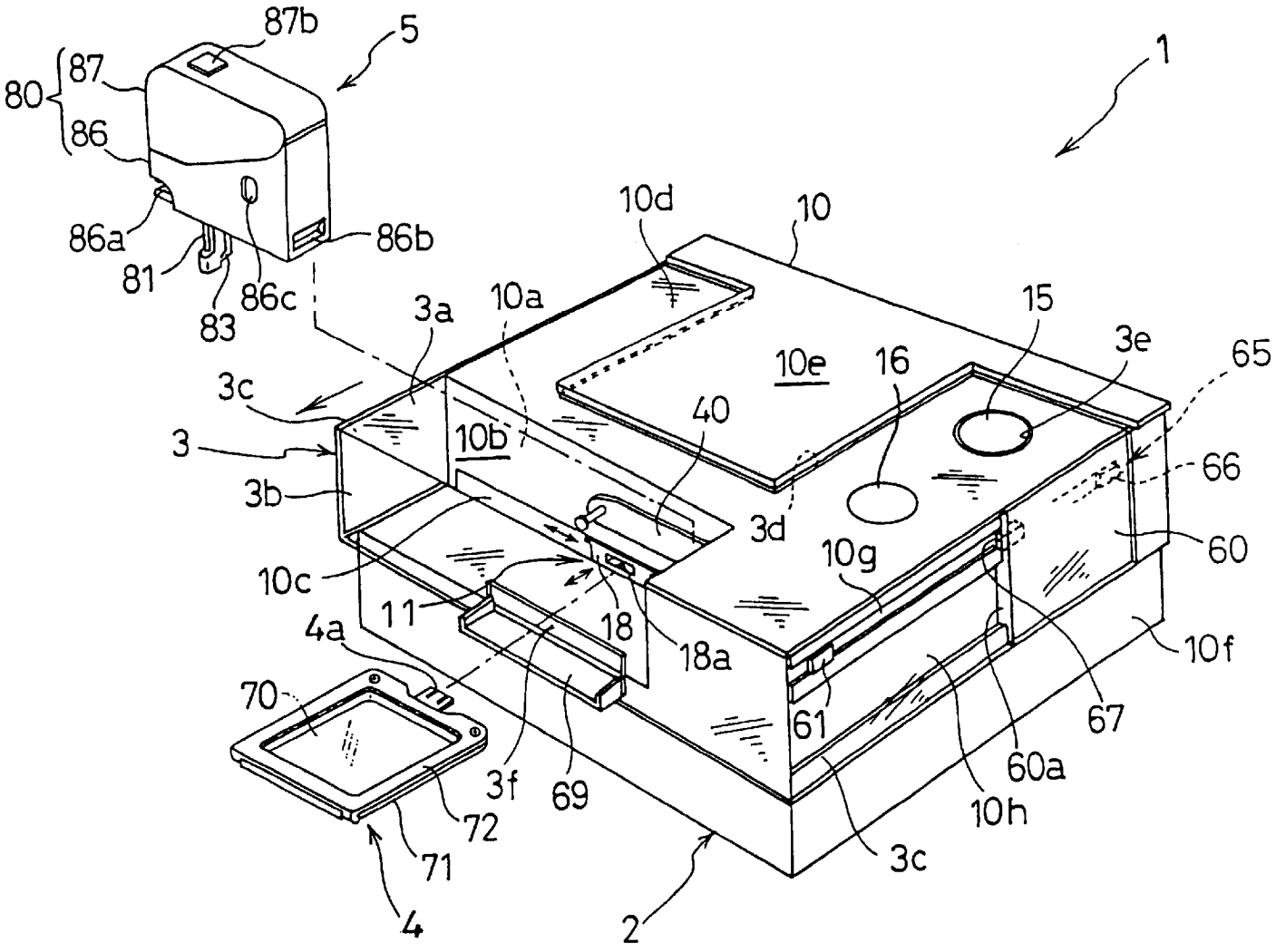
FIG. 2 is a perspective view of the sewing apparatus (when a safety cover is in a storage position)
Figure 3:
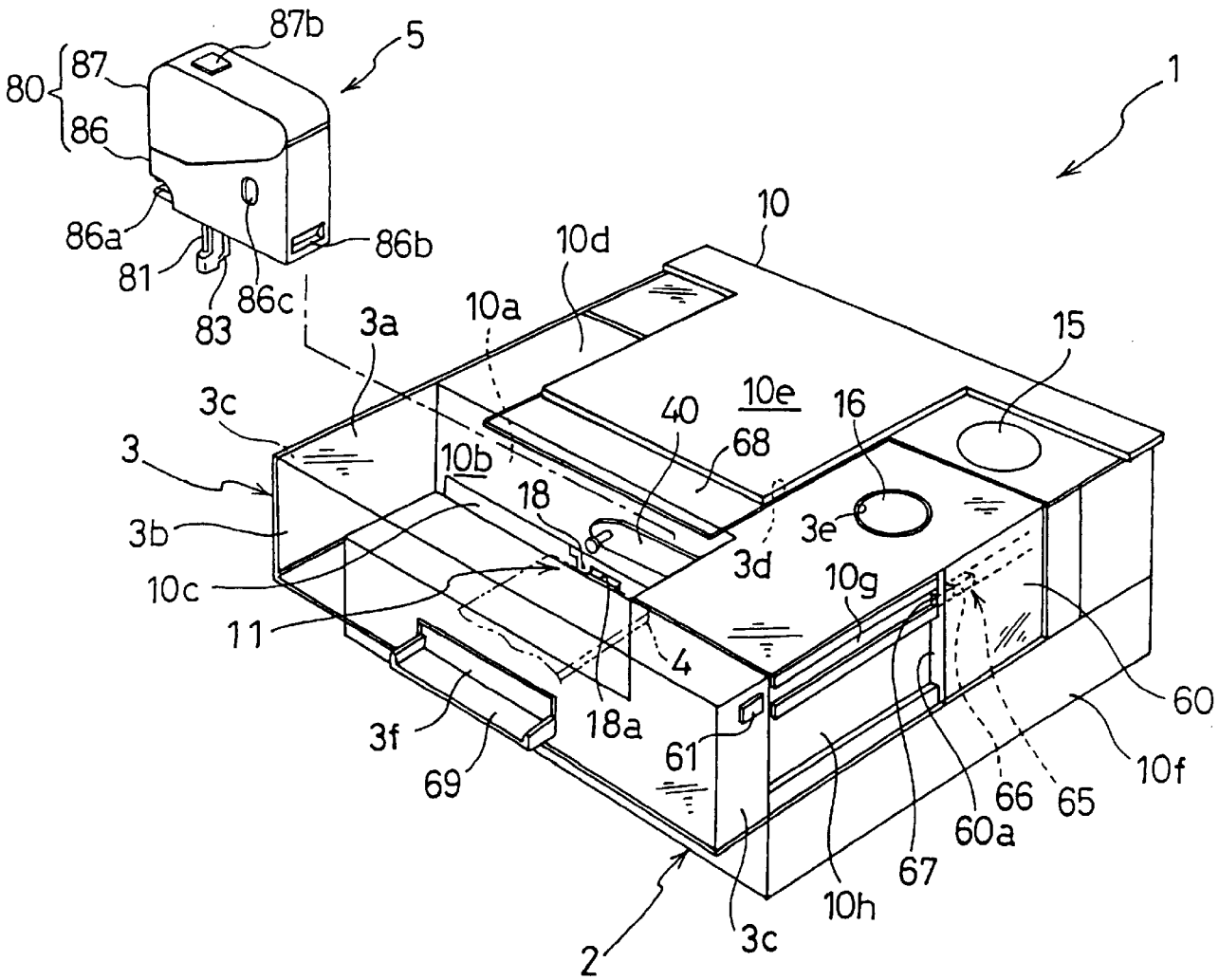
FIG. 3 is a perspective view of the sewing apparatus (when the safety cover is in a sewing position)
Figure 4:
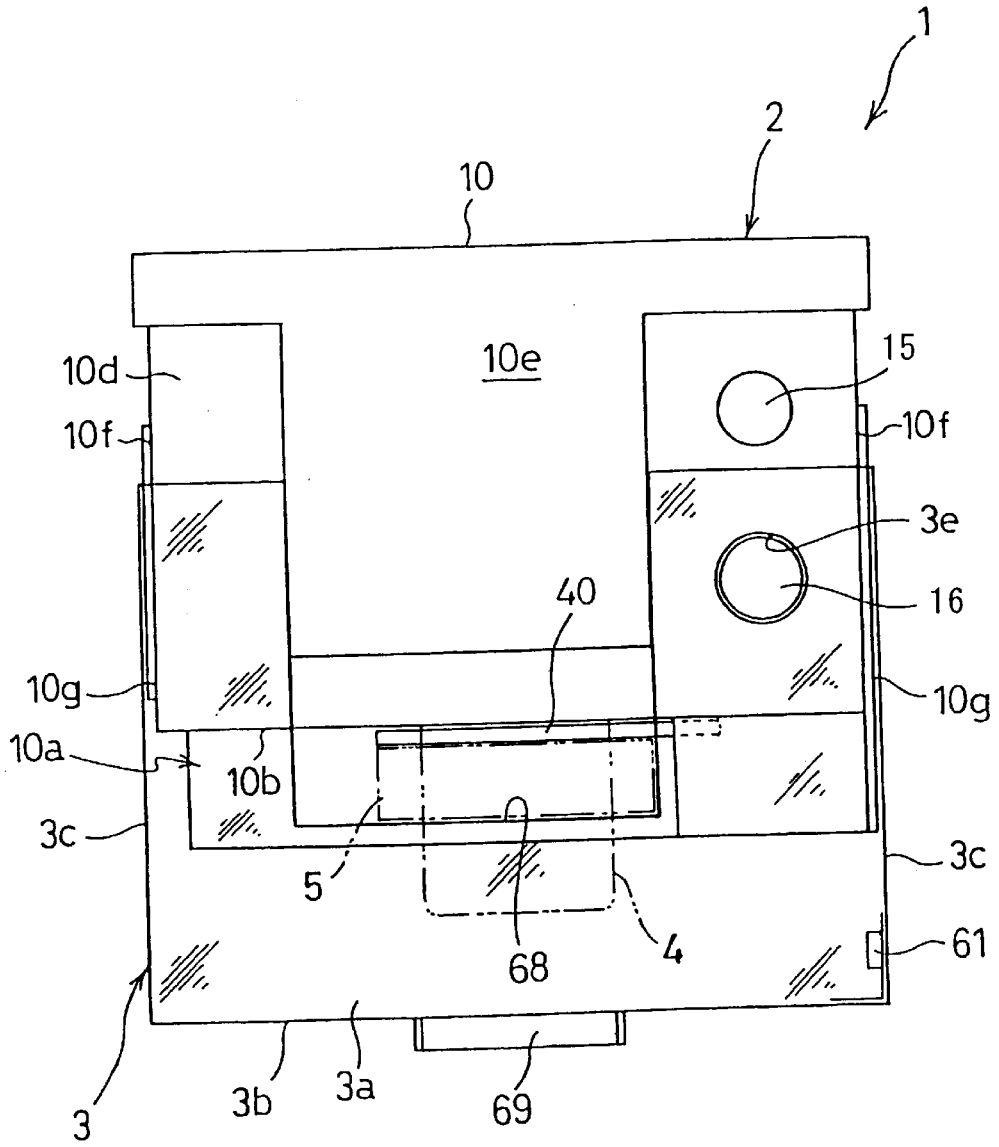
FIG. 4 is a plan view of the sewing apparatus (when the safety cover is in the sewing position)
Figure 5:
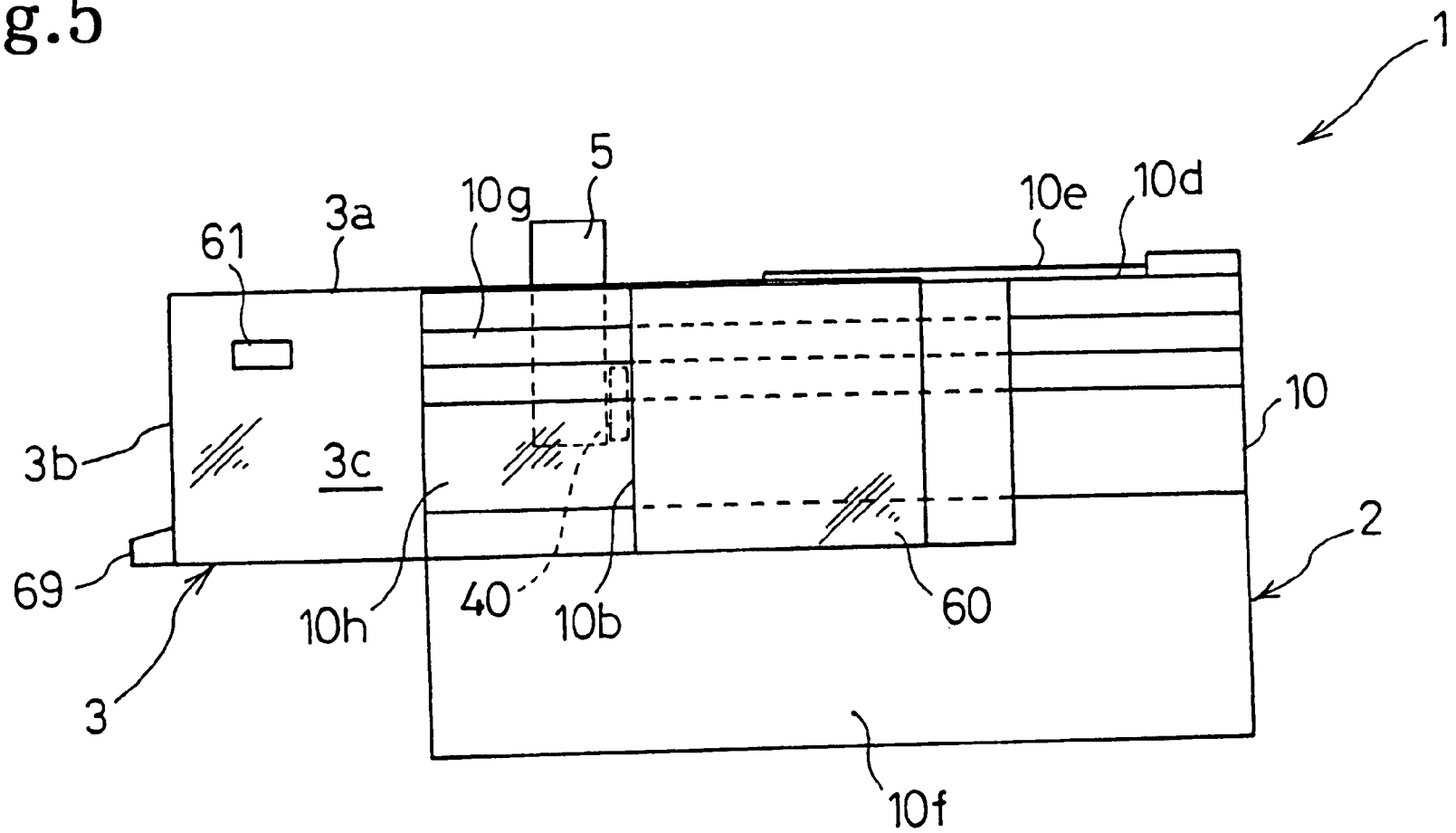
FIG. 5 is a right side view of the sewing apparatus (when the safety cover is in the sewing position)

As shown in FIGS. 1 to 3, the sewing apparatus 1 includes a sewing apparatus body 2, a safety cover 3 slidably attached to the sewing apparatus body 2 in a back and forth direction, an embroidery frame 4, and a sewing cartridge 5. The embroidery frame 4 and the sewing cartridge 5 are detachably attached to the sewing apparatus body 2. A work cloth 70, to be sewn, is attached to the embroidery frame 4. A hollow needle 81 for sewing, that can pass through the work cloth, is provided in the sewing cartridge 5.

First, the sewing apparatus body 2 will be described.

As shown in FIGS. 2 to 8, the sewing apparatus body 2 includes a casing 10, an embroidery frame driving mechanism 11 that moves the embroidery frame 4 having the work cloth 70 in a horizontal plane with respect to the hollow needle 81 while the embroidery frame 4 is held by a carriage 18, a cartridge driving mechanism 12 that swings the sewing cartridge 5, attached to a swing arm 40, up and down, and a controller 13 (see FIG. 41) that controls the embroidery frame driving mechanism 11 and the cartridge driving mechanism 12.

The casing 10 has a relatively small box shape (for example, 130 mm in length, 165 mm in width, 70 mm in height). Substantial parts of the embroidery frame driving mechanism 11 and the cartridge driving mechanism 12 and the controller 13 are accommodated in the casing 10. The casing 10 is cut away approximately two-thirds of the way from a left side (as shown in FIGS. 1 and 2) of the casing 10 in the length, approximately one-fourth of the way from a front side, and approximately half of the height from the top. Thus, a cutaway space 10*a* is formed in the casing 10.

A slit 10*c*, extending in a right and left direction, is formed in a lower end portion of a front wall 10*b* of the casing 10 within the cutaway space 10*a*. The slit 10*c* is provided to attach the embroidery frame 4 to the carriage 18 and to move the embroidery frame 4 in a horizontal plane. A slit extending in a vertical direction (not shown) is formed in the side wall of the casing 10 within the cutaway space 10*a*. The swing arm 40 of the cartridge driving mechanism 12 protrudes into the cutaway space 10*a* from the inside of the casing 10 and is vertically movable in the vertical slit.

On an upper wall 10*d* of the casing 10, a guide upper surface 10*e* is formed as a step. A middle area of the guide upper surface 10*e* protrudes toward the front of the casing 10. On the right side of the guide upper surface 10*e* is a power switch 15, electrically connected to the controller 13, and a start/stop switch 16 that commands the start and an end of sewing. Upper surfaces of the power switch 15 and the start/stop switch 16 are positioned at the same or a slightly lower level than the upper surface of the upper wall 10*d*.

To assist attachment/detachment of the sewing cartridge 5 to/from the swing arm 40, in front of the guide upper surface 10*e* (described later), a front end of the guide upper surface 10*e* is longer in length in the right and left direction than the sewing cartridge 5. Accordingly, the front end of the guide upper surface 10*e* extends toward and behind the sewing cartridge 5 that is attached to the swing arm 40.

Guide grooves 10*g*, 10*h* are formed in the front to rear direction in right and left side walls 10*f* of the casing 10. The width of the guide groove 10*g* is narrower than that of the guide groove 10*h*. An engagement block piece 67 is fixed to each guide groove 10*g* in a substantially mid-position, between the front and back sides, of the casing 10, and protrudes outwardly. Because the cutaway space 10*a* exists in the casing 10, the length of the guide grooves 10*g*, 10*h* in the left wall 10*f* is shorter than that of the guide grooves 10*g*, 10*h* in the right wall 10*f*.

Figure 6:
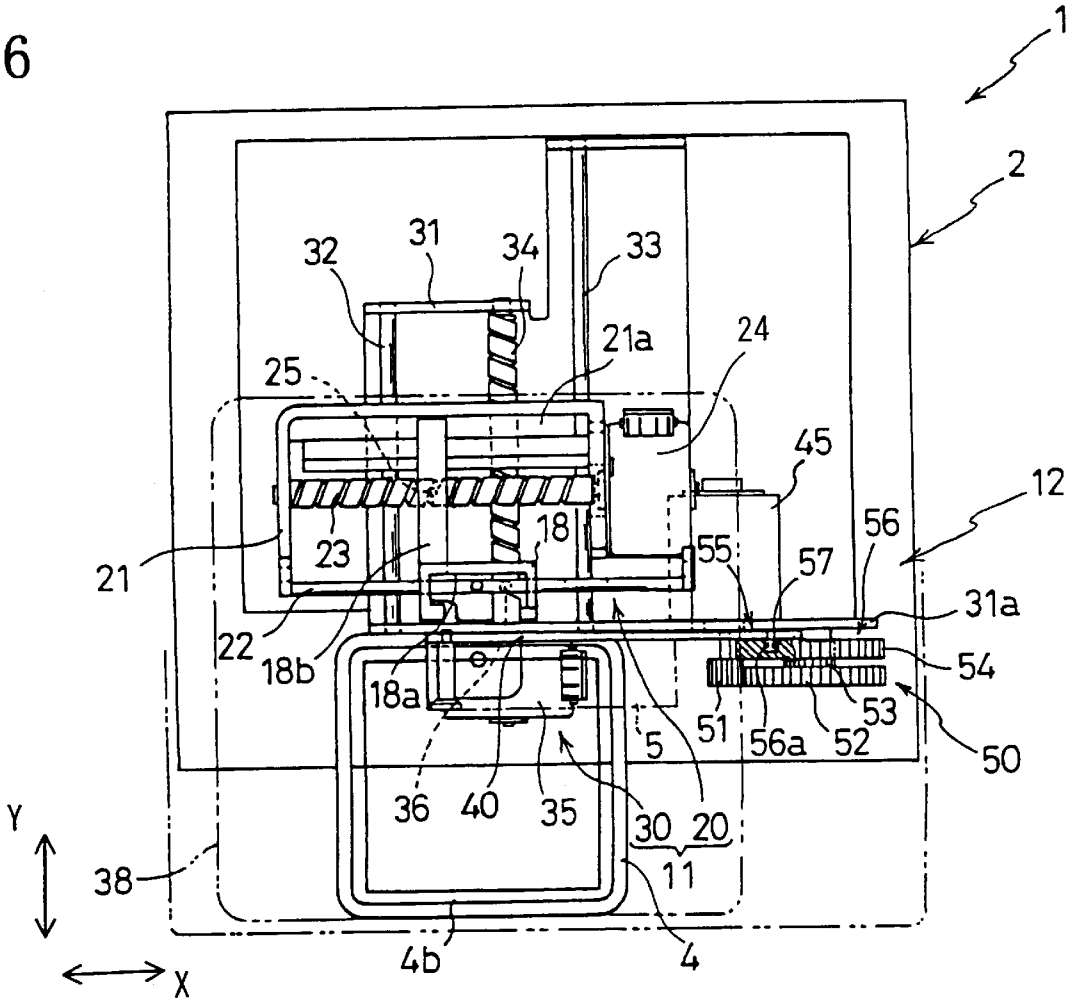
FIG. 6 is a transverse sectional view of the sewing apparatus.

As shown in FIGS. 2, 3, and 6, the embroidery frame driving mechanism 11 includes the carriage 18 to which the embroidery frame 4 is detachably attached, an X-axis direction moving mechanism 20 that moves the carriage 18 in an X direction (the left-right direction) within a horizontal plane, and a Y-axis direction moving mechanism 30 that moves the carriage 18 in a Y direction (the front and rear direction) perpendicular to the X direction, within the horizontal plane.

The carriage 18 has an engagement portion 18*a* that can engage/disengage a rear end support portion 4*a* of the embroidery frame 4 thereto/therefrom and a guide plate 18*b* that extends rearward from the underside of the engagement portion 18*a*. When the embroidery frame 4 is attached to or detached from the carriage 18, the carriage 18 is positioned under the swing arm 40. A moving frame 21 of the X-axis direction driving mechanism 20 is formed with a guide portion 21*a* in the right and left direction at its rear and is provided with a guide rod 22 in the right and left direction at its front. The carriage 18 is movably supported and guided in the right and left direction by the guide portion 21*a* and the guide rod 22.

The X-axis direction driving mechanism 20 has the moving frame 21, the guide rod 22, a screw shaft 23, a pulse motor 24 (FIG. 41), and a guide pin 25. The moving frame 21 has a substantially box shape and an upper open structure. The guide rod 22 is supported by side walls of the moving frame 21 at its ends. The screw shaft 23 is disposed inside of the moving frame 21, extending in the right and left direction. A left end of the screw shaft 23 is rotatably supported by the left wall of the moving frame 21. The pulse motor 24 is fixed on the right of the right wall of the moving frame 24. An output shaft of the pulse motor 24 is directly connected to a right end of the screw shaft 23.

The guide plate 18*b* of the carriage 18 is disposed above the screw shaft 23. The guide pin 25 is fixed to the guide plate 18*b* so as to protrude downward. The guide pin 25 slidably engages a spiral groove formed in the screw shaft 23. As the screw shaft 23 is rotated by the pulse motor 24, the guide pin 25 is guided along the spiral groove, so that the guide pin 25 moves from side to side. As a result, the carriage 18 is moved in the X direction.

The Y-axis direction moving mechanism 30 has a support frame 31, two guide rods 32, 33, a screw shaft 34, a pulse motor 35, and a guide pin 36. The support frame 31 has a substantially concave shape when viewed from the side. The guide rods 32, 33, extend in the front to back direction and are supported by the front and the rear walls at their ends. The support frame 31 of the Y-axis driving mechanism 30 is movably supported and guided in the back and forth direction by the guide rods 32, 33.

The screw shaft 34 extends in the front to back direction. The screw shaft 34 is rotatably supported by the rear wall of the support frame 34 at its rear end. The pulse motor 35 is fixed at the front of the front wall of the support frame 31. An output shaft of the pulse motor 35 is directly connected to the front end of the screw shaft 34. The guide pin 36 is fixed to the moving frame 21 so as to protrude downward. The guide pin 36 slidably engages a spiral groove formed in the screw shaft 34. As the screw shaft 34 is rotated by the pulse motor 35, the guide pin 36 is guided along the spiral groove, so that the guide pin 36 moves back and forth. As a result, the carriage 18 is moved in the Y direction together with the moving frame 21. The Y-axis direction moving mechanism 30 is disposed under the X-axis direction moving mechanism 20.

An embroidery frame moving area 38, shown in FIG. 6, is an area in which the embroidery frame 4, attached to the carriage 18, can be moved by the embroidery frame driving mechanism 11. The hollow needle 81 in the sewing cartridge 5 attached to the sewing apparatus body 2 is positioned substantially at a center of the embroidery frame moving area 38. The sewing cartridge 5 is attached to the forward part of the sewing apparatus body 2, so that the embroidery frame moving area 38 extends from the casing 10. As described above, the Y-axis direction driving mechanism 30 is disposed under the X-axis direction driving mechanism 20 and each of the driving mechanisms 20, 30 is positioned under the embroidery frame moving area 38 of the carriage 18. Accordingly, the sewing apparatus body 2 can be downsized.

As shown in FIGS. 6 to 9, the cartridge driving mechanism 12 has the swing arm 40 that the sewing cartridge 5 is attached to or detached from, a machine motor 45, that is an AC motor, as drive source to move the swing arm 40 up and down, a gear mechanism 50 that reduces the rotation speed of the machine motor 45, and a cam mechanism 55 that converts a rotary motion, reduced in its rotation speed by the gear mechanism 50, into up-and-down movements of the swing arm 40.

As shown in FIGS. 7, 8, and 22 to 24, the swing arm 40 is formed with an arm portion 40*a*, extending in the right and left direction, and a lever portion 40*b*, extending in the up and down direction, which are integral to form a single structure. The swing arm 40 is disposed at substantially the right half part of the forward part of the casing 10. The lever portion 40*b* is pivotally supported at its middle portion by a pivot shaft 41*b* which is supported by the sewing apparatus body 2 via a bracket 41*a*. A largest portion of the arm portion 40*a* protrudes toward the cutaway space 10*a*. The remaining portion, including the lever portion 40*b*, is accommodated in the casing 10.

An engaging pin 42, extending from front to rear of the casing 10, is fixed at a left end portion of the arm portion 40*a*. A lock release pin 43, also extending from front to rear, is fixed to the right of the engaging pin 42 so as to protrude toward the front of the casing 10. An engaging member 44*a* is rotatably supported by the swing arm 40. A torsion spring (not shown) rotatably urges the engaging member 44*a* in a clockwise direction. An engagement plate 19, that is integrally formed with a machine frame of the sewing apparatus body 2, is provided behind the swing arm 40. The engagement plate 19 extends from the right part of the machine frame of the sewing apparatus body 2 and toward the left. In front of the engagement plate 19, an operating member 44*b*, that is operated to rotate the engaging member 44*a* in a counterclockwise direction, is operably rotatably supported.

The engaging pin 42, the lock release pin 43, the engaging member 44*a*, and the operating member 44*b* are provided in order to attach/detach the sewing cartridge 5 to/from the swing arm 40.

The machine motor 45 is fixed to the back of the right lower portion of the front wall 31*a* of the support frame 31 so that a rotational shaft of the machine motor 45 extends toward the front of the casing 10.

Figure 7:
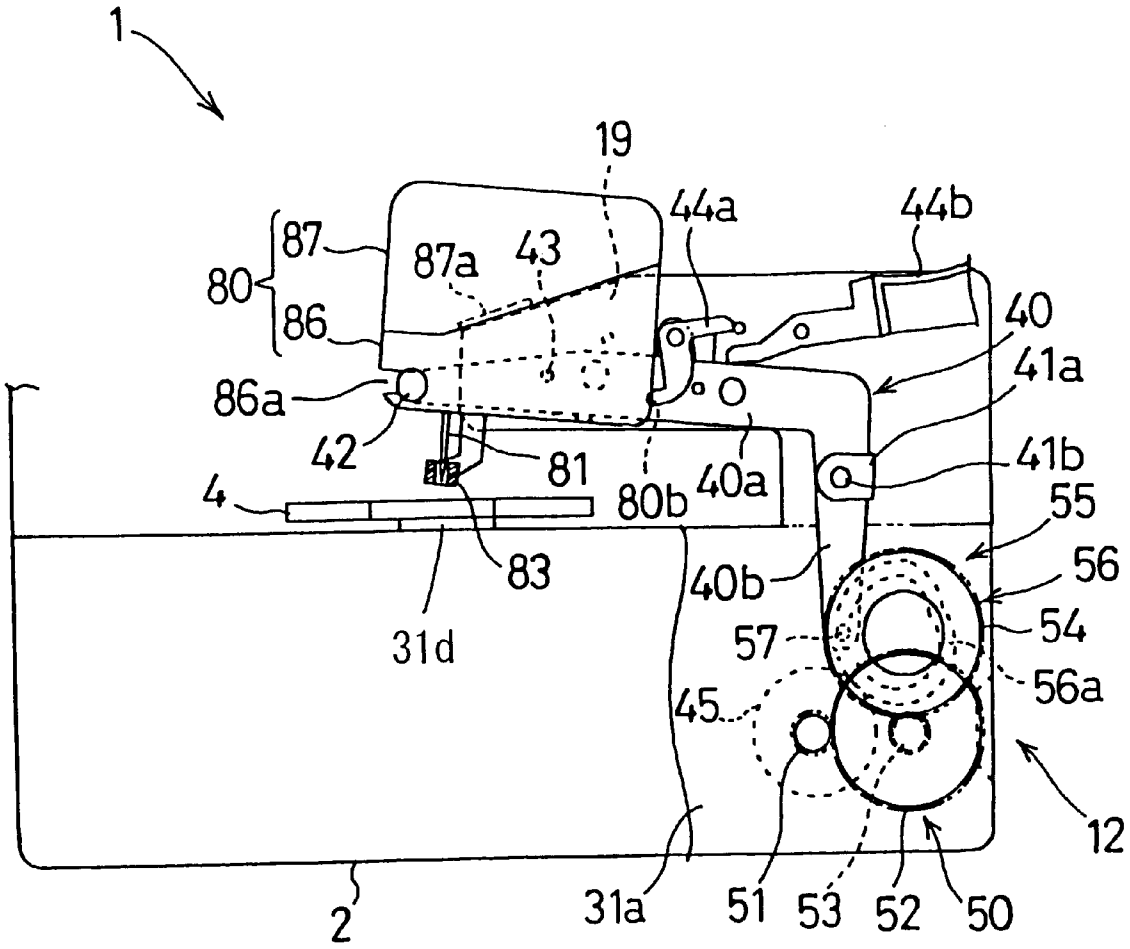
FIG. 7 is a partial perspective view of the sewing apparatus (when a hollow needle is in an upper limit position) as seen from the front.
Figure 8:
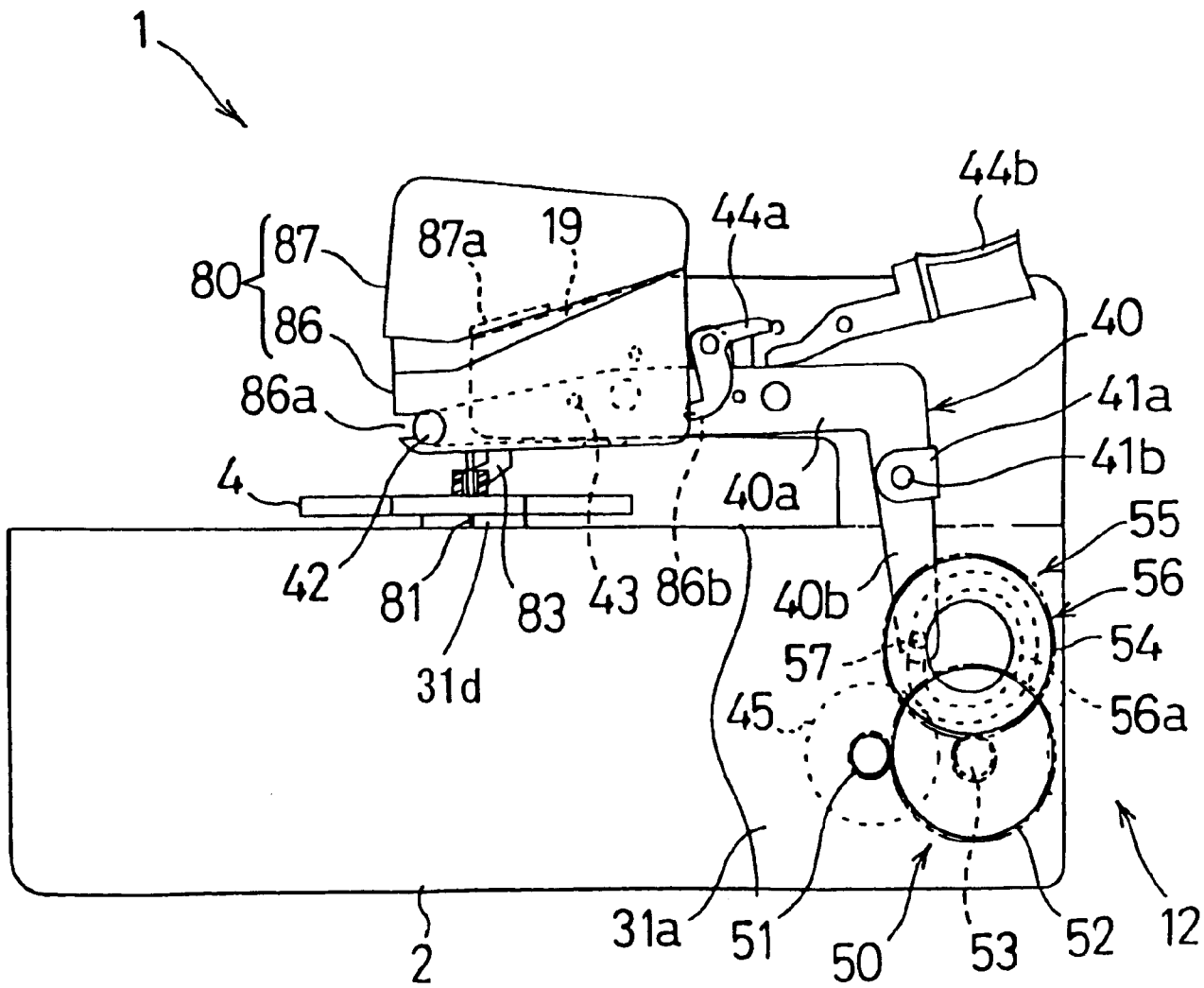
FIG. 8 is a partial perspective view of the sewing apparatus (when the hollow needle is in a lower limit position) as seen from the front.

As shown in FIGS. 6 to 8, the gear mechanism 50 includes gears 51 to 54 disposed in front of the front wall 31*a* of the support frame 31. The drive gear 51 is fixed to the output shaft of the machine motor 45. The intermediate gears 52, 53 are integrally connected and rotatably supported on the same shaft and the large-diameter gear 54 is rotatably supported on another shaft. The drive gear 51 engages the intermediate gear 52. The intermediate gear 53 engages the large-diameter gear 54. Thus, rotation speed of the large-diameter gear 54 is reduced with respect to the rotation speed of the machine motor 45 (the drive gear 51).

As shown in FIGS. 6 to 9, the cam mechanism 55 has a cam 56 that is rotatably supported by the front wall 31*a* and a cam follower 57 that is fixedly attached to the right end of the swing arm 40 to protrude toward the front. The outer region of the cam 56 is formed with gear teeth of the large-diameter gear 54. A cam groove 56*a* is formed on the back of the cam 56. The cam follower 57 is slidably engaged with the cam groove 56*a*.

Figure 9:
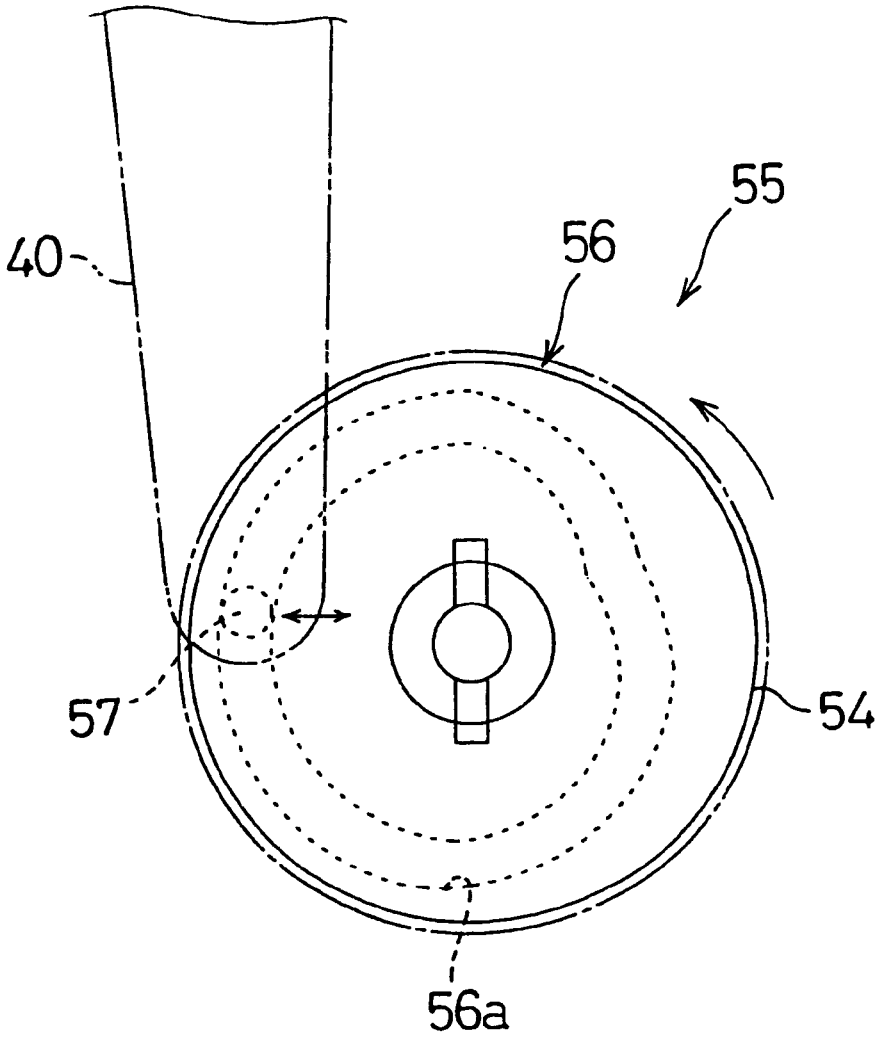
FIG. 9 is a front view of a cam.
Figure 10:
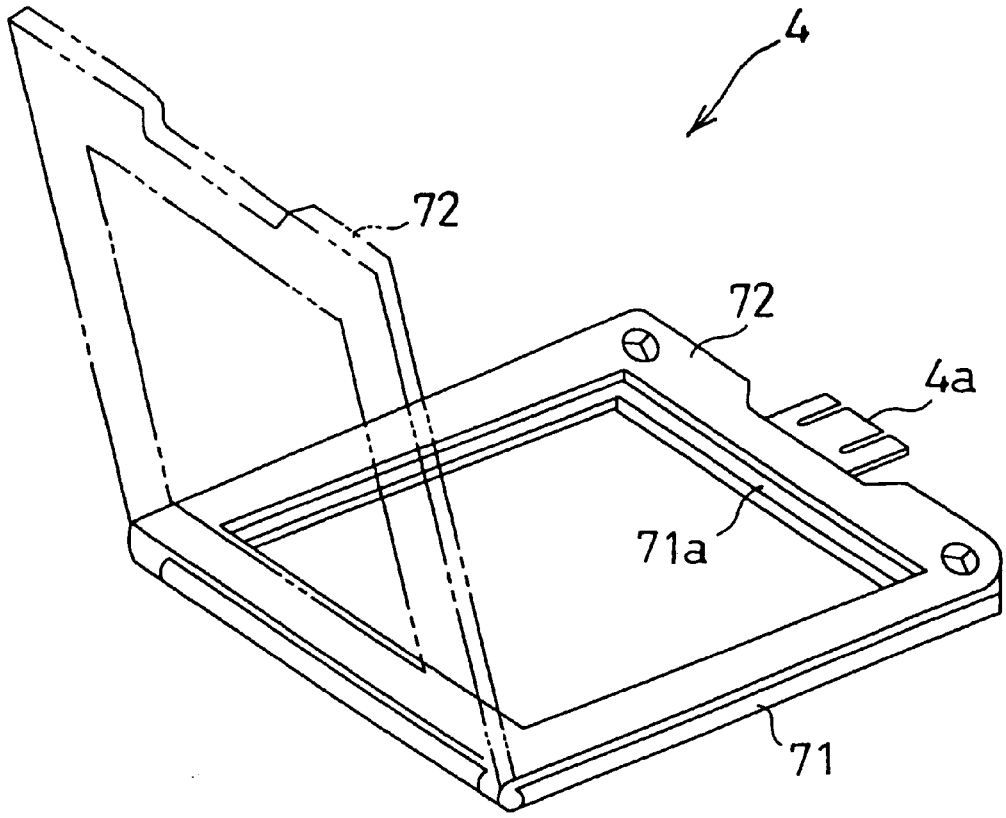
FIG. 10 is a perspective view of an embroidery frame of the first embodiment of the invention.

As shown in FIG. 9, the cam groove 56*a* is formed into a loop wherein a distance between the cam groove 56*a* and a center of rotation of the cam 56 is changed. When the cam 56 is turned, the arm portion 40*a* travels vertically between an upper limit position, shown in FIG. 7, and a lower limit position, shown in FIG. 8. As a distance between an engaging position where the cam follower 57 engages the cam groove 56*a* and a center of an axis of rotation of the cam 56 becomes longer, the cam follower 57 is located at a further left position and the arm portion 40*a* of the swing arm 40 is located at a further upper position. FIG. 9 shows a state where the cam follower 57 engages a position which is farthest from the center of rotation of the cam 56 in the cam groove 56*a*. In this state, the arm portion 40*a* of the swing arm 40 is in the upper limit position of FIG. 7.

As shown in FIGS. 2 to 5, the safety cover 3 has a function of protecting the embroidery frame 4, the sewing cartridge 5, and the swing arm 40 which are to be moved, a function of covering the hollow needle 81 and the embroidery frame moving area 38 so that a user, such as a child, will not be hurt, and a function of preventing an occurrence of undesired operation of the start/stop switch 16. The safety cover 3 can cover the entire embroidery frame moving area 38. The safety cover 3 can be moved between a sewing position (see FIG. 3), where the safety cover 3 covers the embroidery frame moving area 38 at the time when sewing is executed, and a storage position (see FIG. 2), where the safety cover 3 is in a position for storage or packing.

The safety cover 3 is formed of a transparent or a translucent material made of a synthetic resin. The safety cover 3 has an upper wall 3*a*, a front wall 3*b*, and right and left walls 3*c*. The safety cover 3 does not have a lower wall or a rear wall. The upper wall 3*a* of the safety cover 3 is formed with a recessed area 3*d* which is recessed at the rear, generally center portion. The recessed area 3*d* engages the guide upper surface 10*e* of the casing 10 so that the safety cover 3 can slide back and forth. The lower surface of the upper wall 3*a* of the safety cover 3 can contact the upper surface of the upper wall 10*d* of the casing 10, except for the guide upper surface 10*e*.

A vertical plate 60 is fixed inside of the rear part of each side wall 3*c* of the safety cover 3. An engagement piece 66 is fixed inside of the upper rear portion of each vertical plate 60. An engagement portion 60*a* is integrally formed with each vertical plate 60 under the engagement piece 66. Each engagement piece 66 slidably engages a guide groove 10*g* formed in each side wall 10*f* of the casing 10. The guide groove 10*h* is also formed in each side wall 10*f*. Each engagement portion 60*a* slidably engages a guide groove 10*h*. Inside of the forward part of the right side wall 3*c* of the safety cover 3, is fixed an engagement piece 61, which can slidably engage the guide groove 10*g*.

A stopper mechanism 65 is provided to position the safety cover 3 in the sewing position and to regulate the safety cover 3 so as not to be removed from the sewing apparatus body 2. The stopper mechanism 65 has the engagement pieces 66 fixed to each side wall 3*c* of the safety cover 3 and engagement block pieces 67 fixed to the guide groove 10*g* of each side wall 10*f* of the casing 10. When the guide pieces 66 engage the engagement block pieces 67, the safety cover 3 is in the sewing position. As a result, the safety cover 3 cannot move forward from the sewing position.

In a state where the safety cover 3 is switched to the storage position shown in FIG. 2, the recessed area 3*d* of the safety cover 3 completely engages the guide upper surface 10*e* of the casing 10. The rear end of the upper wall 3*a* of the safety cover 3 contacts the stepped portion of the guide upper surface 10*e*. The front wall 3*b* of the safety cover 3 is brought closer to the front surface of the casing 10. When the safety cover 3 is in the storage position, the embroidery frame moving area 38 is not entirely covered by the safety cover 3. As the safety cover 3 is switched to the sewing position shown in FIG. 3, by sliding the safety cover 3 forward from the storage position shown in FIG. 2, the entire embroidery frame moving area 38 is covered with the safety cover 3.

In a state where the safety cover 3 is switched to the sewing position shown in FIG. 3, a cartridge insertion slot 68 is formed by the front end of the guide upper surface 10*e* of the casing 10 and the recessed area 3*d* of the safety cover 3. The width of the cartridge insertion slot 68 is substantially equal to the width of the sewing cartridge 5 (see FIG. 4). The length of the cartridge insertion slot 68 is longer than that of the sewing cartridge 5. The sewing cartridge 5 can be attached to the swing arm 40 by inserting the sewing cartridge 5 from the cartridge insertion slot 68. When the sewing cartridge 5 is inserted into the safety cover 3 from the cartridge insertion slot 68, the sewing cartridge 5 is guided by the cartridge insertion portion 68 and attached to the swing arm 40. In a state where the sewing cartridge 5 is attached to the sewing apparatus body 2, the safety cover 3 is regulated in its position to the sewing position by the sewing cartridge 5.

A switch operating hole 3*e* is formed on the right in the upper wall 3*a* of the safety cover 3. When the safety cover 3 is in the storage position shown in FIG. 2, the switch operating hole 3*e* is opposed to the power switch 15. Therefore, the power switch 15 can be operated via the switch operating hole 3*e*. In this state, the start/stop switch 16 is covered with the safety cover 3, so that the start/stop switch 16 cannot be operated.

The power switch 15 is disposed to the rear of the start/stop switch 16. The distance between centers of the power switch 15 and the start/stop switch 16 is the same as sliding amount of back-and-forth movement of the safety cover 3. Accordingly, in the state where the safety cover 3 is in the sewing position shown in FIG. 3, the switch operating hole 3*e* is opposed to the start/stop switch 16, so that the start/stop switch 16 can be operated via the switch operating switch 16. That is, the prohibition provided by the safety cover 3 is withdrawn.

When the safety cover 3 is in the sewing position, the power switch 15 is exposed at the rear portion of the safety cover 3. Therefore, the power switch 15 can be also operated. As described above, the power switch 15 can be operated when the safety cover 3 is in both the sewing position and the storage position. The power switch 15, the start/stop switch 16, and the switch operating hole 3*e* are formed in the substantially same size as seen from above.

An embroidery frame insertion slot 3*f* is formed at a substantially middle portion in the right and left direction (perpendicular to the sliding direction of the safety cover 3) of the lower portion of the front wall 3*b* of the safety cover 3. The embroidery frame 4 can be inserted into the safety cover 3 via the embroidery frame insertion slot 3*f*. A guide member 69 protruding forward is fixed to the front wall 3*b*. The guide member 69 guides the embroidery frame 4 in the back and forth direction when the embroidery frame 4 is attached to the carriage 18 by inserting the embroidery frame 4 into the safety cover 3 from the embroidery frame insertion slot 3*f*. The embroidery frame insertion slot 3*f* is in the middle portion of the front wall 3*b* in the right and left position and in a position displaced to the right slightly from a middle position within the moving range of the carriage 18 in the right and left direction (a middle position of the embroidery frame moving area 38 in the right and left direction).

When the carriage 18 is positioned substantially under the swing arm 40, the carriage 18 is in a foremost position. Accordingly, the embroidery frame 4, which is guided by the guide member 69 and is inserted into the inside of the safety cover 3 via the embroidery frame insertion slot 3*f*, can be attached to the carriage 18. The guide member 69 doubles as a pull for moving the safety cover 3.

As shown in FIGS. 2, 6, 10, and 11, the embroidery frame 4 is formed with a base frame 71 having a rectangular shape and a holding frame 72. The base frame 71 and the holding frame 72 are rotatably connected each other at their front ends. The rear end support portion 4*a* is formed integral with the base frame 4*a* at the rear end. The rear end support portion 4*a* can engage/disengage the embroidery frame 4 with/from the engaging portion 18*a* of the carriage 18. A stepped portion 71*a* is formed to the internal edge of the base frame 71. An outer region of a special work cloth 70 is fit to the stepped portion 71*a*. The work cloth 70 is attached to substantially the entire embroidery frame 4 when the work cloth 70 is held by the holding frame 72 under tension. The work cloth 70 may be releasably attached to substantially the entire embroidery frame 4 via a double-sided adhesive tape or an adhesive.

Figure 11:
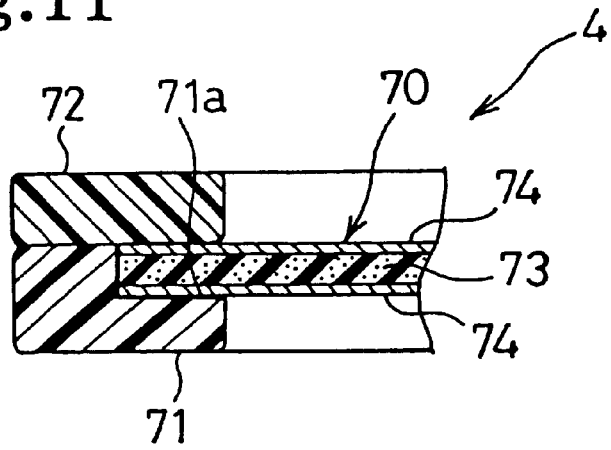
FIG. 11 is a fragmentally vertical sectional view of the embroidery frame.

As shown in FIG. 11, for example, the work cloth 70 is a special cloth that has elasticity and a multi-layer structure formed by which an elastic film member 73 made of urethane is sandwiched by pieces of cloth 74 by lamination. A plurality of the embroidery frames 4 with the work cloth 70 attached in advance are kept at the ready.

As shown in FIGS. 2, 3, and 12 to 21, the sewing cartridge 5 includes a cassette body 80, the hollow needle 81 that can pass through the work cloth 70, a spool 82 around which a thread 99 to be supplied to the hollow needle 81 is wound, a needle cover 83 that covers at least a tip of the hollow needle 81, a coil compression spring 84 that urges the needle cover 83 to a cover position where the needle cover 83 covers the hollow needle 81, and a movement prohibiting mechanism 85 that prohibits the movement of the needle cover 83 positioned at the cover position. For this sewing apparatus 1, a plurality of sewing cartridges 5 that can be detachably attached to the swing arm 40 are prepared. The sewing cartridges 5 each accommodate different colors, so that a colorful embroidery pattern can be formed using several sewing cartridges 5.

The cassette body 80 has a rectangular shape like a horizontally oriented standing matchbox. The cassette body 80 has a housing case 86 and an openable cover 87. The housing case 86 is movable with respect to the sewing apparatus body 2 in a state where the cassette body 80 is attached to the swing arm 40. The openable cover 87 is substantially fixed with respect to the sewing apparatus body 2. The housing case 86 accommodates the upper portion of the hollow needle 81 and the needle cover 83, the spool 82, the coil compression spring 84, and the movement prohibiting mechanism 85. The housing case 86 and the openable cover 87 are rotatably connected to each other at an upper left portion of the cassette body 80 (as viewed in FIGS. 18 and 19). The openable cover 87 travels between a closed position shown in FIG. 18 and an open position shown in FIG. 19 with respect to the housing case 86. A torsion spring 88 is attached to a pivot shaft that pivotally supports the openable cover 87 with respect to the housing case 86. The openable cover 87 is rotatably urged to the closed position by the torsion spring 88.

The sewing cartridge 5 includes a housing area 90 wherein the spool 82 is housed, an excessive rotation preventive mechanism 91, a backflow preventive mechanism 92, and a locking mechanism 93. The excessive rotation preventive mechanism 91 prevents the spool 82 accommodated in the housing area 90 from rotating excessively in the thread supply direction so that excessive feeding of the thread 99 is prevented. The backflow preventive mechanism 92 prevents the thread 99 from being drawn back to the housing area 90 side from the hollow needle 81 side by applying resistance to the thread 99 drawn partway from the spool 82 to the hollow needle 81. The locking mechanism 93 locks the openable cover 87 in the closed position with respect to the housing case 86. The housing area 90, the excessive rotation preventive mechanism 91, and a locking member 110 of the locking mechanism 93 are provided inside the housing case 86. The backflow mechanism 92 and an engaged portion 87*d* of the locking mechanism 93 are provided inside the openable cover 87.

Figure 12:
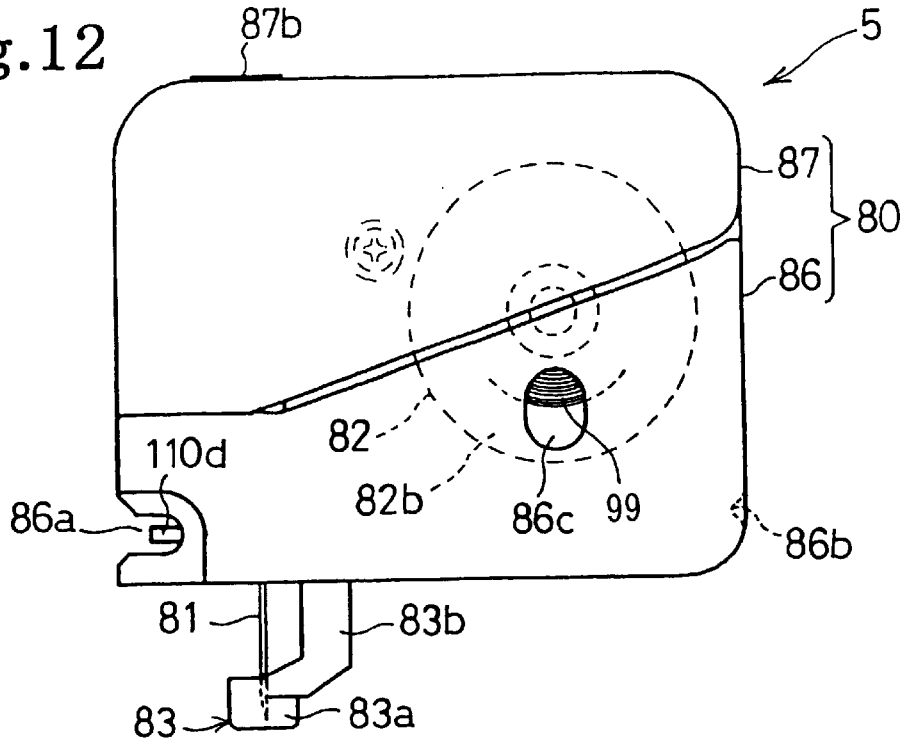
FIG. 12 is a front view of a sewing cartridge of the first embodiment of the invention.
Figure 13:
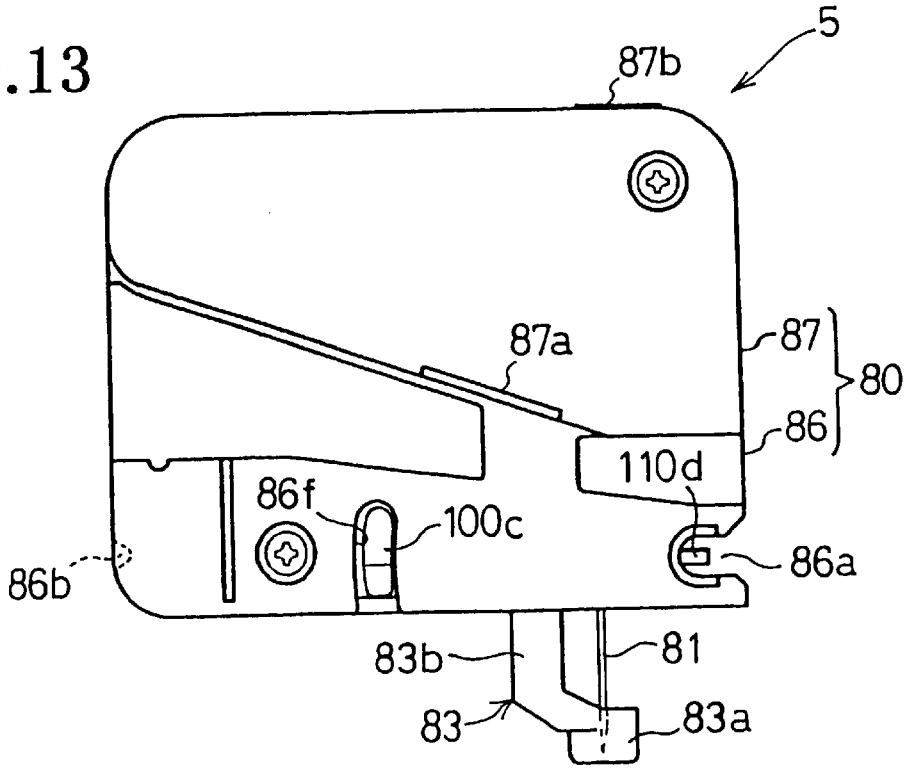
FIG. 13 is a rear view of the sewing cartridge.
Figure 14:
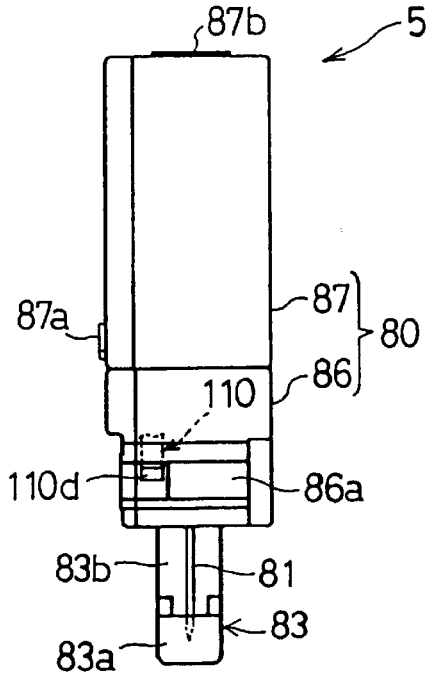
FIG. 14 is a left side view of the sewing cartridge.
Figure 15:
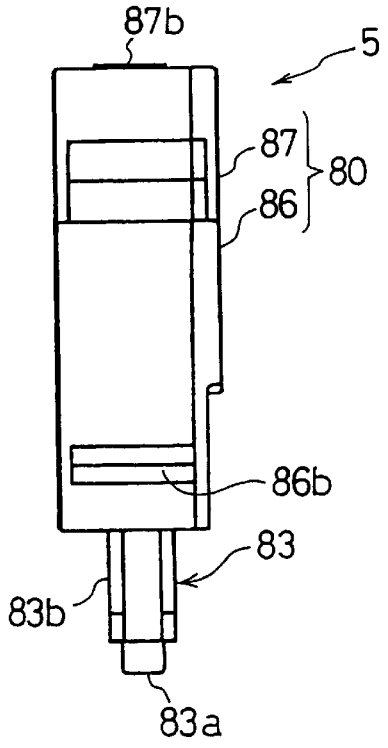
FIG. 15 is a right side view of the sewing cartridge.
Figure 16:
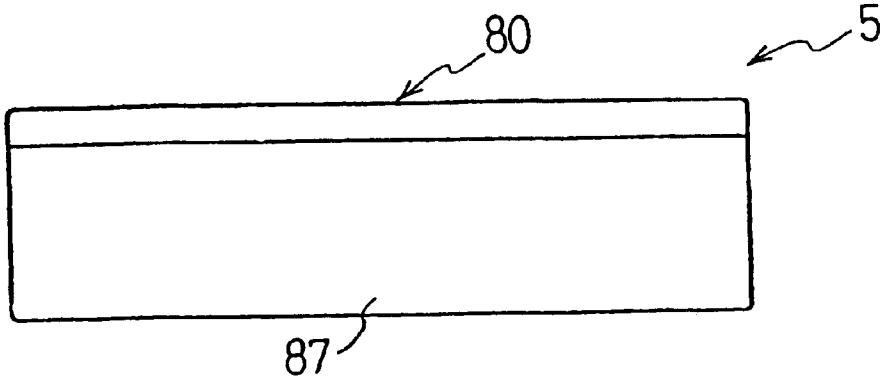
FIG. 16 is a plan view of the sewing cartridge.
Figure 17:
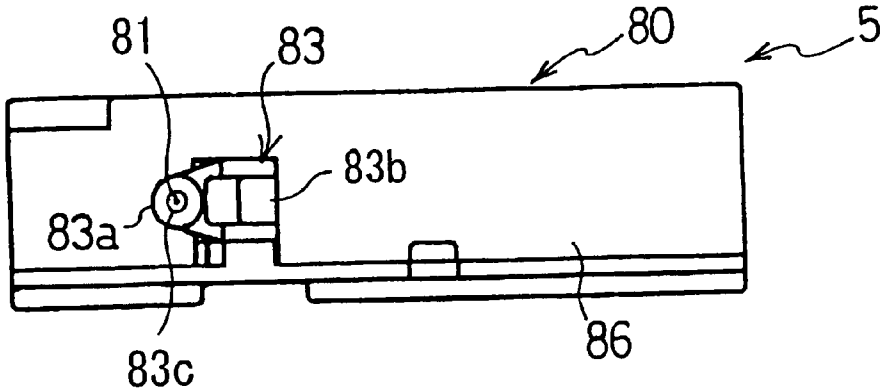
FIG. 17 is a bottom view of the sewing cartridge.
Figure 18:
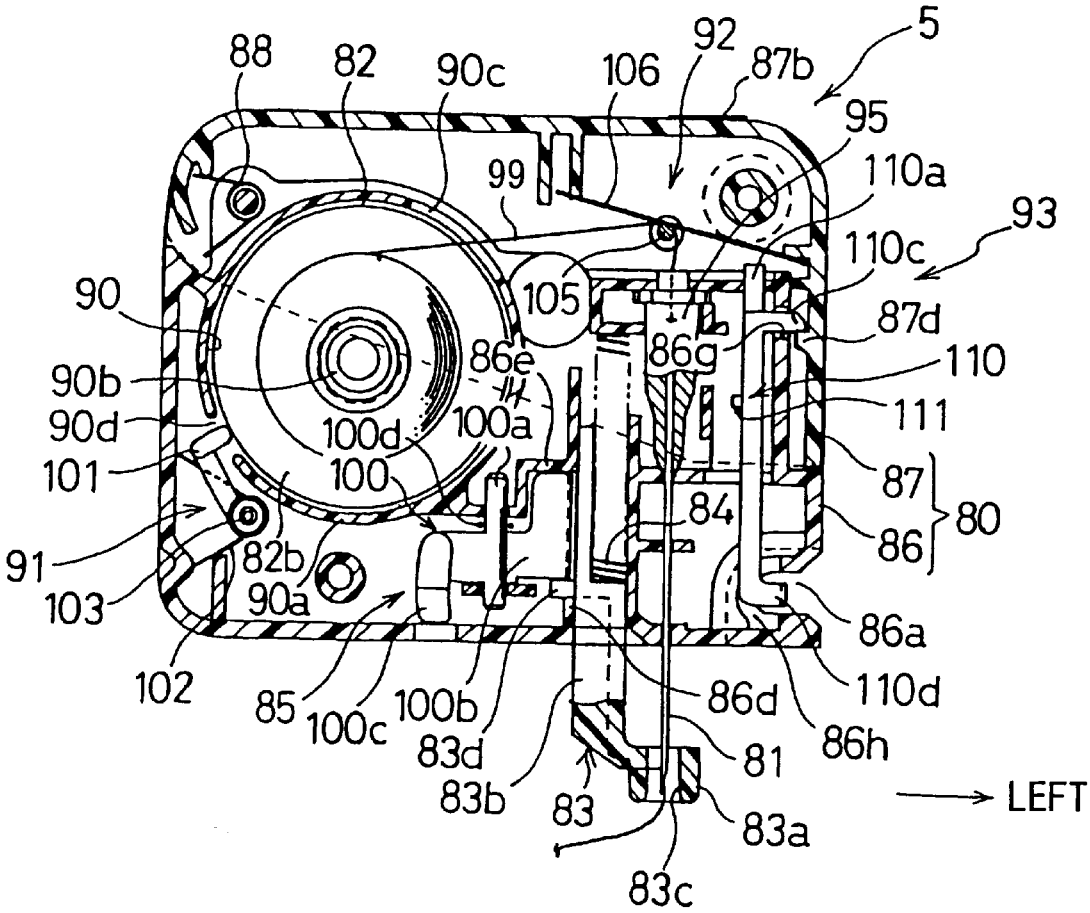
FIG. 18 is a vertical sectional view of the sewing cartridge (in a closed state)
Figure 19:
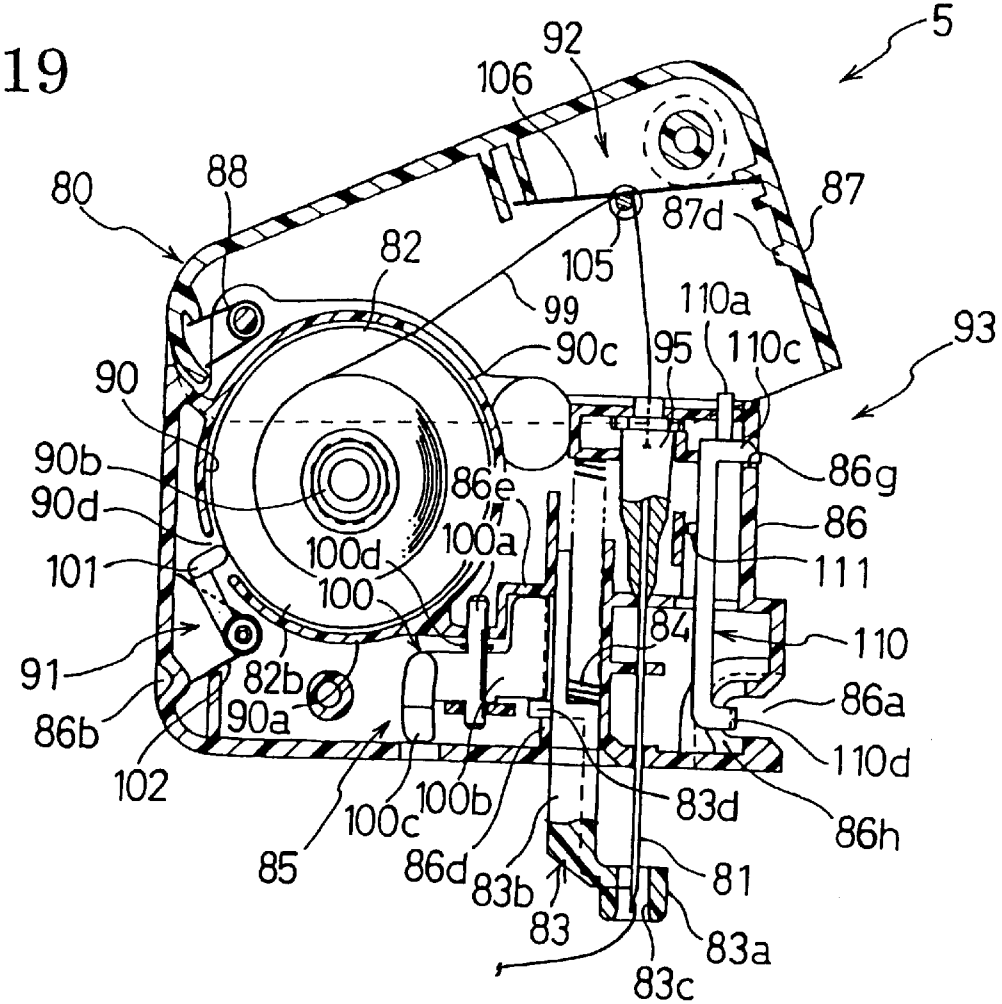
FIG. 19 is a vertical sectional view of the sewing cartridge (in an open state)

As shown in FIG. 12, a U-shaped engagement recess 86*a* is formed in a lower left portion (corresponding to the right portion as shown in FIGS. 18 and 19) of the housing case 86. The engagement recess 86*a* is cut away from the left and can engage the engaging pin 42 of the swing arm 40. A recessed engagement groove 86*b*, that can engage the engaging member 44*a* provided to the swing arm 40, is formed in a lower right portion of the housing case 86. Here, attachment/detachment of the sewing cartridge 5 to/from the swing arm 40 will be described.

Figure 22:
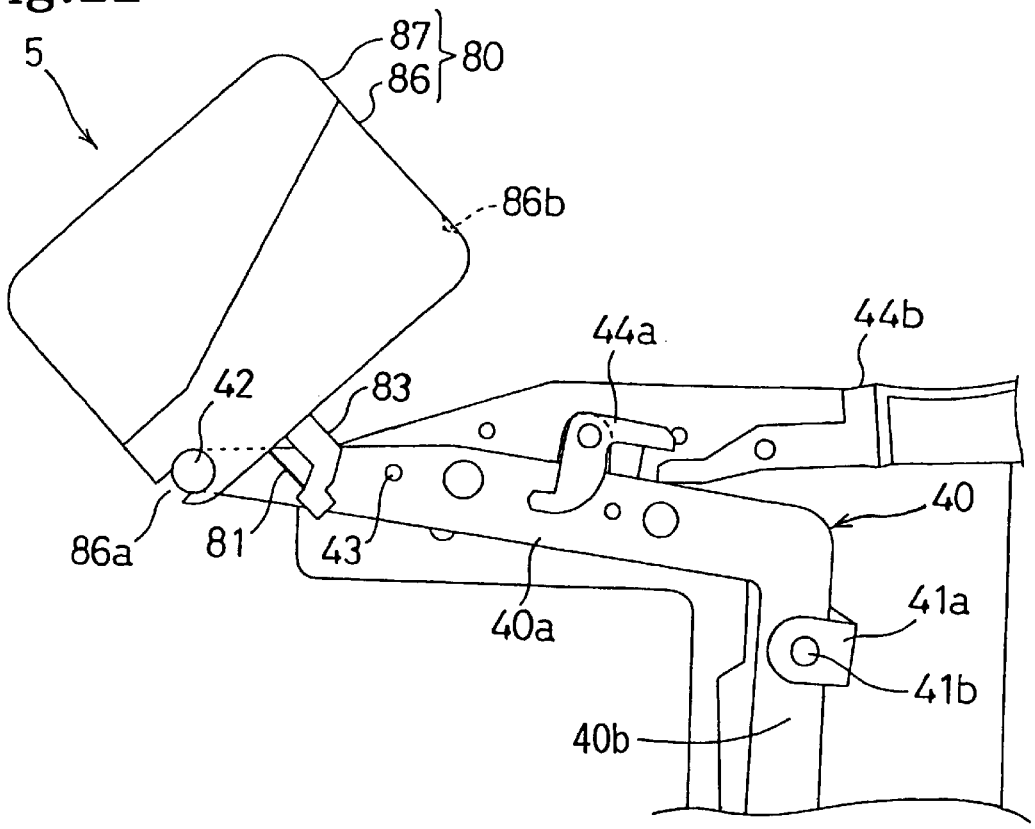
FIG. 22 is a front view of a swing arm and the sewing cartridge (when the sewing cartridge is not completely attached to the swing arm)
Figure 23:
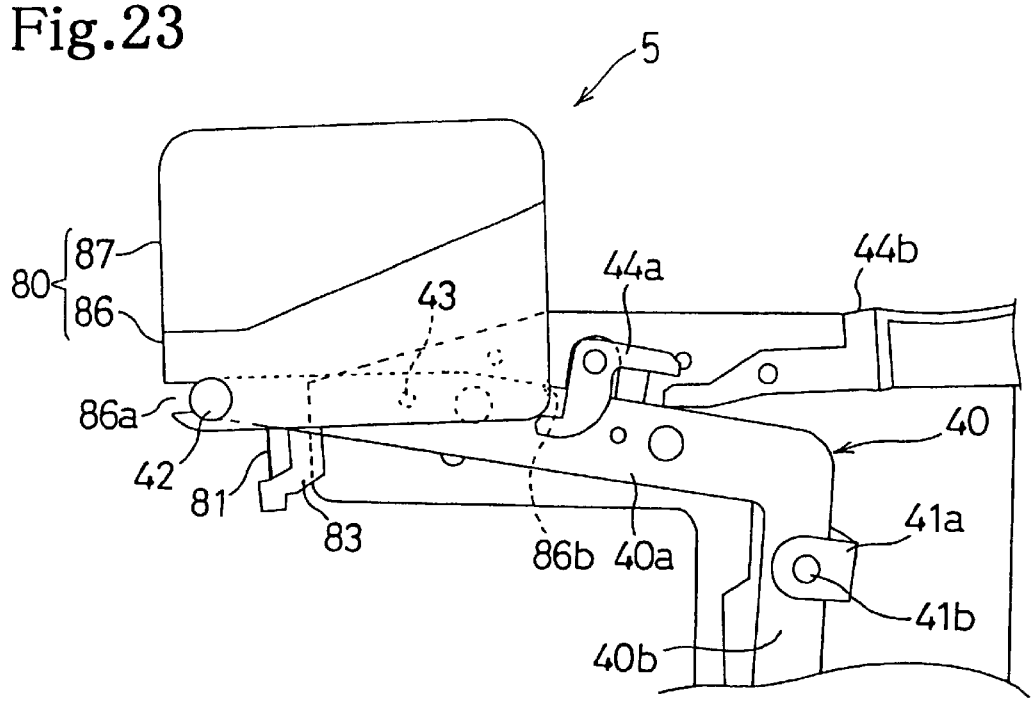
FIG. 23 is a front view of the swing arm and the sewing cartridge (when the sewing cartridge is not completely attached to the swing arm)
Figure 24:
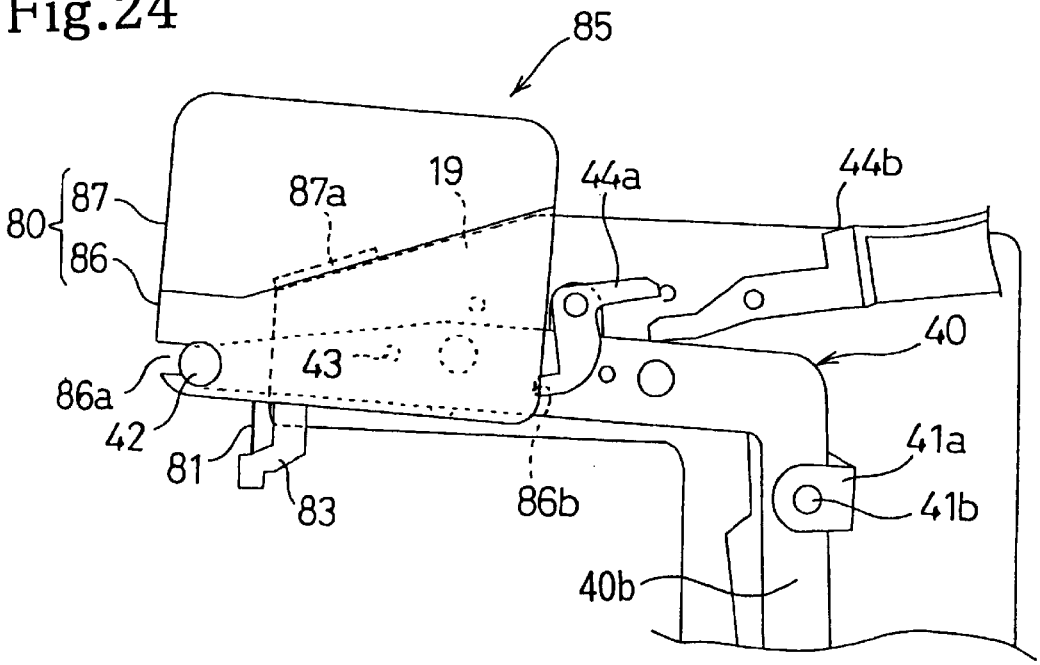
FIG. 24 is a front view of the swing arm and the sewing cartridge (when the sewing cartridge is completely attached to the swing arm)
Figure 25:
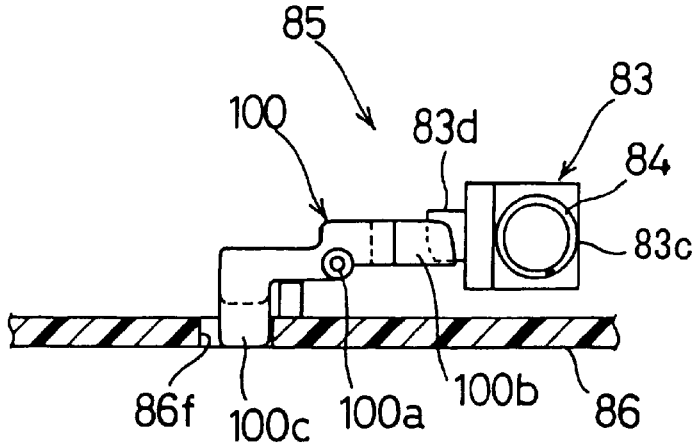
FIG. 25 is a plan view of a movement prohibiting mechanism (in a locked position)
Figure 26:
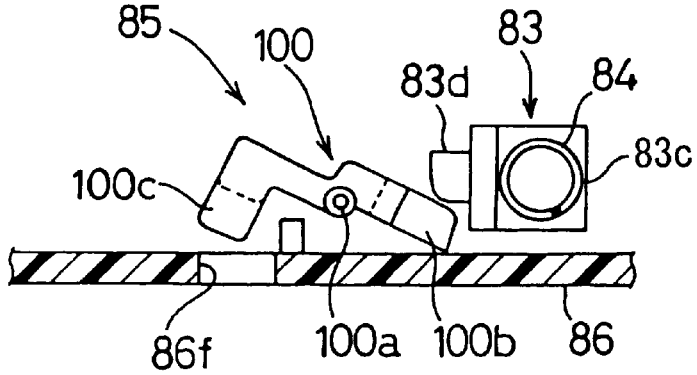
FIG. 26 is a plan view of the movement prohibiting mechanism (in an unlocked position)

When the sewing cartridge 5 is attached to the swing arm 40, the sewing cartridge 5 is inserted from the cartridge insertion slot 68, formed by the forward movement of the safety cover 3, while inclined leftwardly and downwardly. As shown in FIG. 22, the engagement recess 86*a* is engaged with the engaging pin 42, and then the sewing cartridge 5 is rotated clockwise so as to be in an attachment position where the sewing cartridge 5 is placed in a horizontal position. As shown in FIG. 23, a lower right end portion of the sewing cartridge 5 contacts the engaging member 44*a* slightly before the sewing cartridge 5 reaches the horizontal position. As the sewing cartridge 5 reaches the horizontal position, the engaging member 44*a* rotates counterclockwise against an urging force from the torsion spring. Then, the engaging member 44*a* is rotated clockwise by the urging force from the torsion spring, so that the engaging member 44*a* is returned a small amount. Thus, as shown in FIG. 24, the housing case 86 is fixedly attached to the swing arm 40.

The sewing cartridge 5 is attached to the swing arm 40 in a state where the swing arm 40 is in the upper limit position. As described above, when the housing case 86 is fixedly attached to the swing arm 40, as shown in FIGS. 7 and 24, an engaged portion 87*a* of the openable cover 87 engages the left end of the engagement plate 19 of the sewing apparatus body 2 so as to abut against it from the above. Thus, the housing case 86 is substantially fixed to the sewing apparatus body 2. When the sewing cartridge 5 is detached from the swing arm 40, the operating member 44*b* is rotated clockwise, so that the engaging member 44*a* is rotated counterclockwise against the urging force from the torsion spring via the operating member 44*b*. By doing so, as shown in FIG. 23, the engaging member 44*a* is disengaged from the engagement groove 86*b*. Thus, the sewing cartridge 5 can be removed from the swing arm 40 in a manner reverse to the operation for attaching the sewing cartridge 5 to the swing arm 40.

An opening 86*c* is formed in the front wall in front of the housing area 90 in the housing case 86 of the cassette body 80. A remaining amount of a thread 99 wound around the spool 82 housed in the housing area 90 can be visually confirmed from the outside through the opening 86*c*. A thread color indicating portion 87*b*, that indicates a same/similar color as the color of the thread 99 wound around the spool 82, housed in the housing area 90, is provided on a top surface of the openable cover 87 of the cassette body 80, to which a color chip, that is the same as or similar to the color of the thread 99, is adhered.

Flanges 82*b* of the spool 82 are transparent or translucent. Accordingly, a remaining amount of the thread 99 wound around the spool 82 housed in the housing area 90 can be visually confirmed from the opening 86*c* through the flange 82*b*. Because the thread color indicating portion 87*b* is provided on the top surface of the openable cover 87, the thread color indicating portion 87*b* is visually exposed to the outside in a state where the sewing cartridge 5 is attached to the sewing apparatus body 2.

The hollow needle 81 is disposed at the left part (FIGS. 2, 3, 7 and 12) of the inside of the cassette body 80 in a substantially standing posture. At least the upper end portion of the hollow needle 81 is supported by a tube-like needle support member 95 (FIGS. 18 and 19) fixedly attached to the housing case 86. The lower end portion of the hollow needle 81 protrudes from the bottom of the cassette body 80. A tip of the hollow needle 81 is pointed such that the tip is inclined rightwardly and downwardly from the left to the right (FIG. 12). When the sewing cartridge 5 is installed in the sewing apparatus body 2, an extreme tip of the hollow needle 81 is in an end portion of the sewing cartridge 5 on a center-of-swing side of the swing arm 40 (at a left end portion in FIGS. 2, 3, 12, 23 and 24).

In FIG. 18, a circular wall 90*a*, which is formed integral with the housing case 87 and protrudes therefrom, forms the housing area 90 in the left half in the housing case 87. The spool 82 housed in the housing area 90 is fit onto a shaft 90*b* of the housing case 87 and is rotatably supported by the shaft 90*b*. The thread 99 extending from the spool 82 is fed into the hole formed in the hollow needle 81 from above via the backflow preventive mechanism 92 from a thread passing aperture 90C formed in the circular wall 90C. The thread 99 is drawn to the outside of the sewing cartridge 5 from the lower end of the hollow needle 81.

The upper thread 99, wound around the spool 82, is not very heavy. A thread hole of the hollow needle 51 is formed so that the thread 99 can be threaded through the hollow needle 81. A sewing operation is performed when a certain length of the thread 99 is drawn from the lower end of the hollow needle 81.

The needle cover 83 can move between a cover position where the needle cover 83 covers the tip of the hollow needle 81 and a retracted position where the needle cover 83 retracts to a position above the cover position so that the hollow needle 81 can pass through the work cloth 70. The needle cover 83 also serves as a presser foot that holds the work cloth 70 at the time of sewing. The needle cover 83 includes a cover portion 83*a* and a guided portion 83*b* extending upward from the right end of the cover portion 83*a*. The cover portion 83*a* and the guided portion 83*b* are integrated into a single part to form the needle cover 83.

The cover portion 83*a* is formed with a needle passing hole 83*c* through which the hollow needle 81 passes. The guided portion 83*b* is vertically movably guided by the housing case 86. The coil compression spring 84 is interposed between the guided portion 83*b* and the housing case 86. A protrusion 83*d*, protruding leftward in FIG. 18, is provided at a middle portion of the guided portion 83*b* in the up and down direction. In a state where the protrusion 83*d* abuts against an upper end of a rib 86*d* that guides the guided portion 83*b* in the up and down direction, the needle cover 83 is in the cover position. Further, the tip of the hollow needle 81 is positioned inside of the needle passing hole 83*c*, so that the tip of the hollow needle 83 is covered with the cover portion 83*a*. As the needle cover 83 moves upward with respect to the hollow needle 81, the needle cover 83 is placed in the retracted position. Thus, the hollow needle 81 passes through the needle passing hole 83*c* and protrudes from the bottom of the cover portion 83*a*.

As shown in FIGS. 18 to 20 and 25 to 27, the movement prohibiting mechanism 85 has a movement prohibiting member 100 disposed at a middle, lower portion, in the right and left direction, inside of the housing case 86. The movement prohibiting member 100 includes a vertical pivot shaft portion 100*a*, a locking portion 100*b* disposed on the right of the pivot shaft portion 100*a* (FIGS. 18, 19, 25 and 26) and an engaged portion 100*c*, that engages the lock release pin 43, disposed on the left of the pivot shaft portion 100*a*. The vertical pivot shaft portion 100*a*, the locking portion 100*b*, and the engaged portion 100*c* are integral and form a unitary structure. In the movement prohibiting member 100, the pivot shaft portion 100*a* is pivotally supported to the housing case 86, so that the movement prohibiting member 100 is rotated about the pivot shaft portion 100*a*. The movement prohibiting member 100 cannot move vertically.

The locking portion 100*b* is relatively long in the up and down direction. The lower end of the locking portion 100*b* substantially abuts against an upper surface of the protrusion 83*d* of the needle cover 83 in the cover position, that is, where the lower surface of the protrusion 83*d* is abutted against the upper surface of the rib 86*d*. In this state, the locking portion 100*b* is positioned between a rib 86*e*, in the cassette body 80, and the protrusion 83*d*. Thus, the needle cover 83 is locked in the cover position, and cannot move upward. The movement prohibiting member 100 can be rotated between a locked position (see FIG. 25) and an unlocked position (see FIG. 26) where the locking portion 100*b* is moved out of the way of the up and down movement of the protrusion 83*d* between the rib 86*e* and the rib 86*d*. Therefore, when the movement prohibiting member 100 is placed in the unlocked position, the needle cover 83 can be movable if the needle cover 83 is pushed upwardly against the elastic force from the coil compressing spring 84. The needle cover 83 is pushed upwardly when the sewing cartridge 5 is moved to the sewing position by the movement of the swing arm 40. At that time, the needle cover is pushed against a needle plate 31*d*, having a hole through which the hollow needle 81 can pass, formed on the support frame 31, via the work cloth 70 (see FIG. 8).

A torsion spring 100*d* is attached to the pivot shaft portion 100*a*. The movement prohibiting member 100 is rotatably urged to the locked position by the torsion spring 100*d*. In a state where the sewing cartridge 5 is not attached to the sewing apparatus body 2, the movement prohibiting member 100 is maintained in the locked position. The rear wall of the housing case 86 is formed with an opening 86*f* corresponding to the engaged portion 100*c* (FIGS. 18 and 19). When the movement prohibiting member 100 is in the locked position, the engaged portion 100*c* protrudes toward the outside from the opening 86*f*.

Figure 27:
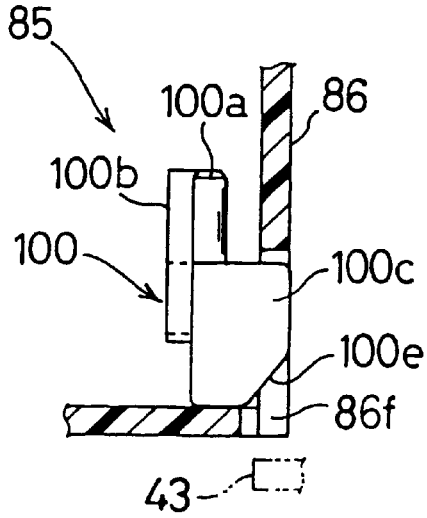
FIG. 27 is a side view of the movement prohibiting mechanism.
Figure 28:
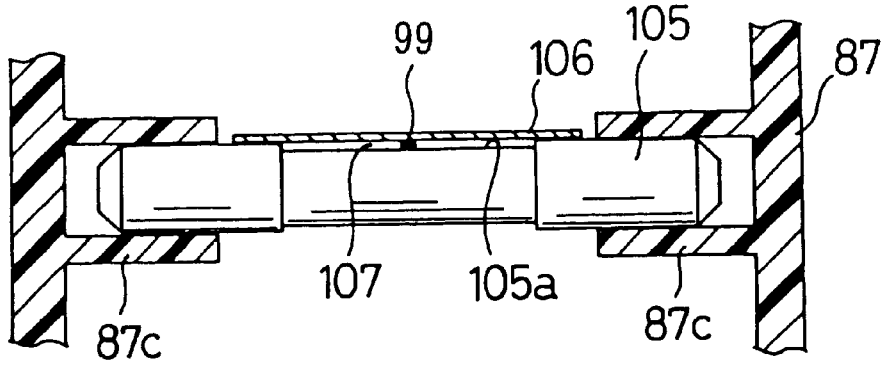
FIG. 28 is a vertical sectional view of a backflow preventive mechanism.
Figure 29:
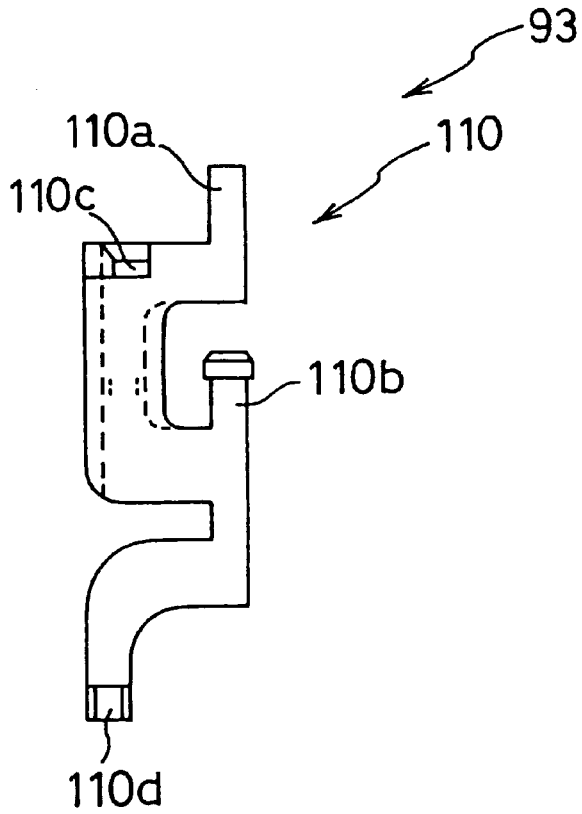
FIG. 29 is a side view of a locking member of a locking mechanism.

As shown in FIG. 27, the opening 86*f* extends to the lower wall of the housing case 86. The bottom of the engaged portion 100*c* is formed with a tapered portion 100*e* that inclines externally and upwardly. As described above, the lock release pin 43 is provided to the swing arm 40. When the sewing cartridge 5 is attached to the swing arm 40, the lock release pin 43 enters into the opening 86*f* from the bottom and engages the tapered portion 100*e* of the engaged portion 100*c*. As a result, the movement prohibiting member 100 is rotated from the locked position to the unlocked position against the urging force from the torsion spring 100*d*, so that the needle cover 83 is unlocked and can be movable upwardly as described above.

As described above, in the state where the sewing cartridge 5 is not attached to the sewing apparatus body 2, the movement prohibiting member 100 prohibits the needle cover 83 in the cover position from moving therefrom. In the state where the sewing cartridge 5 is attached to the sewing apparatus body 2, the needle cover 83 is allowed to move from the cover position to the retracted position.

Figure 20:
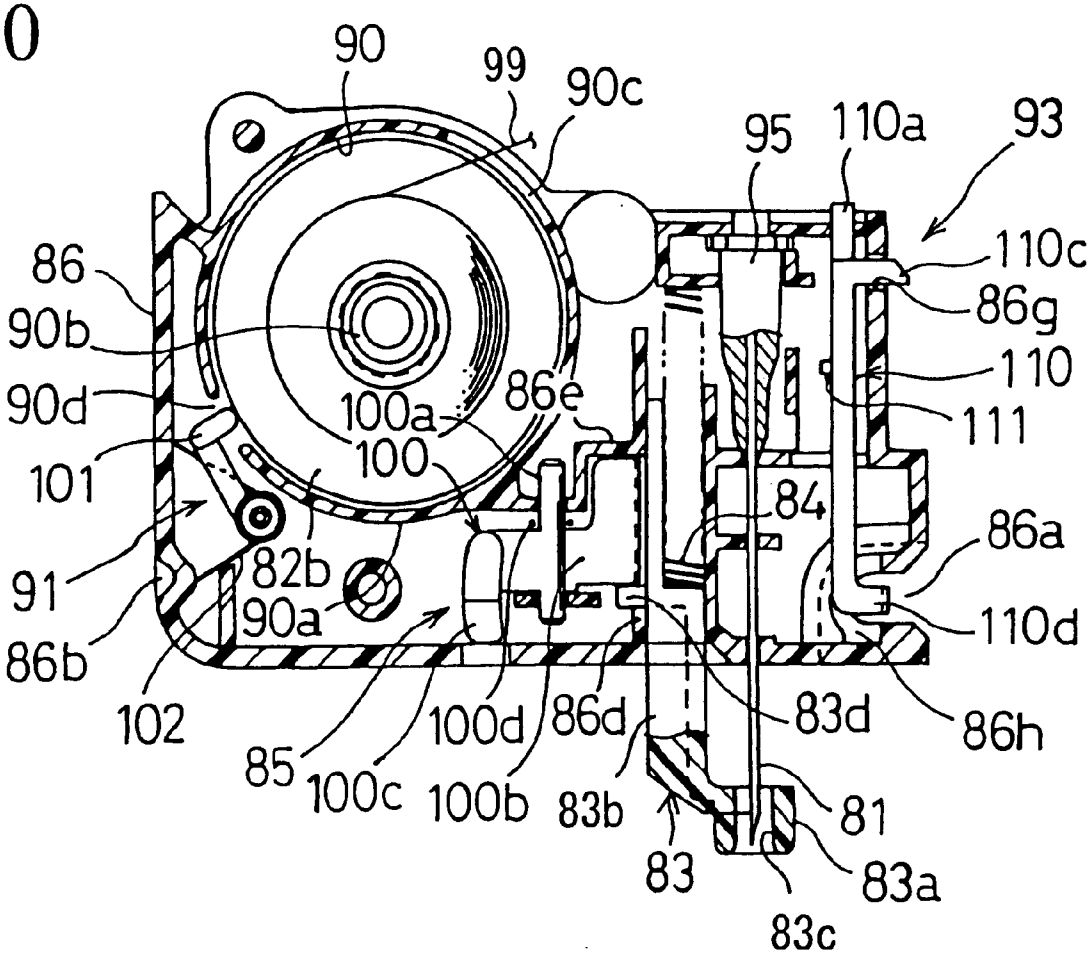
FIG. 20 is a vertical sectional view of a housing case of the sewing cartridge.
Figure 21:
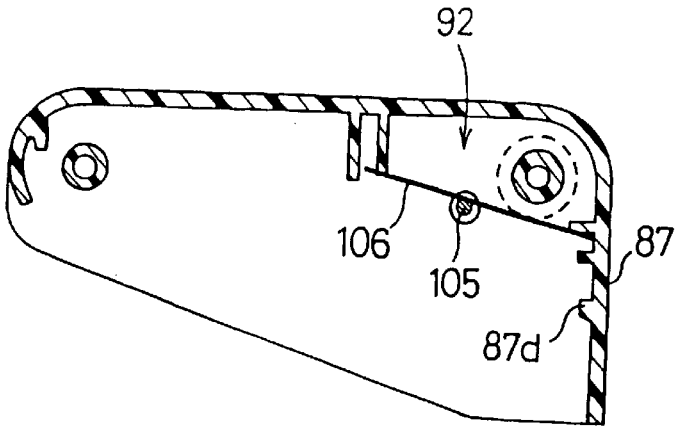
FIG. 21 is a vertical sectional view of an openable cover of the sewing cartridge.

As shown in FIGS. 18 to 20, the excessive rotation preventive mechanism 91 has a contact 101 that can contact one of the flanges 82*b* of the spool 82, and a torsion spring 102 that urges the contact 101 against the flange 82*b*. By the friction produced between the contact 101 and the flange 82*b*, the spool 82 is prevented from excessively rotating in the thread supply direction to prevent the excessive feeding of the thread 99. The contact 101 is pivotally supported by a shaft 103 disposed near the housing area 90 in the housing case 86. The shaft 103 is provided with the torsion spring 102. The tip of the contact 101 contacts the flange 82*b* of the spool 82 in the housing area 90 by passing through an aperture 90*d* formed in the circular wall 90*a*.

As shown in FIGS. 18, 19, 21, and 28, the backflow preventive mechanism 92 has two backflow preventive members, a guide pin 105 and a leaf spring 106 abutting against the guide pin 105. Between the guide pin 105 and the leaf spring 106, a thread passing portion 107, which has extremely small clearance, is provided. The thread 99 drawn from the spool 82 is passed through the thread passing portion 107. A frictional resistance is applied to the thread 99 due to the contact of the guide pin 105 and the leaf spring 106.

Both ends of the guide pin 105 are fixed in respective bosses 87*c* formed at the right part (FIGS. 18 and 19) of the openable cover 87. The leaf spring 106 is inserted into the openable cover 87 so as to urge the guide pin 105 in a leftwardly and downwardly inclined posture. A slender portion 105*a*, having a smaller diameter is formed at the middle portion of the guide pin 105. The thread passing portion 107 is formed by the slender portion 105*a* and the leaf spring 106. Thereby, the thread 99 passing through the thread passing portion 107 has an appropriate frictional resistance applied thereto and the thread 99 can be surely guided into the hollow needle 81.

As shown in FIGS. 18 to 20 and 29, the locking mechanism 93 integrally locks the openable cover 87 to the housing case 86 in a state where the sewing cartridge 5 is not attached to the sewing apparatus body 2. The locking mechanism 93 has the locking member 110 disposed on the right of the housing case 86. The locking member 110 is formed with pivot portions 110*a*, 110*b*, an engaging portion 110*c*, and an engaged portion 110*d* as an integrated structure. The pivot portions 110*a*, 110*b* are pivotally supported by a vertically extending shaft. The locking member 110 can be switched between the locked position (see FIG. 18) and the unlocked position (see FIG. 19).

The locking member 110 is regulated in its vertical movement. The locking member 110 is urged to the locked position by a torsion spring 111. In FIG. 18, the engaging portion 110*c* protrudes rightward from the upper portion of the locking member 110. The engaged portion 110*d* protrudes rightward from the lower end portion of the locking member 110. The engaging portion 110*c* and the engaged portion 110*d* protrude toward the right from apertures 86*g*, 86*h*, respectively, which are formed in the upper portion of the front wall and a back wall of the engagement recess 86*a*.

When the sewing cartridge 5 is not attached to the swing arm 40, the openable cover 87 is in the closed position. In this state, the engaging portion 110*c* of the locking member 110 in the locked position engages the engaged portion 87*d* protruding leftward (inward) in FIG. 18 from the front wall of the openable cover 87 from the above. Accordingly, the openable cover 87 cannot be moved upward with respect to the housing case 86 and is integrally locked to the housing case 86 in the closed position.

When the sewing cartridge 5 is attached to the swing arm 40, as described above, the engaging pin 42 rightwardly presses (FIG. 22, for example) and moves the engaged portion 110*d* of the locking member 110 as the engagement recess 86*a* of the housing case 86 engages the engaging pin 42 of the swing arm 40. Therefore, the locking member 110 is switched to the unlocked position from the locked position. In this state, the engaging portion 110*c* of the locking member 110 is in the unlocked position and is disengaged from the engaged portion 87*d*. The lock is released, so that the openable cover 87 can be moved upward with respect to the housing case 86.

Usually, the sewing cartridge 5 is detached from the swing arm 40 in a state where the openable cover 87 is in the closed position. Therefore, the openable cover 87 is locked to the housing case 86 in the locked position immediately after the sewing cartridge 5 is detached. If the sewing cartridge 5 is detached from the swing arm 40 in a state where the openable cover 87 is in a position other than the closed position, the locking member 110 is switched to the locked position with the openable cover 87 unlocked. However, the openable cover 87 is rotated to the closed position by the urging force from the torsion spring 88 because a tapered portion inclined leftwardly is formed at the left end portion of the engaging portion 110*c* of the locking member 110. At that time, the engaged portion 87*d* temporarily presses and moves the locking member 110 toward the unlocked position via the tapered portion, so that the openable cover 87 can be switched to the closed position. For all of the above discussion, any direction description related to FIGS. 18–20 is the reverse of the actual directions when the sewing cartridge 5 is mounted in the sewing apparatus, such as shown in FIGS. 1, 2 and 21–23, for example.

Next, the sewing operation performed in the sewing apparatus 1 and stitches to be formed on the work cloth 70 by the sewing operation will be described with reference to FIGS. 30 to 37.

In a state where the embroidery frame 4 having the work cloth 70 and the sewing cartridge 5 are attached to the sewing apparatus body 2, the sewing cartridge 5 is vertically moved by the cartridge driving mechanism 12. At that time, the hollow needle 81, the needle cover 83 (when the needle cover 83 is kept away from the work cloth 70), the spool 82, and the excessive rotation preventive mechanism 91 move up and down with the housing case 86. However, the openable cover 87 is fixed to the sewing apparatus body 2, so that the openable cover 87 hardly moves up and down along with the backflow preventive mechanism 92 mounted therein.

Figure 31:
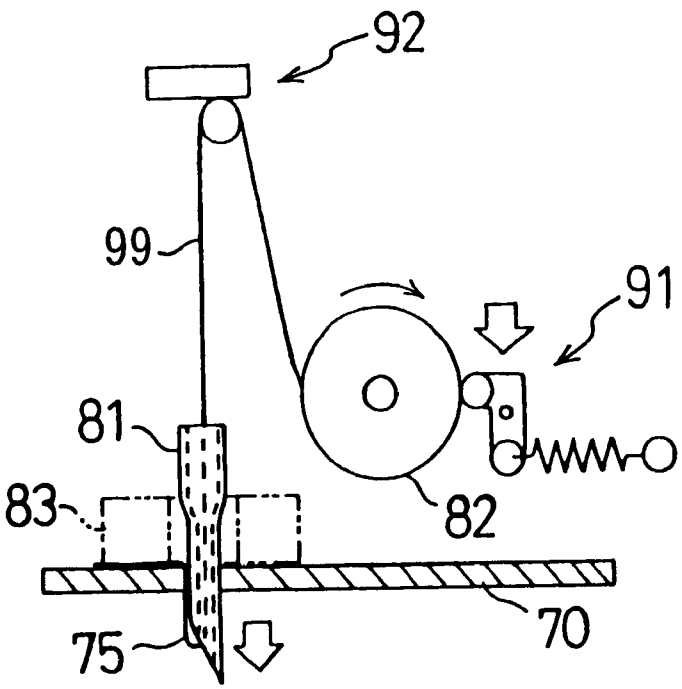
FIG. 31 is an explanatory diagram showing the sewing operation (when a first stitching is performed)
Figure 30:
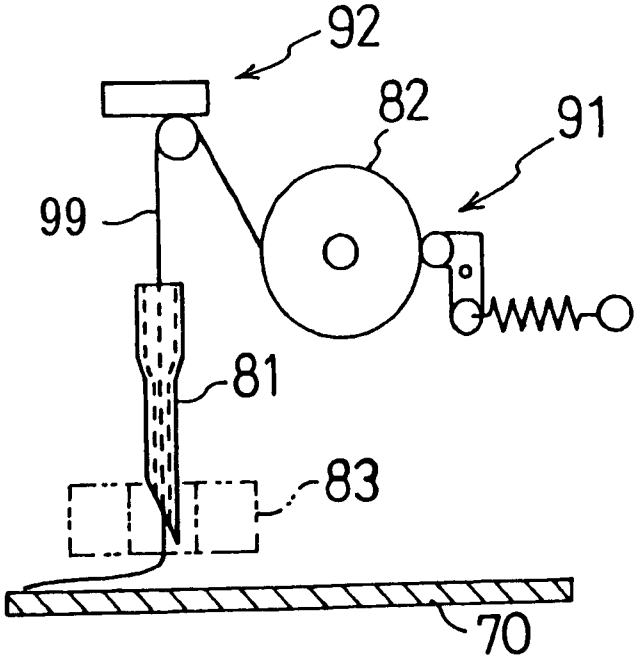
FIG. 30 is an explanatory diagram showing sewing operation (before the sewing operation is started)

When the sewing cartridge 5 is attached to the swing arm 40 and the first sewing operation is performed, as shown in FIG. 30, a certain length of a thread 99 is drawn from the lower end of the hollow needle 81. When the housing case 86 descends from this state, as shown in FIG. 31, first, the needle cover 83 as a presser foot holds the work cloth 70 with the thread 99 on the work cloth 70. As the needle cover 83 holds the work cloth 70, the needle cover 83 comes to a substantial standstill. Then, the hollow needle 81 descends with respect to the needle cover 83 and penetrates the work cloth 70. At that time, the hollow needle 81 is substantially perpendicular to the work cloth 70 at the instant when the hollow needle 81 penetrates the work cloth 70. The extreme tip of the hollow needle 81 is positioned at the end portion of the sewing cartridge 5 on the center-of-swing side of the swing arm 40, so that the work cloth 70 is prevented from being displaced.

When the hollow needle 81 penetrates the elastic film member 73 and the thread 99 extending from the hollow needle 81 and penetrating the work cloth 70 is held by a thread holding force due to elasticity of the elastic film member 73. In this state, when the hollow needle 81 (the spool 82 and the excessive rotation preventive mechanism 91) further descends, the thread 99 is drawn from the spool 82 against the draw resistance for the thread 99 provided by the excessive rotation preventive mechanism 91 and the backflow preventive mechanism 92 and a free loop 75 is formed on a reverse side of the work cloth 70. At this stage, a half of the thread 99 forming the free loop 75 exists inside of the hollow needle 81.

The resistance to drawing the thread 99 produced by the excessive rotation preventive mechanism 91 and the backflow preventive mechanism 92 is smaller than the thread holding force. Therefore, while the hollow needle 81 sticks in the work cloth 70 and descends to a lower limit position, the thread 99 extending from the hollow needle 81 is hardly pulled toward the reverse side of the work cloth 70 and more thread 99 is drawn from the spool 82. Thus, the free loop 75 is formed on the reverse side of the work cloth 70. Further, the thread 99 will not be pulled toward the reverse side of the work cloth 70 before the hollow needle penetrates the work cloth 70, if the thread 99 extending from the hollow needle 81 is held between the needle cover 83 and the work cloth 70.

Figure 32:
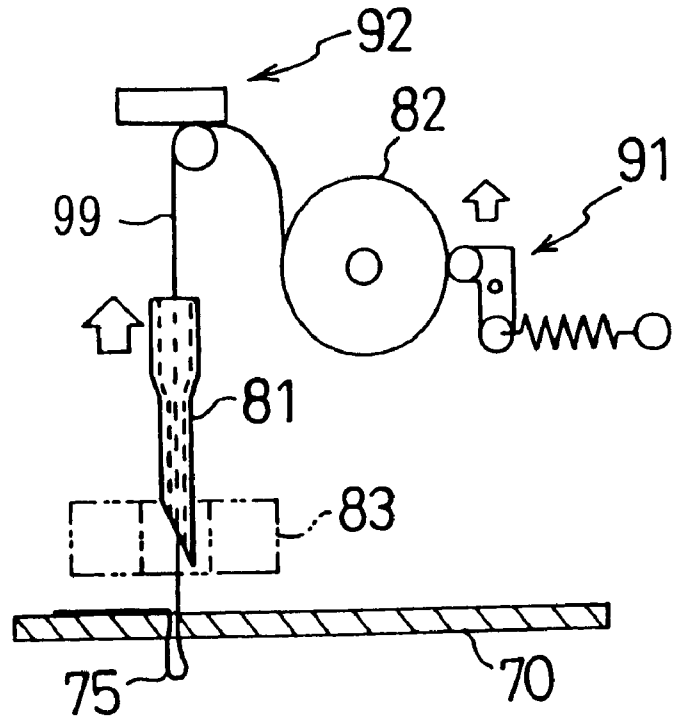
FIG. 32 is an explanatory diagram showing the sewing operation (when the hollow needle has risen immediately after the first stitching was performed)

Next, when the housing case 86 is moved upward, as shown in FIG. 32, the hollow needle 81 ascends from the lower limit position and the tip of the hollow needle 81 is pulled from the work cloth 70. Then, the work cloth 70, held by the needle cover 83, becomes free from the pressure and the needle cover 83 ascends to an upper limit position together with the hollow needle 81. At that time, only the hollow needle 81 ascends while the thread 99 is fixed or set between the backflow preventive mechanism 92 stopped in a certain position and the work cloth 70. The free loop 75 formed on the reverse side of the work cloth 70 is held and the entire free loop 75 is exposed. When the hollow needle 81 moves to the upper limit position, the spool 82 and the excessive rotation preventive mechanism 91 also move to the upper limit position. At that time, the thread 99 is not drawn from the backflow preventive mechanism 92 to the hollow needle 81, and the backflow preventive mechanism 92 and the excessive rotation preventive mechanism 91 apply resistance to drawing the thread to the thread 99. Accordingly, the thread 99 between the spool 82 and the backflow mechanism 92 becomes loosened.

Figure 33:
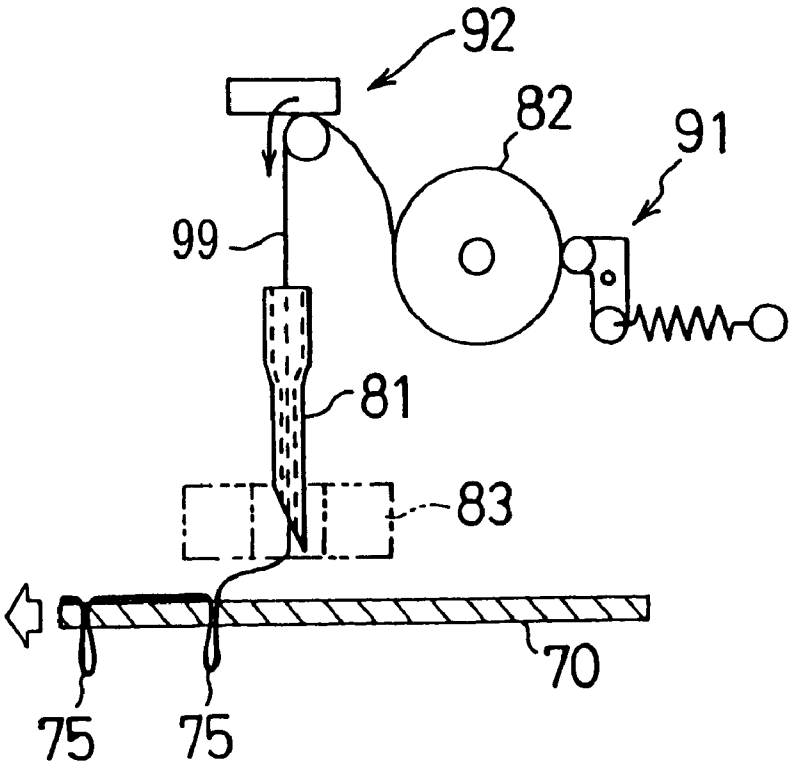
FIG. 33 is an explanatory diagram showing the sewing operation (while advancing a work cloth)

Then, as shown in FIG. 33, as the work cloth 70 is moved in a horizontal direction, the thread 99 is pulled by the thread holding force and the loosened thread 99 between the spool 82 and the backflow preventive mechanism 92 is pulled via the backflow preventive mechanism 92 because the thread 99 extending from the hollow needle 81 is held by the work cloth 70. At that time, the thread holding force by the work cloth 70 is far greater than the resistance to draw of the thread by the backflow preventive mechanism 92, so that there is no possibility of pulling out the thread 99 forming the free loop 75 toward the hollow needle 81 side.

Figure 34:
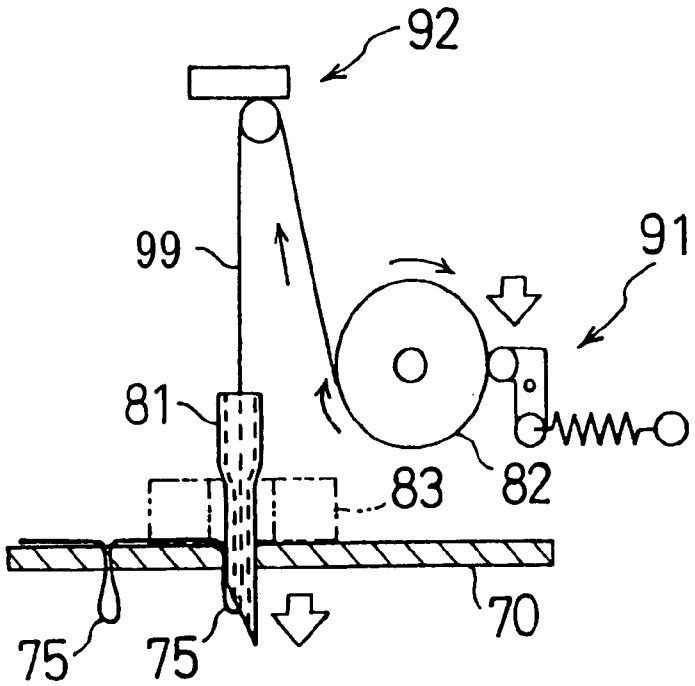
FIG. 34 is an explanatory diagram showing the sewing operation (when a second or following stitching is performed)

After the work cloth 70 is moved in the horizontal direction, the housing case 86 descends. As shown in FIG. 34, the needle cover 83 holds the work cloth 70 and the hollow needle 81 penetrates the work cloth 70. While the hollow needle 81 descends from the upper limit position to the lower limit position, the remaining loosened thread 99 between the spool 82 and the backflow preventive mechanism 91 is pulled and then the thread 99 is drawn from the spool 82. Applied to the drawn thread 99 is the resistance to drawing the thread by the excessive rotation preventive mechanism 91 and the backflow preventive mechanism 92. As described above, the resistance to drawing the thread is smaller than the thread holding force of the work cloth 70. Further, thread 99 can be pressed against the work cloth 70 by the needle cover 83. Accordingly, a new free loop 75 is formed without pulling the previous free loop 75 from the work cloth 70.

Figure 35:
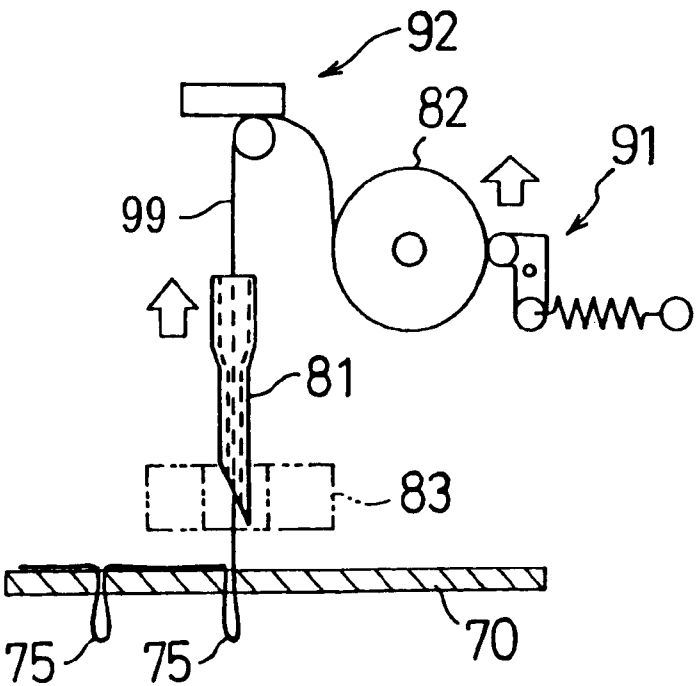
FIG. 35 is an explanatory diagram showing the sewing operation (when the hollow needle has risen immediately after the second or following stitching is made)
Figure 36:
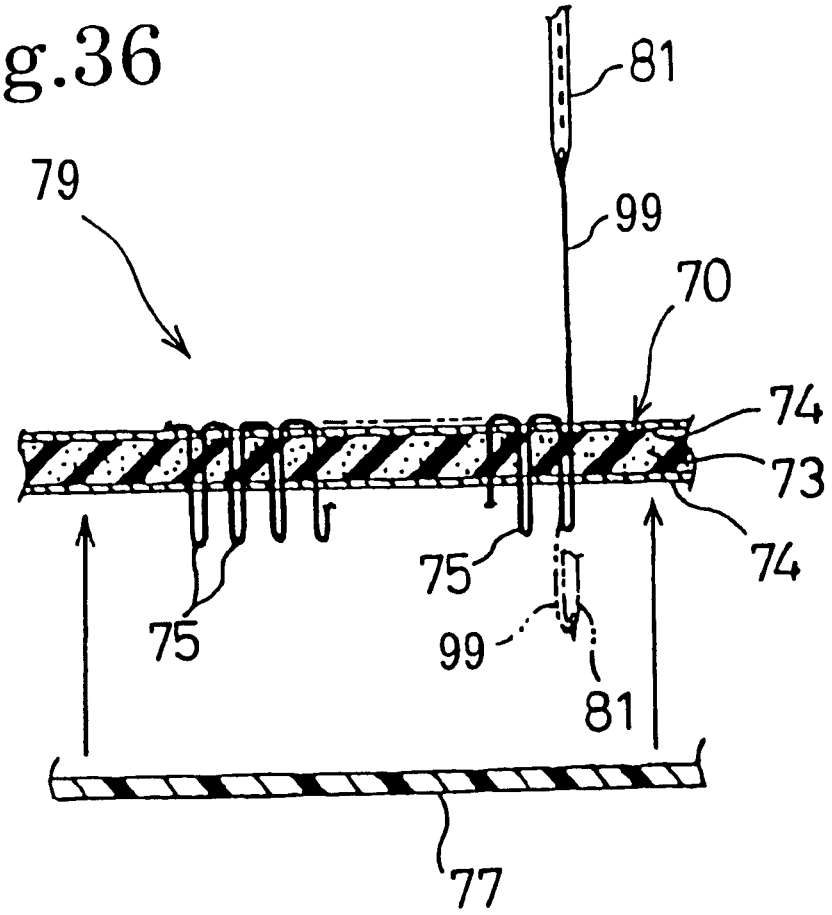
FIG. 36 is a sectional view of a work cloth, an embroidery pattern formed on the work cloth, and a double-sided adhesive tape.
Figure 37:
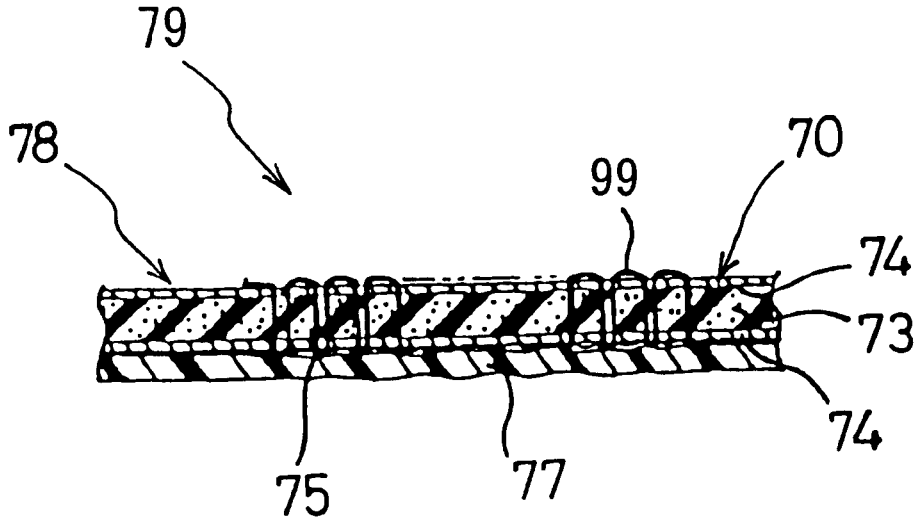
FIG. 37 is a sectional view of a patterned cloth.

Next, as shown in FIG. 35, the hollow needle 81 and the needle cover 83 ascend. Then, the operations shown in FIGS. 33 to 35 are repeatedly performed. As described above, the thread 99 is left on the work cloth 70 every sewing operation by the thread holding force produced by the elasticity of the work cloth 70 and a plurality of free loops 75 are formed on the reverse side of the work cloth 70 by the thread 99, as shown in FIG. 36. Thus, stitches forming an embroidery pattern 79 are formed on the surface of the work cloth 70. When a double-sided adhesive tape 77 is adhered to fix the free loops 75 on the reverse side of the work cloth 70, a patterned cloth 78, as shown in FIG. 37, is formed.

Accordingly, the free loops 75 do not come off or out, so that the thread 99 does not need to be fixed by other thread or the thread of the previous stitch and following stitch. The embroidery pattern 79 formed on the work cloth 70 is stable without unraveling. The patterned cloth 78 can be attached to various things via the double-sided adhesive tape 77 as an emblem. Instead of the double-sided adhesive tape 77, adhesive agent may be applied to the reverse side of the work cloth 70 in layers. A tape may be formed of the adhesive agent and the tape may be used to fix the free loops 75 on the reverse side of the work cloth 70.

There are a plurality of free loops 75 on the reverse side of the work cloth 70. Accordingly, unevenness may develop in the double-sided adhesive tape 77 when the double-sided adhesive tape 77 is adhered to the reverse side of the work cloth 77. When the work cloth 70 is adhered to clothes via the double-sided adhesive tape 77 as an emblem, the emblem is liable to come off because the cloth is soft. However, adhesion of the work cloth 70 can be improved because of the unevenness of the double-sided adhesive tape 77. The unevenness is formed every free loop or every several free loops depending on the materials of the thread and the double-sided adhesive tape used.

Figure 38A:
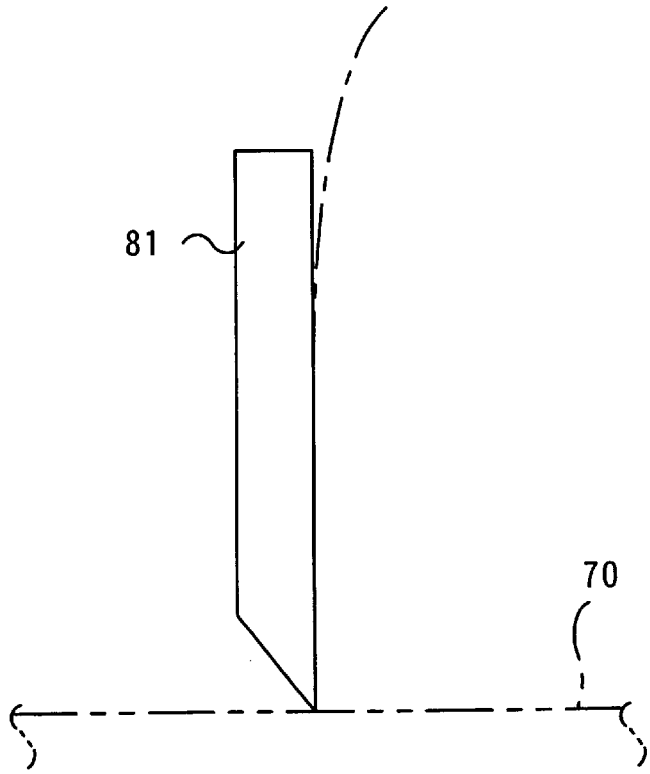
FIG. 38A is a front view of a hollow needle (an instant at which the hollow needle sticks in a work cloth)
Figure 38B:
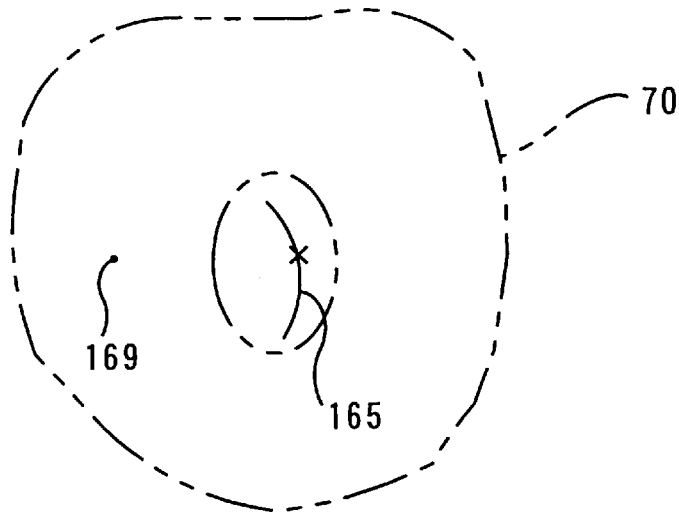
FIG. 38B is a plan view of a cut surface formed in the work cloth.

When the hollow needle 81 penetrates the work cloth 70 as shown in FIG. 38A, an arc-shaped cut surface 165 is formed around a center 169 as shown in FIG. 38B. The center 169 of the arc-shaped cut surface 165 is positioned at a side opposed to a center of swing of the swing arm 40 with respect to the extreme tip of the hollow needle 81. First, the extreme tip of the hollow needle 81 penetrates substantially the middle of the cut surface 165. Then, the hollow needle 81 moves downward along an arc and passes through the work cloth 70, so that the arc-shaped cut surface 165 is formed. A thread is held by the arc-shaped cut surface 165 in the work cloth 70.

Figure 39:
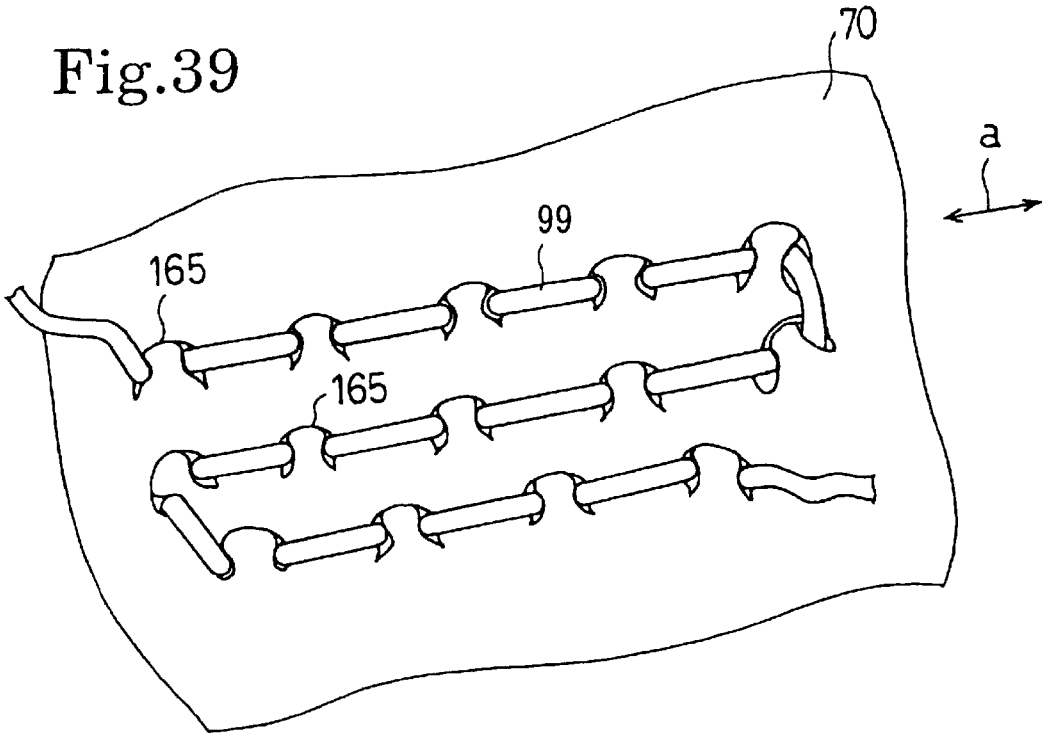
FIG. 39 is a diagram showing a pattern of stitches formed on the work cloth.
Figure 40:
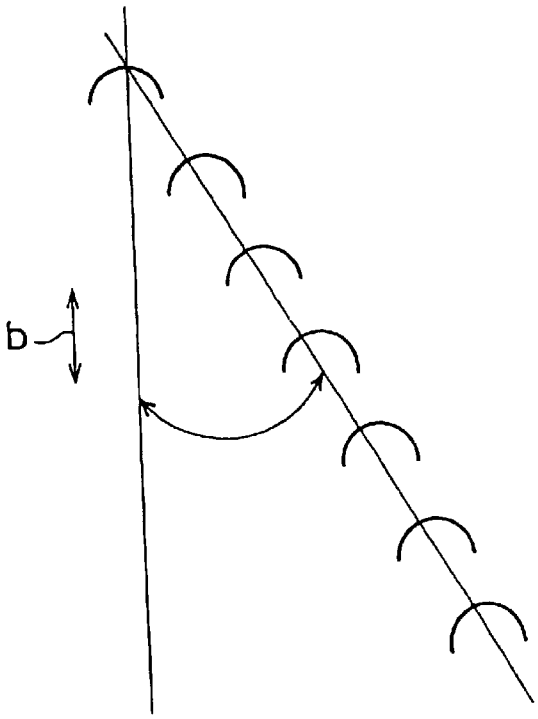
FIG. 40 is a diagram showing a pattern of cut surfaces to be formed in the work cloth.

The extreme tip of the hollow needle 81 and the center of swing of the swing arm 40 are positioned on the left and right, respectively (in an extending direction of the swing arm 40). When an area is filled with a certain stitch, sewing is performed by making turns back and forth. As shown in FIG. 39, the sewing is preferably performed in either of two directions of a direction (arrow a), i.e., in a direction of from front/rear to rear/front of the sewing apparatus body 2, which is perpendicular to the extending direction of the swing arm 40. That is, in a relative movement continuing in a certain direction, the hollow needle 81 and the embroidery frame 4 are moved in parallel with an arrangement direction of arcs. Thus, a tangent to the middle of the arc in the cut surface 165 is not perpendicular to the arrangement direction of the cut surfaces 165 which are to be formed in order in the back and forth direction. Therefore, a plurality of cut surfaces 165 are successively formed one after another. If the sewing is performed in the extending direction of the swing arm 40, the thread 99 might be cut by the extreme tip of the hollow needle 81.

In order to displace the thread 99 from the extreme tip of the hollow needle 81, as shown in FIG. 31, stitch positions need to be shifted approximately 5 degrees to either of front and back directions of the sewing apparatus body 2 with respect to the extending direction, arrow b, of the swing arm 40. That is, stitch positions are displaced from the extreme tip of the hollow needle 81. As described above, the embroidery frame driving mechanism 11 is controlled to prevent thread cutting. In order to accomplish the above-described operation, a control program for moving the embroidery frame 4 (the work cloth 70) relative to the hollow needle 81 by controlling the sewing apparatus 1 may be provided and the control program stored in the ROM 13*b* of the controller 13, or any compatible storage or carrier medium. A part of the control program may be stored in a recording medium, such as a DVD, so that the control program can be read by such as the game machine 6, the controller 13 of the sewing apparatus 1, and a personal computer.

According to the sewing cartridge 5 described above, the needle cover 83 can cover at least the tip of the hollow needle 81 in both states where the sewing cartridge 5 is attached to and detached from the sewing apparatus body 2. Further, the needle cover 83 placed at a cover position can be inhibited from moving therefrom by the movement prohibiting mechanism 85, so that a tip of a needle can be prevented from being exposed to the outside due to careless handling. Accordingly, particularly when the sewing cartridge 5 is attached to or detached from the sewing apparatus body 2, damage to clothes due to the hollow needle 81 can be prevented and the sewing cartridge 5 can be easily and safely handled.

The hollow needle 81 is fixedly provided so that the portion of the tip side of the hollow needle 81 protrudes from the cassette body 80. Sewing operations can be performed by which the hollow needle 81 vertically reciprocates with the sewing cartridge 5 and the hollow needle 81 passes through the work cloth 70. Further, the needle cover 83 also serves as a presser foot. Therefore, a small sewing cartridge 5 having a simple structure can be provided. Further, the mechanism that reciprocates the hollow needle 81 (the sewing cartridge 5) can be simplified, thereby contributing to miniaturization of the sewing apparatus 1.

The structure of the sewing cartridge 5 may be partially changed as described below. The needle cover 83 may be structured such that the position of the needle cover 83 is manually switched between a cover position and a retracted position. In this case, the coil compression spring 84 that urges the needle cover 83 to the cover position can be removed. Thus, a standard sewing needle may be used instead of the hollow needle 81.

The excessive rotation preventive mechanism 91 may be structured such that frictional resistance is applied to the flange 82*b* by a spool holder or other member or portion, not only by which the contact 101 urged by the torsion spring 102 is pressed against the flange 82 of the spool 82. In the backflow preventive mechanism 92, a recess may be formed in the leaf spring 106 to provide a thread passing portion, instead of forming the slender portion 105*a* in the guide pin 105.

Instead of forming the opening 86*c*, at least one of the housing case 86 and the openable cover 87 may be formed of a transparent or a translucent material so that the remaining amount of the thread 99 can be visually confirmed through the housing case 86 and/or the openable cover 87. The thread color indicating portion 87*b* may be provided to a portion other than the top surface of the openable cover 87 of the cassette body 80. As the thread color indicating portion 87*b*, the cassette body 80 may be partially or entirely colored with a same/similar color as the color of the thread 99 wound around the spool 82 contained in the cassette body 80.

Figure 41:
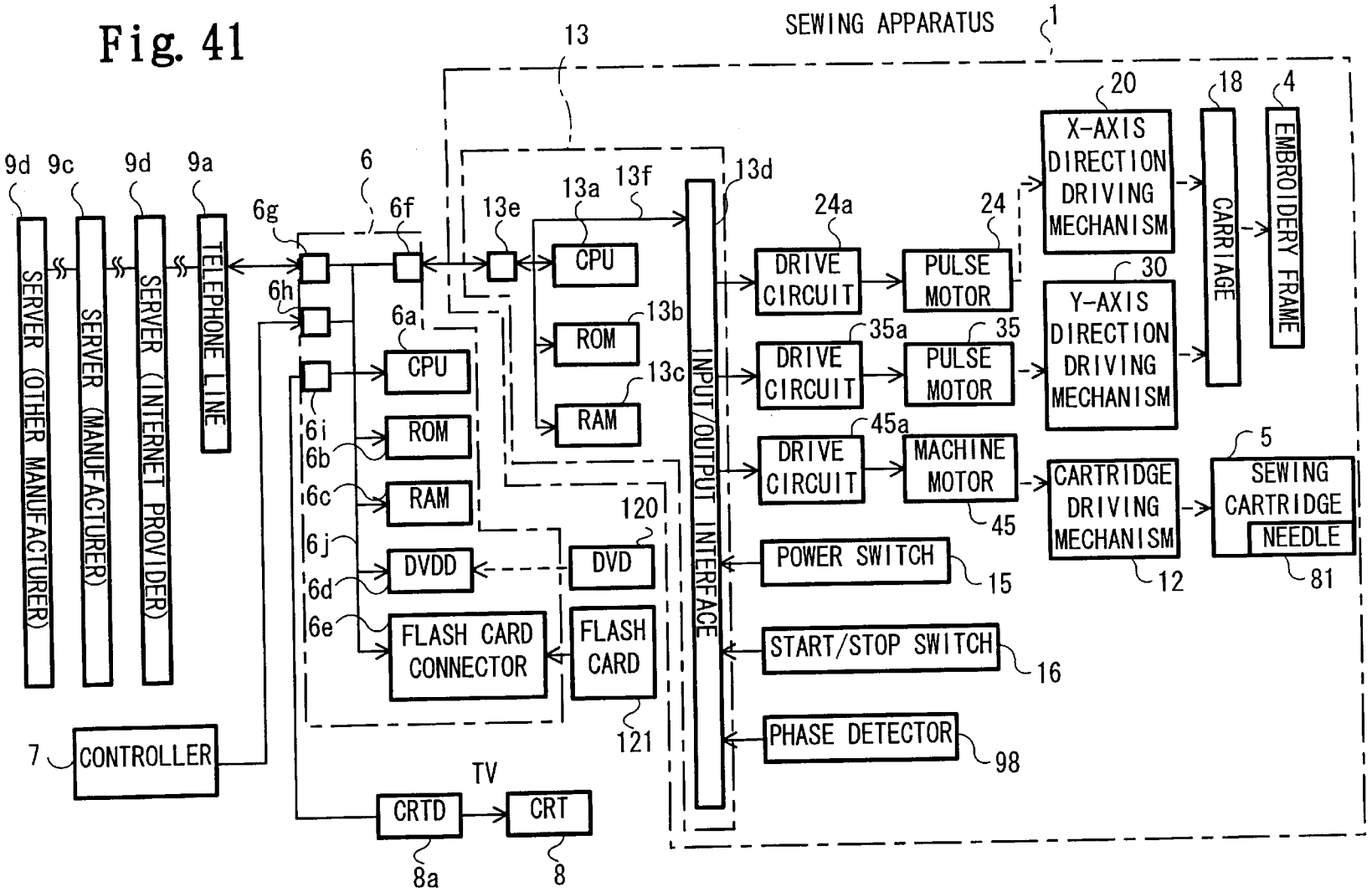
FIG. 41 is a block diagram showing a control system of the sewing apparatus and a game machine.

As shown in FIG. 41, the controller 13 of the sewing apparatus 1 has a computer including a CPU 13*a*, a ROM 13*b*, and a RAM 13*c*, an input/output interface 13*d*, and an input/output terminal 13*e*. The CPU 13*a*, the ROM 13*b*, the RAM 13*c*, the input/output interface 13*d*, and the input/output terminal 13*e* are connected to each other via a bus 13*f*. The input/output interface 13*d* is connected with a drive circuit 24*a* for the pulse motor 24 of the X-axis direction driving mechanism 20, a drive circuit 35*a* for the pulse motor 35 of the Y-axis direction driving mechanism 30, a drive circuit 45*a* for the machine motor 45 of the cartridge driving mechanism 12, the power switch 15, the start/stop switch 16, and a phase detector 98.

The phase detector 98 includes a plurality of photo interrupters and encoder disks which are fixedly attached to the pivot shaft integrally rotating with the large-diameter gear 54 and correspond to the photo interrupters. The phase detector 98 detects a rotational phase of the pivot shaft, so that an upper limit position, a lower limit position, and an unthreading position of the swing arm 40 can be detected.

The game machine 6 has a computer including a CPU 6*a*, a ROM 6*b* and a RAM 6*c*, a DVD drive (DVDD) 6*d* capable of reading and writing a DVD 120, a flash card connector 6*e*, input/output terminals 6*f*, 6*g*, an input terminal 6*h*, and an output terminal 6*i*, which are connected each other via bus 6*j*. The input/output terminal 6*f* is connected to the input/output terminal 13*e* of the sewing apparatus 1. The controller 7 is connected to the input terminal 6*h*. The output terminal 6*i* is connected with a drive circuit (CRTD) 8*a* for the CRT 8. The drive circuit 8*a* and display 8 could also be an LCD drive and display. The input/output terminal 6*g* can be connected with a telephone line 9*a*.

The DVD 120, as an external storage medium, stores various sewing data and programs so that the sewing data and the programs are readable by the computer. The DVD 120 can be attached to or detached from the DVD drive 6*d*. When a DVD 120 storing game software for a video game is installed in the DVD drive 6*d*, a game screen is displayed on the CRT 8 according to the game software and a user can enjoy playing the game using the controller 7. Further, by connecting the input/output terminal 9*g* to the telephone line 9*a*, the sewing apparatus 1 can capture various data regarding sewing via the telephone line 9*a*, through a server of an Internet provider, from a server A10 of a manufacturer of data and programs or a server of another manufacturer. That is, various data regarding sewing provided from the manufacturers can be captured via the Internet 406.

A homepage of a manufacturer is not necessary to be established on a server in a country where a game machine or a terminal for sewing exists. The homepage may be established on a server in another country if the homepage can be accessed through the Internet using a connection, such as a telephone line. For example, a front homepage which is a "HOME" of a company is established on a server B10 in the U.S. A homepage of the same company or a related company or a private homepage is established on a server C10 in a country other than the U.S. (for example, European countries) so that control programs regarding sewing, control signals, and data can be sent from their homepage. The control programs, the control signals, and the data may be distributed worldwide via the Internet by which the home page in the U.S. is linked to the homepage in the other country.

In the sewing apparatus 1, an embroidery pattern can be formed on the work cloth 70 by controlling the embroidery frame driving mechanism 11 (the X-axis direction driving mechanism 20 and the Y-axis direction driving mechanism 30) and the cartridge driving mechanism 12 by the controller 13 based on the sewing data. A control program for sewing is stored in the ROM 13*b*. In the embodiment, various characters (e.g., persons, animals, robots) to be displayed on the CRT 8 by the game software can be selected and edited using the game machine 6. Pattern data for sewing a selected/edited character can be created in the game machine 6 and can be supplied to the sewing apparatus 1.

Figure 42:
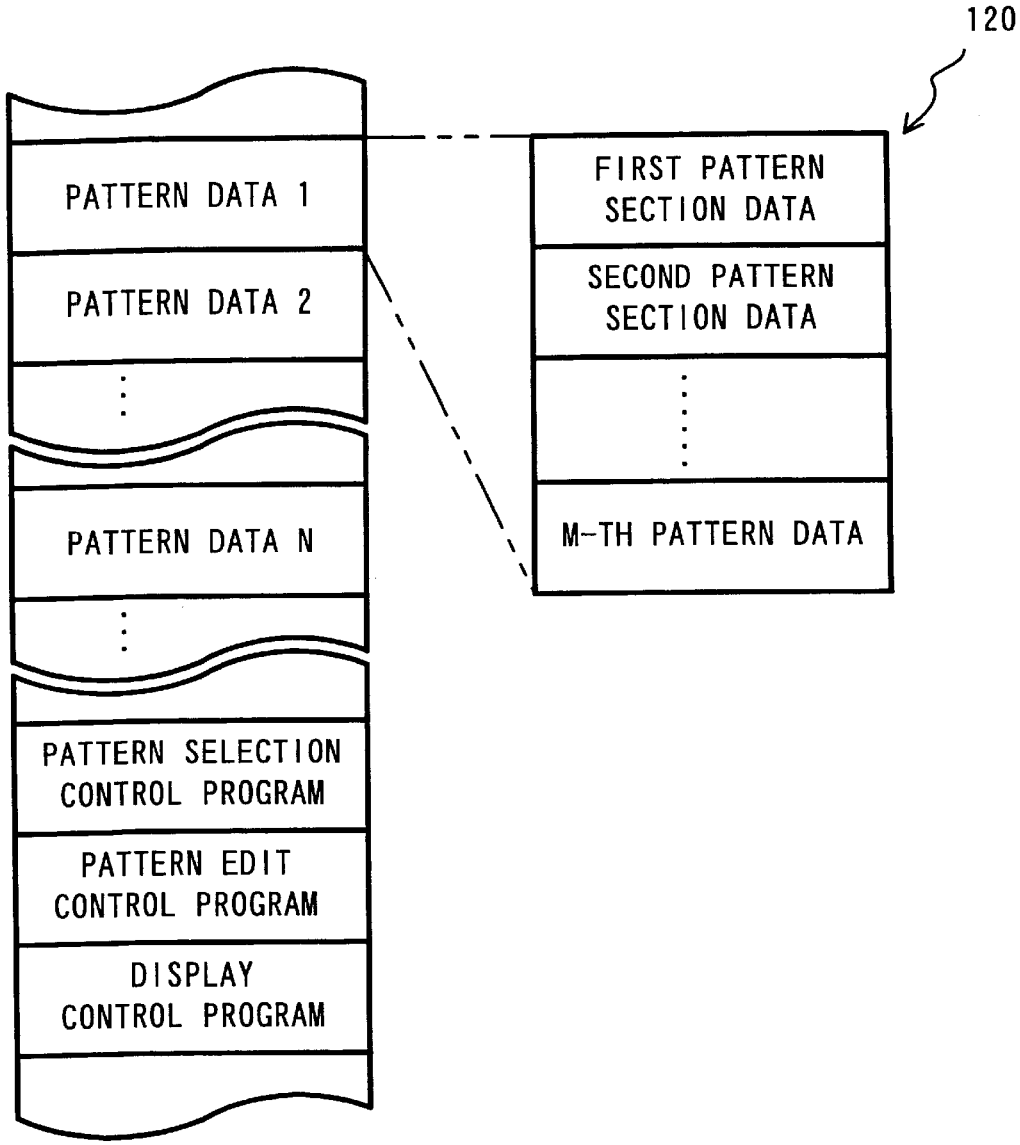
FIG. 42 is a diagram showing data stored in a DVD.

Therefore, the DVD 120 for selecting/editing sewing data is provided for the game machine 6. That is, as shown in FIG. 42, the DVD 120 stores various kinds of embroidery patterns selected from game software as described above, pattern data of various kinds for prestored embroidery patterns, a pattern selection control program for selecting a desired embroidery pattern from the various kinds of embroidery patterns, a pattern edit control program for editing (e.g., enlargement, reduction, unification, reversal) a selected embroidery pattern, and a display control program for displaying an embroidery pattern for selecting and setting. A flash card, connectable to the flash card connector 6*e*, can store pattern data of a selected/edited embroidery pattern.

The DVD 120 also stores a pattern data creation program for creating pattern data by selecting/editing a character of game software based on data of the game software. When pattern data is created using the pattern data creation control program, first, the control program is downloaded into the RAM 6*c*, and then various kinds of characters are displayed by running the game software DVD. A character to be sewn is selected/edited, and pattern data is created. The created pattern data is stored in the DVD 120.

Next, a series of operations of the sewing apparatus 1 described above will be described with reference to the flowcharts of FIGS. 43 and 44. As shown in FIG. 1, it is assumed that the sewing apparatus 1 is connected with the game machine 6 via the connecting cable and the DVD 120 storing data of FIG. 42 is installed in the DVD drive 6*d* of the game machine 6. The game machine 6 is connected to the CRT 8 via the connecting cable.

First, an embroidery pattern is selected/edited using the controller 7 of the game machine 8 while observing a screen on the CRT 8. The embroidery pattern can be selected/edited without turning the power of the sewing apparatus 1 on.

Figure 43:
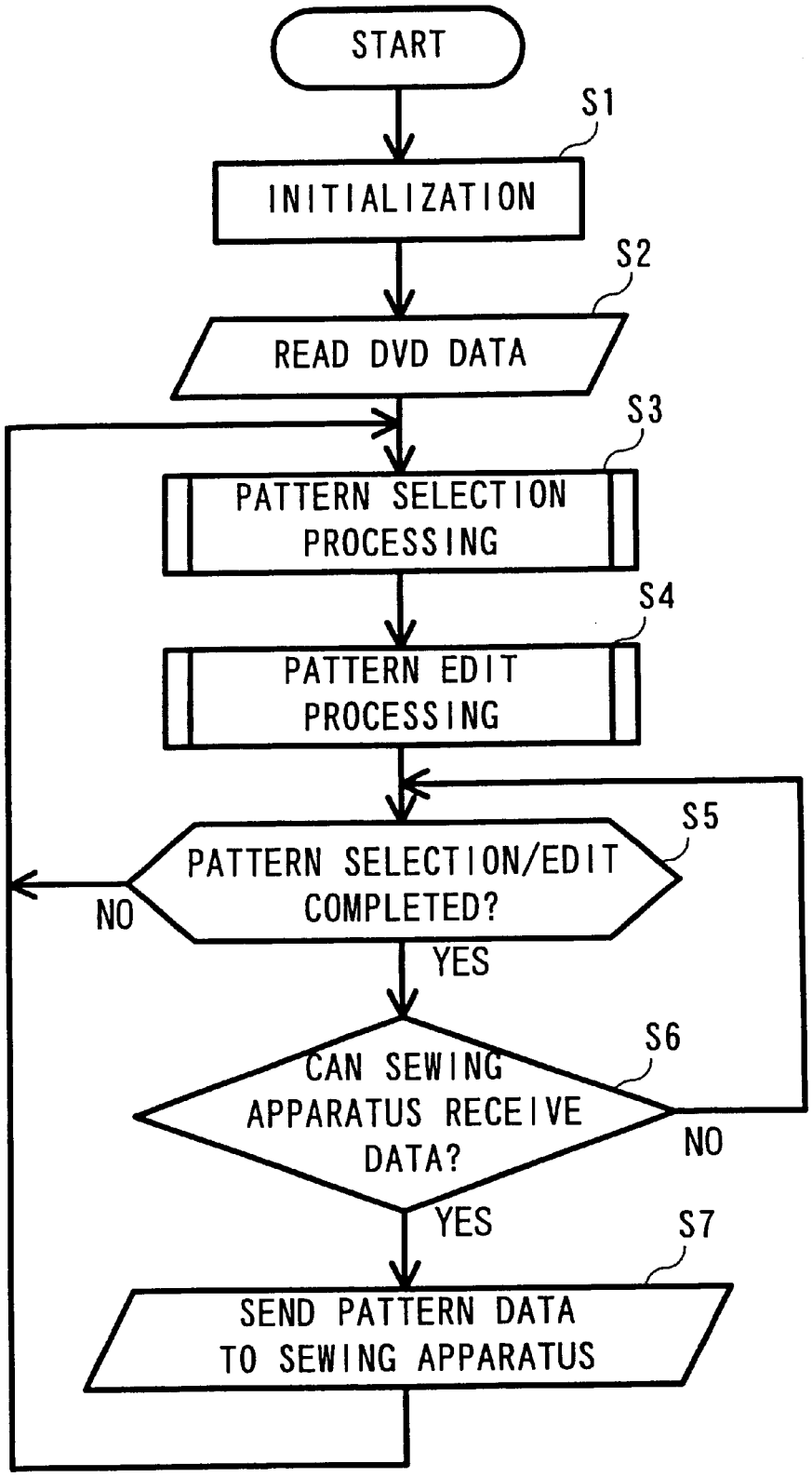
FIG. 43 is a flowchart of control to be executed in the game machine.

As shown in FIG. 43, in a controller of the game machine 6, control is started when the power of the game machine 6 is turned on. After initialization (S1) (S stands for a step), data in the DVD 120 (such as the pattern selection control program, the pattern edit control program, and the display control program) are read (S2). Then, in pattern selection processing (S3), a desired embroidery pattern can be selected from various kinds of embroidery patterns stored in the DVD 120. In pattern edit processing (S4), a selected embroidery pattern can be edited (e.g., enlargement, reduction, unification, reversal).

Selection/edit of the embroidery data is completed by operating a predetermined button of the controller 7 (S5;Yes). Then, when the sewing apparatus 1 can accept data (S6;Yes), the pattern data of the selected/edited embroidery pattern is sent to the sewing apparatus 1 (S7). After that, flow is returned to S3. When the sewing apparatus 1 cannot receive data, such that the power of the sewing apparatus 1 is not turned on (S6;No), flow returns to S5.

Figure 44:
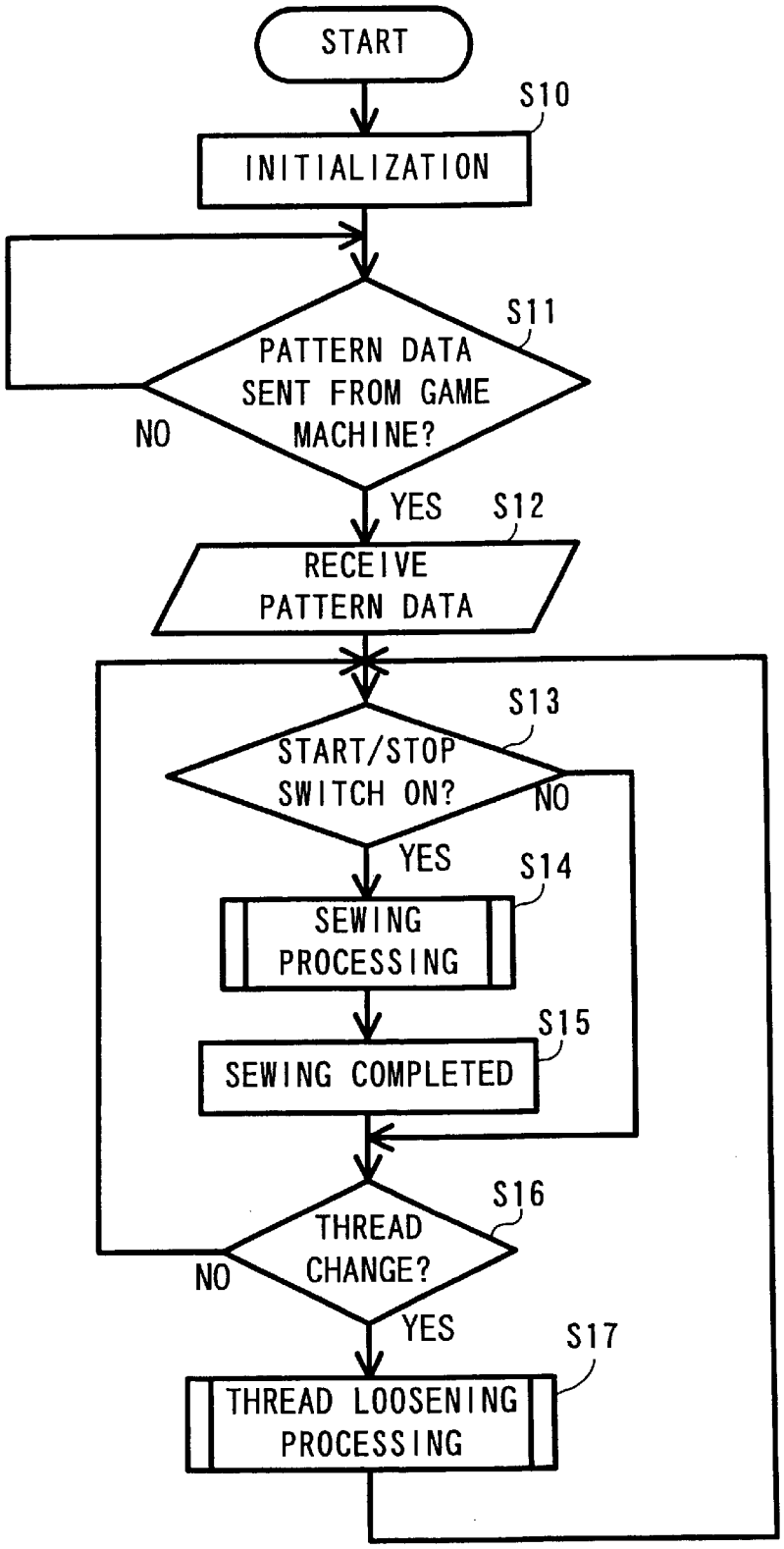
FIG. 44 is a flowchart of control to be executed in the sewing apparatus.

As shown in FIG. 44, in the controller 13 of the sewing apparatus 1, control is started when the power switch 15 is turned on. After initialization (S10), the sewing apparatus 1 can receive data. When the selected/edited pattern data is sent from the game machine 6 (S11;Yes), the sewing apparatus 1 receives the pattern data (S12). Next, when the start/stop switch 16 is turned on (S13;Yes), sewing processing is performed based on the received pattern data (S14).

Preparation required prior to starting the sewing operation will now be described. In a state where the safety cover 3 of the sewing apparatus 1 is in the storage position, shown in FIG. 2, the embroidery frame 4 having the work cloth 70 is inserted into the inside of the safety cover 3 from the embroidery frame insertion slot 3*f* while the embroidery frame 4 is guided by the guide member 69 of the safety cover 3. The rear end support portion 4*a* of the embroidery frame 4 is engaged with the engagement portion 18*a* of the carriage 18. As described above, the carriage 18 in which the embroidery frame 4 can be surely attached is positioned substantially under the swing arm 40. At the initialization (S10), the carriage 18 is moved to this position and placed on standby. The safety cover 3 is in the storage position and the embroidery frame 4 slightly protrudes from the safety cover 3.

After the embroidery frame 4 is attached to the carriage 18, the guide member 69 is grasped and the safety cover 3 is slid forward so as to be placed in the sewing position shown in FIG. 3. In this state, the sewing cartridge 5, accommodating a thread of a desired color, is inserted into the inside of the safety cover 3 from the cartridge insertion slot 68 and is attached to the swing arm 40. After this preparation is completed, sewing processing can be performed.

When the safety cover 3 is in a position other than the sewing position, the start/stop switch 16 cannot be operated because the start/stop switch 16 is covered with the safety cover 3. When the safety cover 3 is switched to the sewing position, the start/stop switch 16 is opposed to the switch operating hole 3*e*, so that the start/stop switch 16 can be operated. When the start/stop switch 16 is turned on (S13;Yes), the sewing processing (S14) is performed.

As shown in FIG. 42, pattern data of each embroidery pattern stored in the DVD 120 includes pattern section data of several pattern sections. The sewing cartridge is changed every pattern section to change a thread color. That is, as shown in FIG. 44, when the start/stop switch 16 is turned on (S13;Yes), the sewing processing (S14) is performed. Based on the pattern data of one pattern section, the embroidery frame driving mechanism 11 and the cartridge driving mechanism 12 are controlled and the pattern section is sewn on the work cloth 70.

When one pattern section is formed, the sewing operation of the pattern section is finished (S15). When a pattern section to be sewn next has a different color, the sewing cartridge 5 is changed to the sewing cartridge 5 that has a thread having a color for a pattern section to be sewn. In this case, for example, when a thread change is commanded by operating a predetermined button of the controller 7 (S16;Yes), thread loosening processing (S17) is performed in order to cut the thread and change the sewing cartridge 5.

When it is not necessary to change the sewing cartridge 5, the thread loosening processing at S17 does not need to be performed. That is, when the thread change is not commanded (S16;No), flow returns to S13. Accordingly, the start/stop switch 16 is turned on (S13;Yes) while the sewing operation is stopped (S15), the sewing operation (S14) is started again. Thus, the next pattern section is formed.

At the thread loosening processing (S17), the embroidery frame 4 is moved from a sewing end position to a moving limit position within the embroidery frame moving area 38 (see FIG. 6) after the sewing operation is completed. Then, the embroidery frame driving mechanism 11 is controlled so as to loosen the thread 99 between the hollow needle 81 and the work cloth 70, in order to draw the thread 99 from the spool 82 in the sewing cartridge 5. The thread loosening control program is stored in the ROM 13*b* in the controller 13 of the sewing apparatus 1. The thread loosening control program may be stored in other kinds of storage mediums, such as the DVD 120, and may be transferred to the sewing apparatus 1.

Figure 45A:
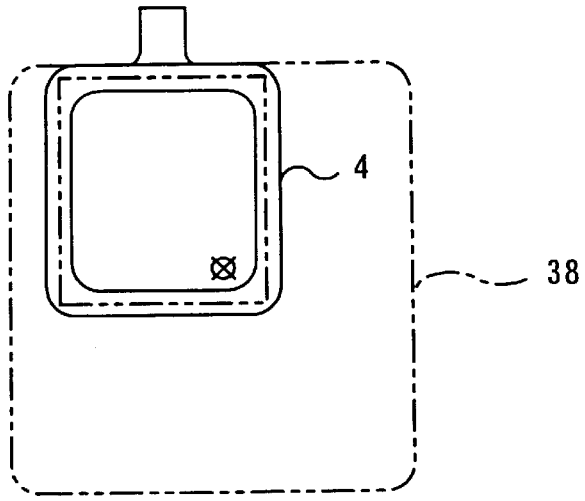
FIG. 45A is a plan view of a sewing end position of the embroidery frame with respect to a embroidery frame moving area.
Figure 45B:
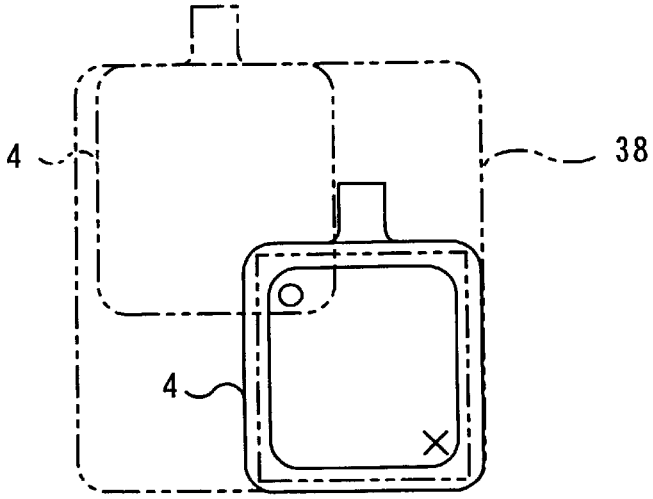
FIG. 45B is a plan view of a moving limit position of the embroidery frame with respect to the embroidery frame moving area.
Figure 45C:
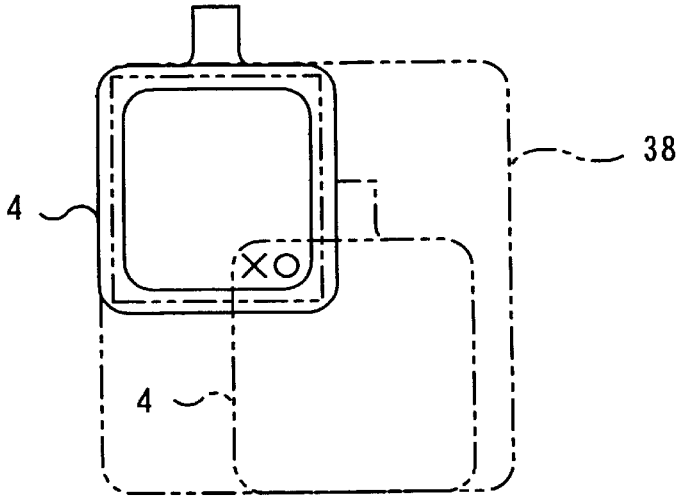
FIG. 45C is a plan view of a moving limit position of the embroidery frame with respect to the embroidery frame moving area.

FIG. 45A shows a sewing end position of the embroidery frame 4 immediately after sewing operation of one pattern section is completed. In FIGS. 45A to 45C, "O" indicates a stitch position of the hollow needle 81 positioned substantially in a center of the embroidery frame moving area 38. "X" indicates a last stitch position where the hollow needle 81 penetrates the work cloth 70 last in one pattern section. "X" moves with the embroidery frame 4.

FIG. 45B shows the embroidery frame 4 that is moved to a moving limit position within the embroidery frame moving area 38 so that the hollow needle 81 moves to a furthermost position from the last stitch position through the movement of the embroidery frame 4. FIG. 45C shows the embroidery frame 4 that is moved to a furthermost moving limit position with respect to a frame detaching position shown by a double dashed chain line within the embroidery frame moving area 38.

Figure 46:
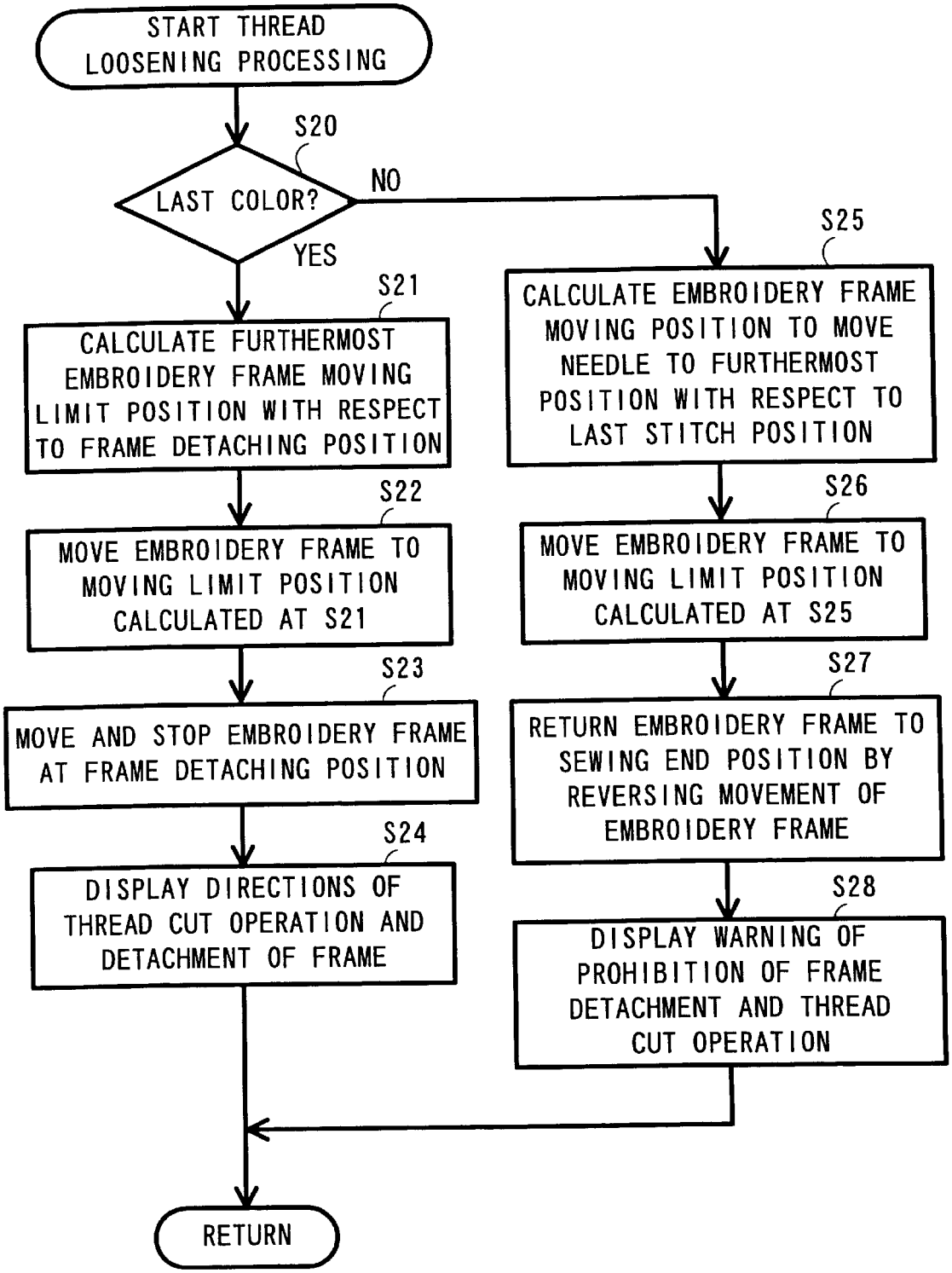
FIG. 46 is a flowchart of thread loosening control to be executed in the sewing apparatus.

As shown in FIG. 46, when the thread loosening processing of S17 is started, it is determined whether the thread being used is for a last pattern section (S20). When the thread being used is for the last pattern section (S20;Yes), that is, when all pattern sections of the embroidery pattern are formed, as shown in FIG. 45C, a moving limit position which is a furthermost position with respect to the frame detaching position (shown by a double dashed chain line) of the embroidery frame 4 is calculated (S21). Based on the calculated data, the embroidery frame driving mechanism 11 is controlled so that embroidery frame 4 is moved to the moving limit position (S22).

Accordingly, the thread 99 is drawn from the spool 82 of the sewing cartridge 5. Next, the embroidery frame 4 is moved and stopped at the frame detaching position (S23), and the thread 99 between the work cloth 70 and the hollow needle 81 is loosened. Then, directions of thread cut operation and detachment of the embroidery frame 4 are displayed on the CRT 8 via the game machine 6 (S24). When the embroidery frame 4 is moved to the frame detaching position, the carriage 18 is moved to the foremost position and is positioned under the swing arm 40.

When the thread being used is not for the last pattern section (S20;No), that is, when all the pattern sections of the embroidery pattern are not formed, a moving limit position of the embroidery frame 4 is calculated so that the hollow needle 81 is moved to a furthermost position with respect to a last stitch position (S25). For example, when a sewing end position of the embroidery frame 4 is a position shown in FIG. 45A, the embroidery frame 4 is moved to a position shown in FIG. 45B. Based on the calculated data, the embroidery frame driving mechanism 11 is controlled so that the embroidery frame 4 is moved to the moving limit position (S26).

Accordingly, the thread 99 is drawn enough from the spool 82 in the sewing cartridge 5. Next, the embroidery frame 4 is returned to the sewing end position by which the movement of the embroidery frame 4 is reversed (S27). The thread 99 between the work cloth 70 and the hollow needle 81 is loosened. Then, a warning of prohibition of detachment of the embroidery frame 4 and directions of thread cut operation are displayed on the CRT 8 via the game machine 6 (S28).

When S22, S23, S26 and S27 are performed, as described above, the thread 99 between the hollow needle 81 and the work cloth 70 is loosened. The thread 99 is cut according to the directions of the thread cut operation displayed on the CRT 8 at S24 and S28. At that time, the thread 99 can be easily manually cut without removing the safety cover 3 from the sewing apparatus body 2 while the embroidery frame moving area 38 of the embroidery frame 4 is covered with the safety cover 3. For example, scissors are inserted into the inside of the safety cover 3 from the embroidery frame insertion slot 3*f*. While the inside of the safety cover 3 is observed from the outside of the safety cover 3, made of a transparent or translucent material, the thread 99 can be easily cut using the scissors.

Next, when the sewing operation of the embroidery pattern has been completed, that is, when S21 to S24 have been performed, the embroidery frame 4 located in the frame detaching position can be easily detached from the sewing apparatus body 2 according to the directions of detachment of the frame displayed on the CRT 8. When the embroidery frame 4 is in the frame detaching position in which the embroidery frame 4 is moved to the foremost position within the embroidery frame moving area 38, the carriage 18 is positioned substantially under the swing arm 40. After the work cloth 70 on which the embroidery pattern is formed is removed from the embroidery frame 4, as shown in FIG. 37, the double-sided adhesive tape 77 is adhered to the reverse side of the work cloth 70 and thus, a patterned cloth 78 is formed. The patterned cloth 78 can be adhered to various kinds of things via the double-sided adhesive tape 77.

When the sewing of the embroidery pattern has not been completed, that is, when S25 to S28 have been performed, the sewing cartridge 5 is changed to another sewing cartridge 5 accommodating a thread 99 to be used for a next pattern section after thread cutting. After that, as the start/stop switch 16 is turned on at S13, processing at S14 and subsequent processing are performed again. After the sewing operation is completed, the safety cover 3 is moved to the storage position. Then, the embroidery frame 4 can be detached from the embroidery frame insertion slot 3*f*.

A second embodiment of the invention will be described below with reference to FIGS. 47 to 61. First, a sewing apparatus body 202 of a sewing apparatus 201 of the embodiment will be described.

The basic structure of the casing 10, carriage 18, and embroidery frame driving mechanism 11 are the same as the first embodiment. Accordingly, similar reference numerals have been used in the drawings to denote similar parts, and detailed explanations for those parts will be omitted. Hereinafter, the structures that are different from the first embodiment will be described.

As shown in FIGS. 52 to 55, a cartridge driving mechanism 212 has a swing arm 240 to which a sewing cartridge 205 is attached to or detached from, a machine motor 245, that is, an AC motor as drive source and moves the swing arm 240 up and down, a gear mechanism 250 that reduces rotation speed of the machine motor 245, and a cam mechanism 255 that converts a rotary motion reduced in its rotation speed by the gear mechanism 250 into up-and-down movements of the swing arm 240.

Figure 48:
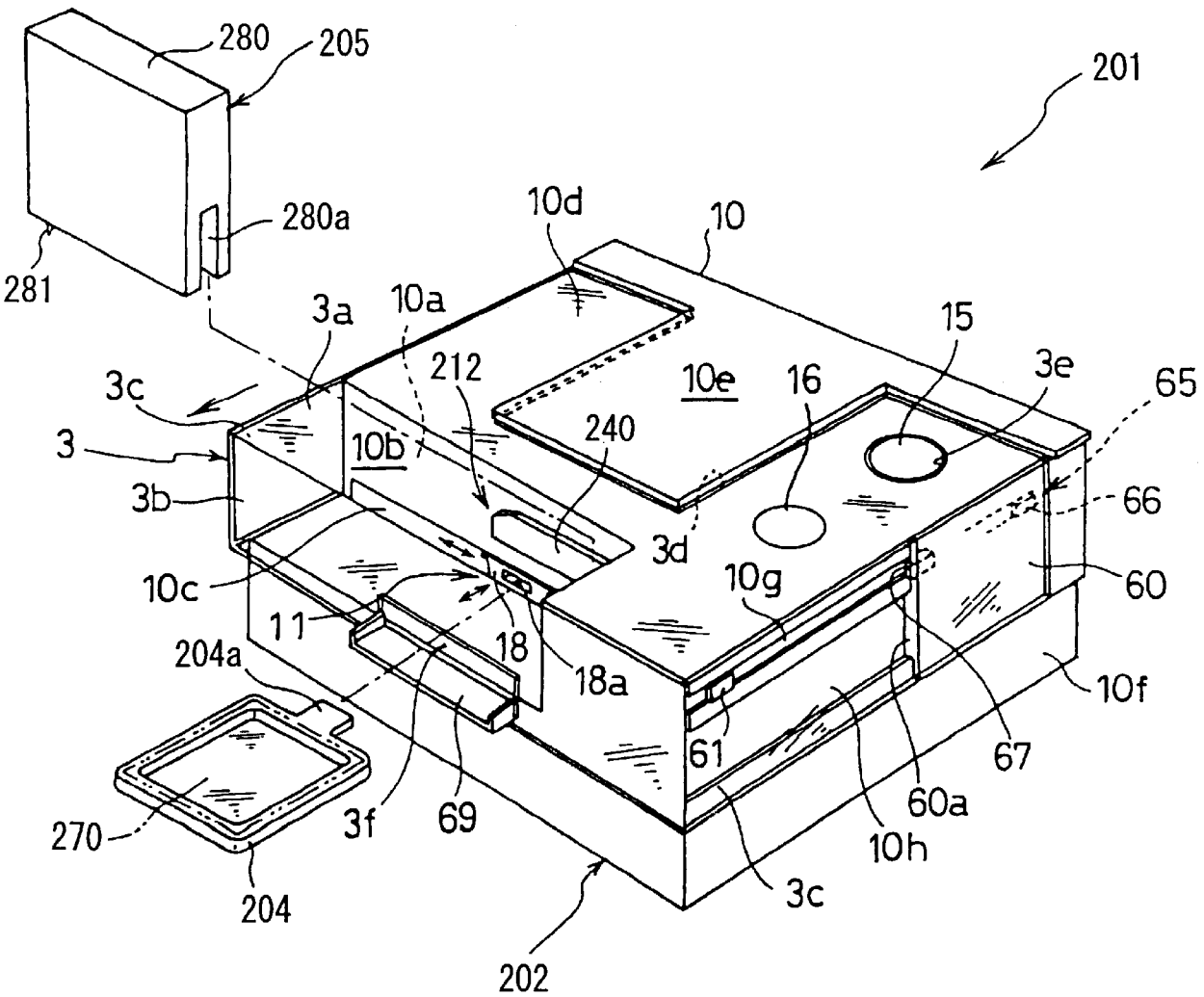
FIG. 48 is a perspective view of the sewing apparatus (when a safety cover is in a storage position)
Figure 49:
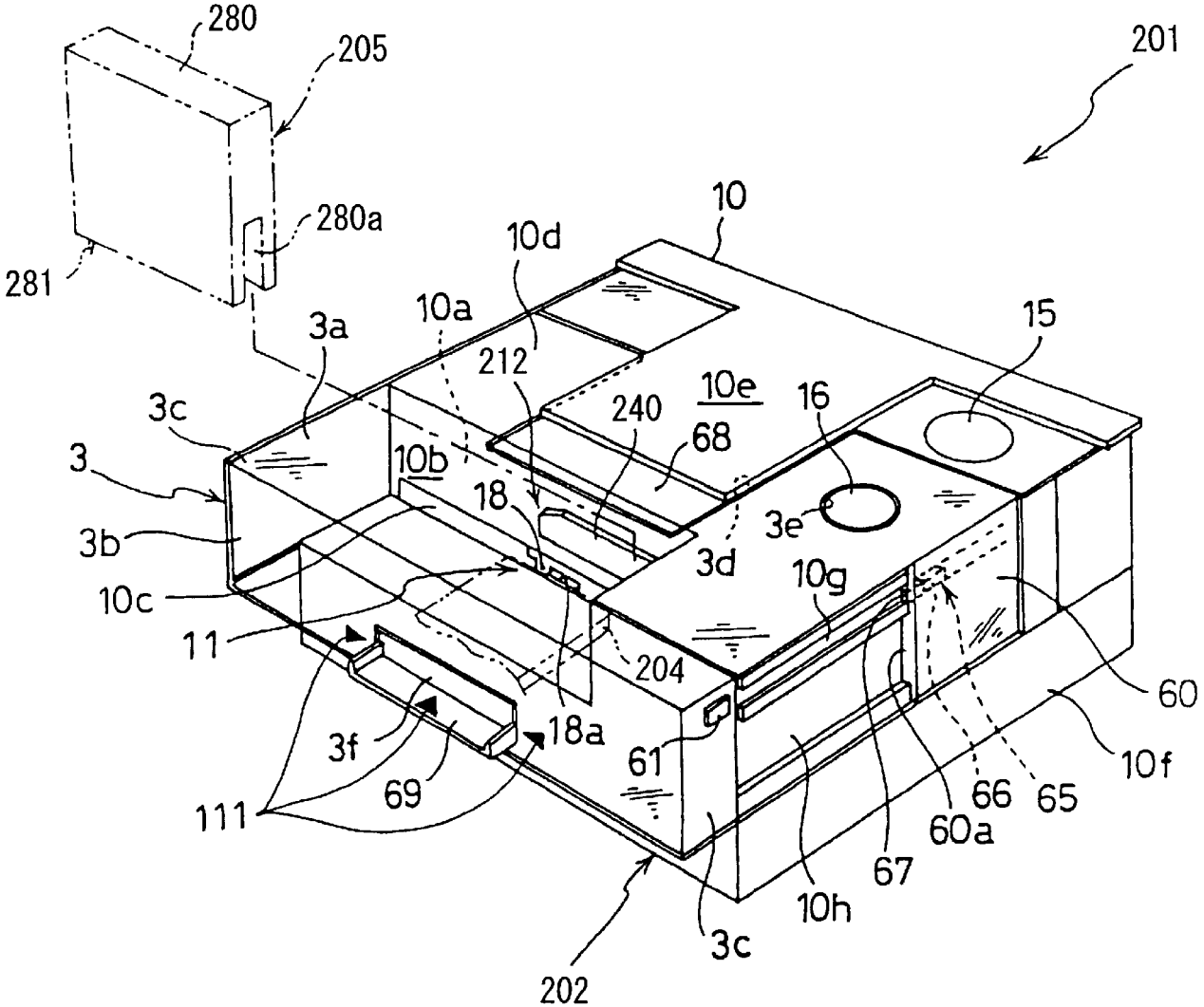
FIG. 49 is a perspective view of the sewing apparatus (when the safety cover is in a sewing position)
Figure 50:
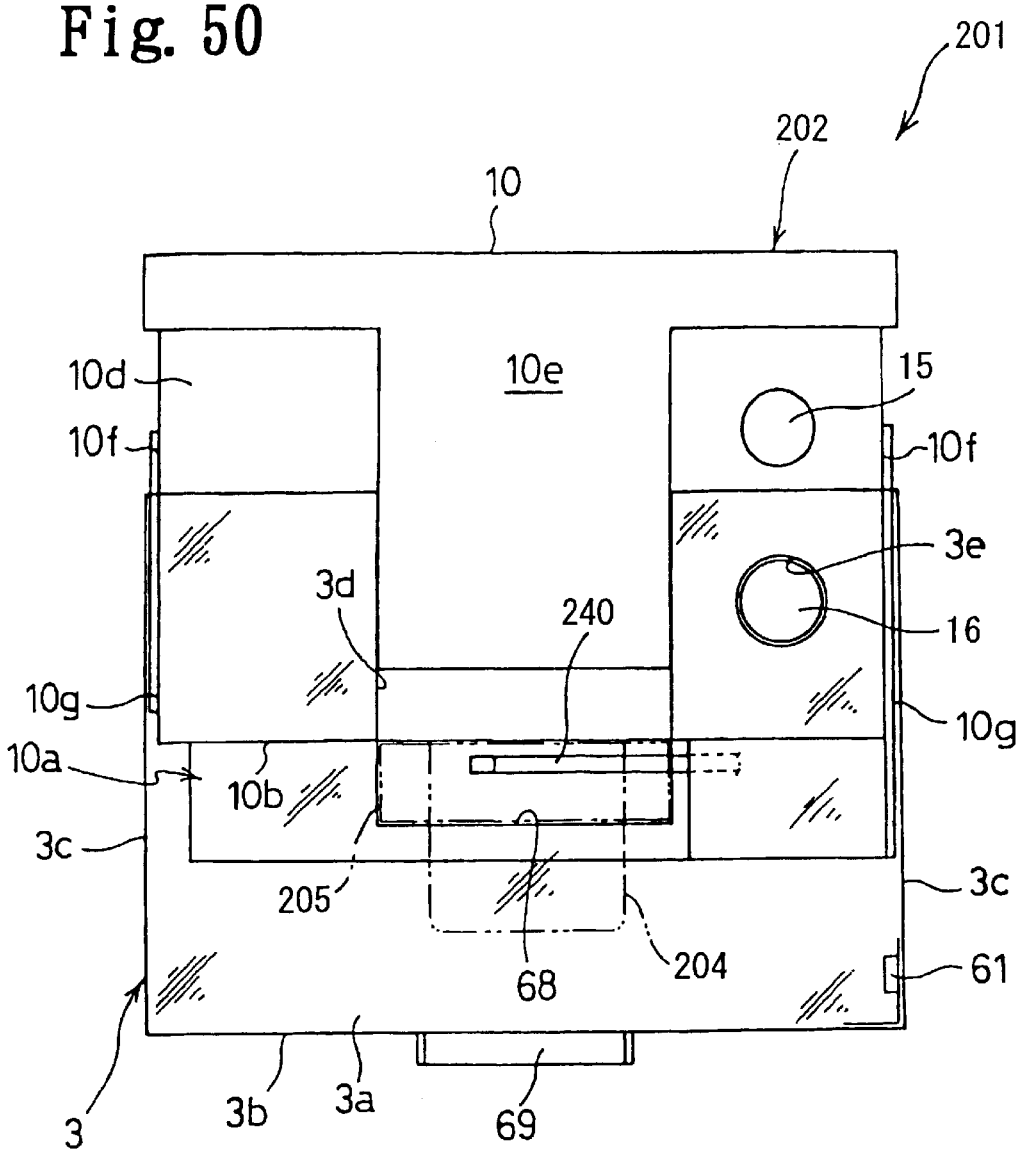
FIG. 50 is a plan view of the sewing apparatus (when the safety cover is in the sewing position)
Figure 51:
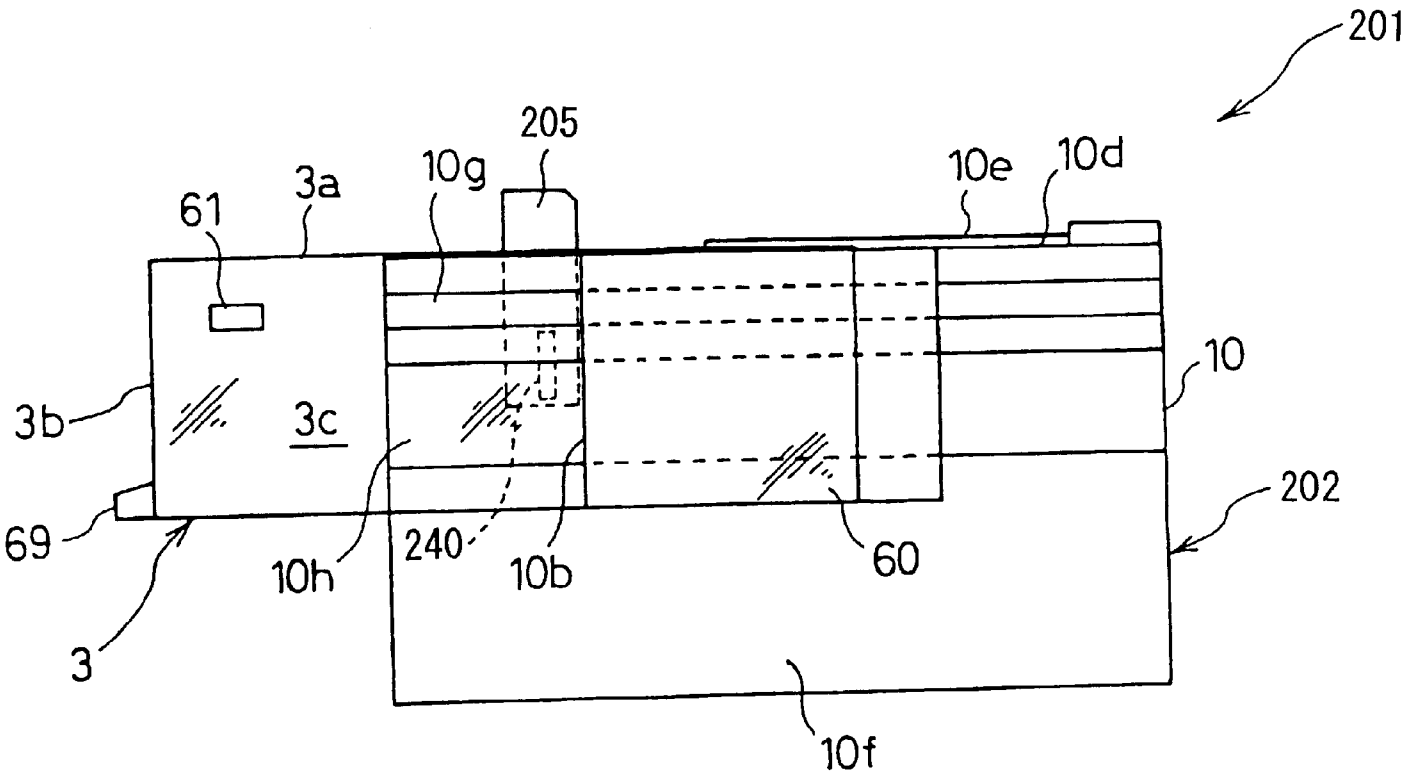
FIG. 51 is a side view of right side of the sewing apparatus (when the safety cover is in the sewing position)
Figure 53:
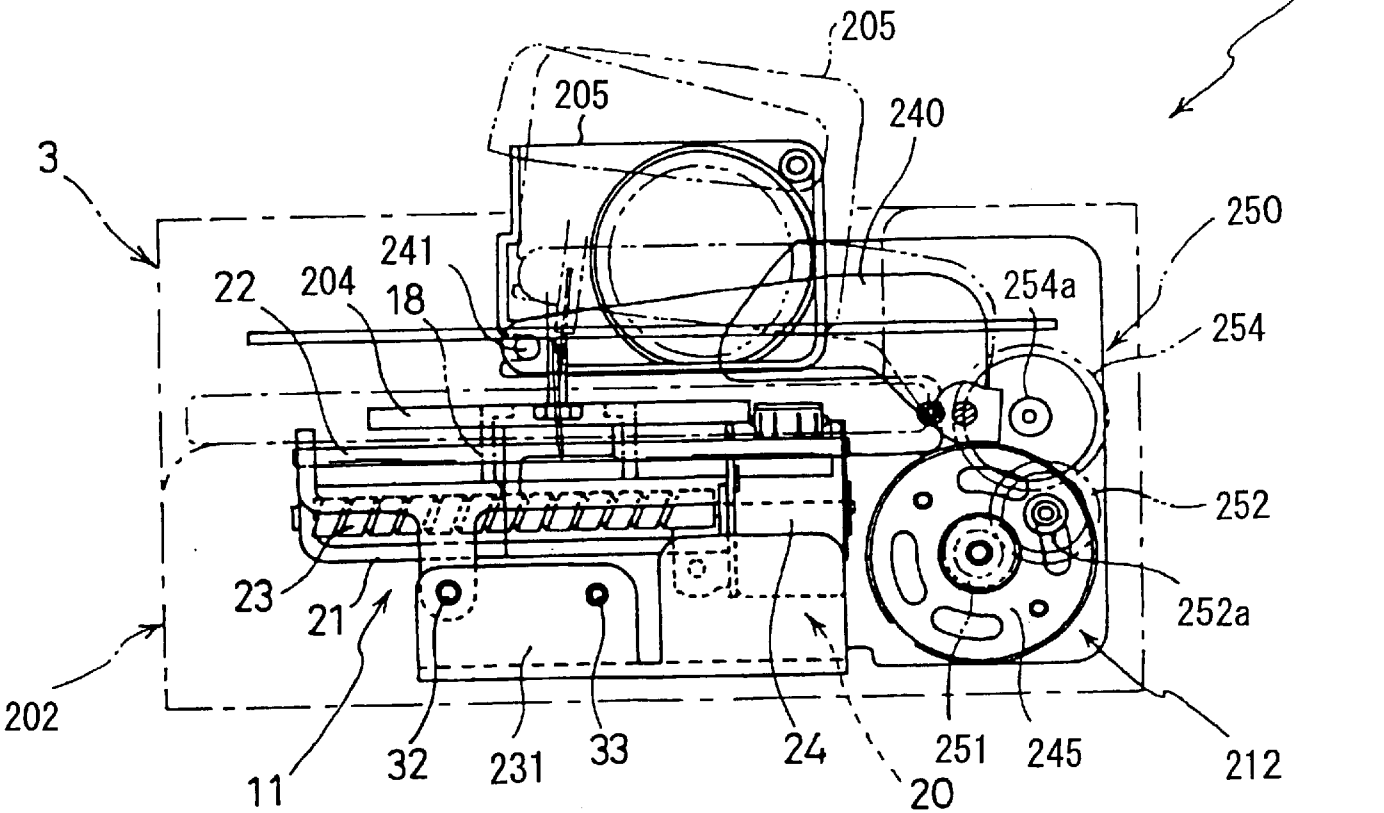
FIG. 53 is a schematic perspective view of the sewing apparatus as seen from the front.
Figure 54:
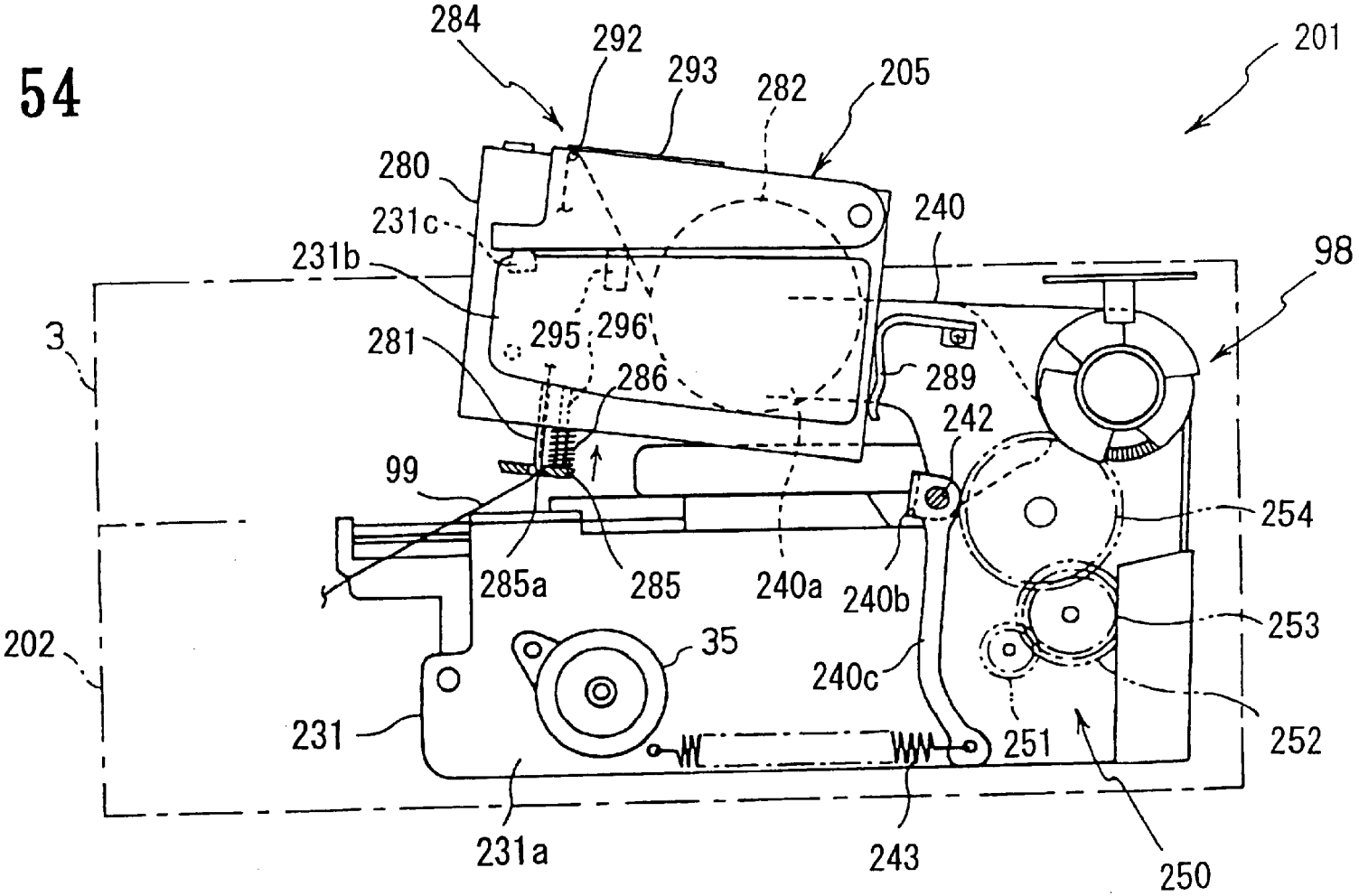
FIG. 54 is a perspective view of the sewing apparatus including a gear mechanism as seen from the front.
Figure 55:
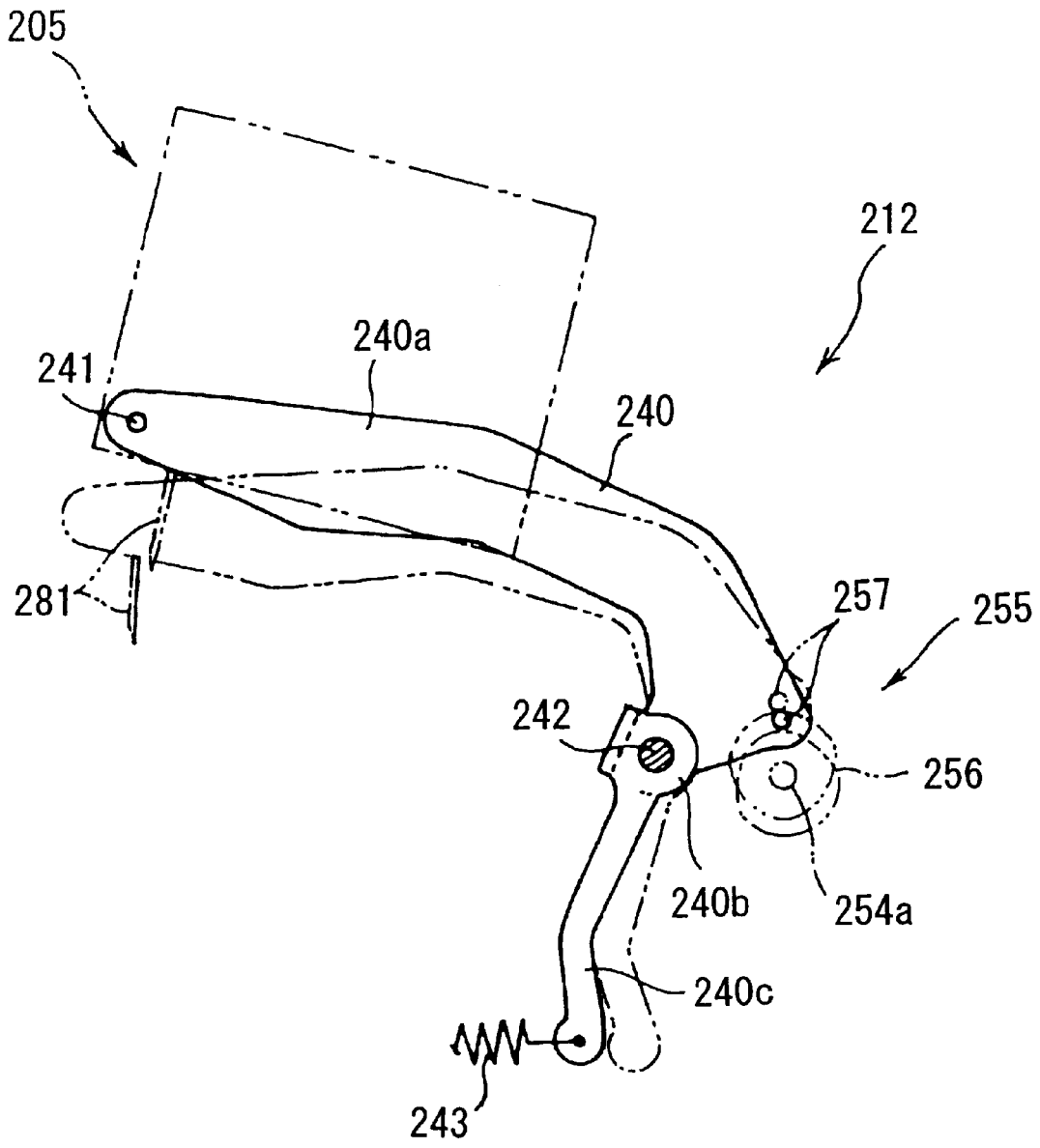
FIG. 55 is a front view of a swing arm and a cam mechanism.

As shown in FIGS. 53 to 55, the swing arm 240 is formed with an arm 240*a*, a pivot portion 240*b*, and a spring attaching lever 240*c*, which form a unitary structure. The swing arm 240 is disposed at substantially the right half part of the forward part of the casing 10 (FIGS. 48 and 49). The most of the arm 240*a* protrudes toward the cutaway space 10*a*. The remaining part, including the pivot portion 240*b* and the spring attaching lever 240*c*, is accommodated in the casing 10. An engaging pin 241, extending in the front to rear direction, is fixed to a left end portion of the arm 240*a*.

A front wall 231*a* of the support frame 231 extends upward. The pivot portion 240*b* is rotatably supported by a pivot shaft 242. The pivot shaft 242 is fixed to the support frame 231. A resin plate 231*b* is fixed to the support frame 231 at a near side above the front wall 231*a* of the support frame 231. The plate 231*b* is integrally formed with a fixing portion 231*c*, which extends in the direction vertical to the drawing paper of FIG. 54.

A lower end of the spring attaching lever 240*c* is connected to the support frame 231 via a tension spring 243. The swing arm 240 is urged in a clockwise direction by the tension spring 243 about the pivot shaft 242. The machine motor 245 is fixed to the back of the right lower portion of the front wall 231*a* of the support frame 231 so that a rotational shaft of the machine motor 245 extends toward the front.

Figure 52:
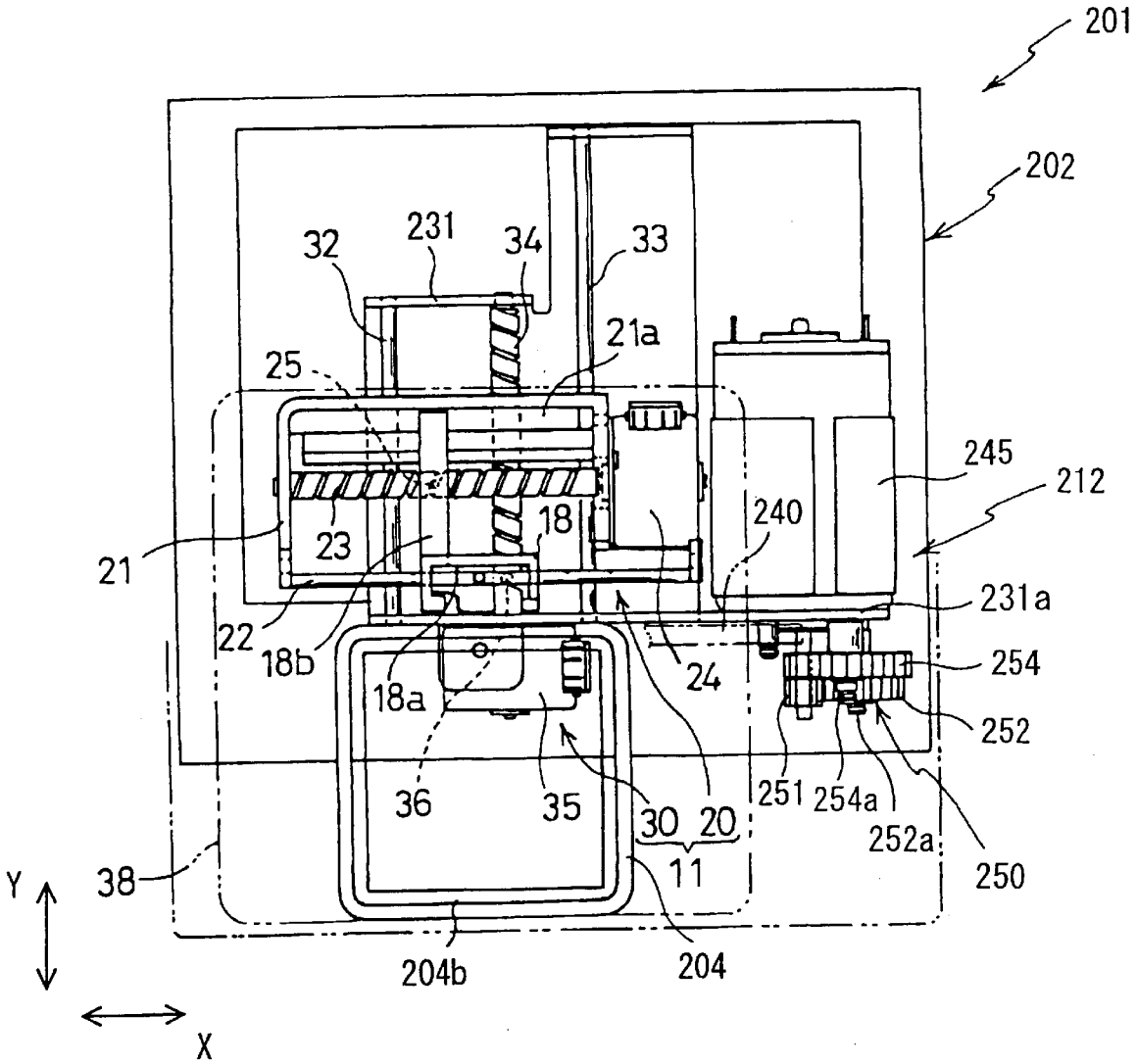
FIG. 52 is a view in transverse section of the sewing apparatus.

As shown in FIGS. 52 to 54, the gear mechanism 250 includes gears 251 to 254 disposed in front of the front wall 231*a* of the support frame 231. The drive gear 251 is fixed to the output shaft of the machine motor 245. The intermediate gears 252, 253 integrally connected on the same shaft are rotatably supported via a pivot shaft 252*a*. The large-diameter gear 254 is rotatably supported by the front wall 231*a* at a position higher than the position of the pivot shaft 252*a*, via a pivot shaft 254*a*. The drive gear 251 engages the intermediate gear 252. The intermediate gear 253 engages the large-diameter gear 254. Thus, the rotation speed of the large-diameter gear 254 is reduced with respect to the rotation speed of the machine motor 245 (the drive gear 251).

As shown in FIG. 55, the cam mechanism 255 has a substantially triangular cam 256, that is fixedly attached to the pivot shaft 254*a* of the large-diameter gear 254, and a cam follower 257 that is fixedly attached to the right end of the arm 240*a* of the swing arm 240 and can engage the cam 256. Because the swing arm 240 is urged in the clockwise direction at all times, the cam follower 257 engages an outer region of the cam 256.

As a distance between an engaging position where the cam follower 257 engages the cam 256 and a center of an axis of rotation of the cam 256 becomes longer, the cam follower 257 is in a further upper position and the arm 240*a* of the swing arm 240 is in a further lower position. When the cam 256 is turned, the arm 240*a* travels vertically between an upper limit position indicated in a solid line and a lower limit position indicated in a double dashed chain line, in FIG. 55. Thus, embroidering operation is performed on a work cloth 270.

The safety cover 3 has the same structure as the safety cover of the first embodiment. Therefore, similar reference numerals have been used in the drawings to denote the safety cover 3 of the second embodiment, and detailed explanation will be omitted.

As shown in FIGS. 48, 49, 52, 57 and 58, the embroidery frame 204 has a rectangular shape. The rear end support portion 204*a* is formed integral with the embroidery frame 204 at the rear end. The rear end support portion 204*a* can engage/disengage the embroidery frame 204 with/from the engage portion 18*a* of the carriage 18. A stepped portion 204*b* is formed at the internal edge of the embroidery frame 204. An outer region of a special work cloth 270 is fit to the stepped portion 204*b*. The work cloth 270 is releasably attached to the substantially entire embroidery frame 204 under a tension via a double-sided adhesive tape or an adhesive.

Figure 58:
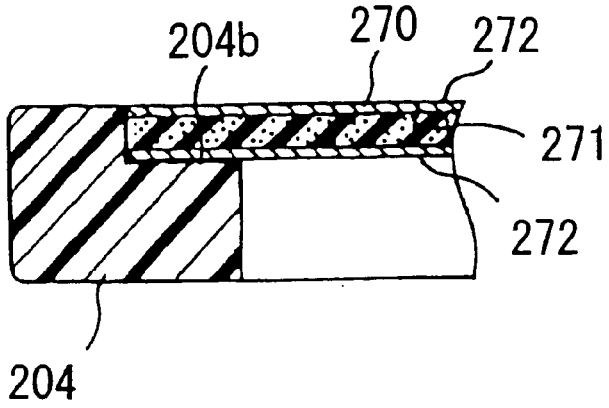
FIG. 58 a view of section taken along line 58—58 of FIG. 57.

As shown in FIG. 58, for example, the special work cloth 270 has elasticity and is a multi-layer structure formed in which an elastic film member 271, made of urethane, is sandwiched by a pair of cloths 272 by lamination. A plurality of the embroidery frames 204 to which a work cloth 270 is attached in advance are kept at the ready.

Figure 56:
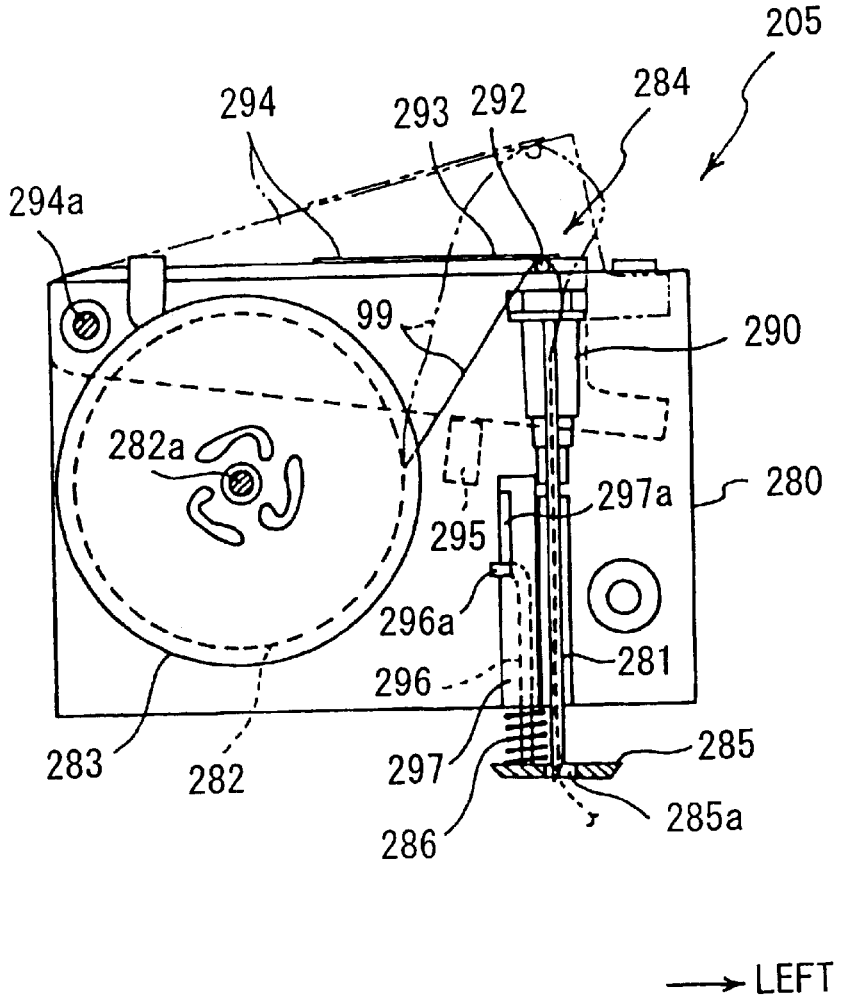
FIG. 56 is a vertical sectional view of a sewing cartridge of the second embodiment of the invention.
Figure 57:
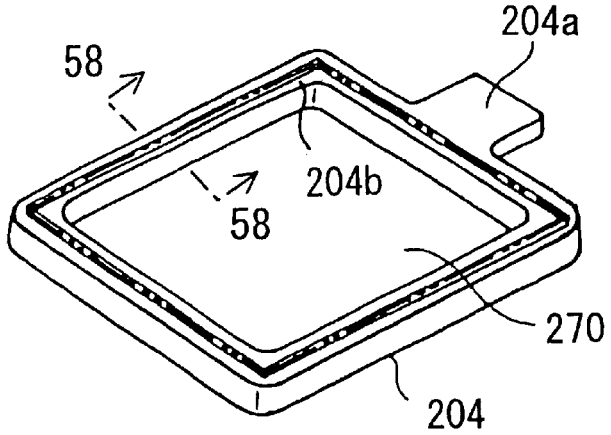
FIG. 57 is a perspective view of an embroidery frame of the second embodiment of the invention.

As shown in FIGS. 48, 54, and 56 (FIG. 56 showing the reverse of FIGS. 48 and 54), the sewing cartridge 205 includes a cover 280, the hollow needle 281, a spool 282, a spool holder 283, a thread looseness preventive mechanism 284, a presser foot 285, and a coil compression spring 286.

The cover 280 has a rectangular shape like a horizontally oriented standing matchbox. The cover 280 accommodates most of the hollow needle 281, the spool 282, the spool holder 283, and the thread looseness preventive mechanism 284. In order to detachably attach the sewing cartridge 205 to the swing arm 240, an engagement groove 280*a* and an pin engagement hole (not shown) are formed at the lower portion of the cover 280. The engagement groove 280*a* engages the arm 240*a* of the swing arm 240. The pin engagement hole is in communication with the engagement groove 280*a*. The engagement pin 241 of the swing arm 240 engages the pin engagement hole.

Therefore, the sewing cartridge 205 is coupled to the swing arm 240 in a predetermined attaching state with a single motion by inserting the sewing cartridge 205 into the safety cover 3 from the cartridge insertion slot 268 formed when the safety cover 3 is moved to the sewing position. This attaching state can be maintained by urging the sewing cartridge 205 by a leaf spring 289 (see FIG. 54) fixed to the swing arm 240.

Figure 47:
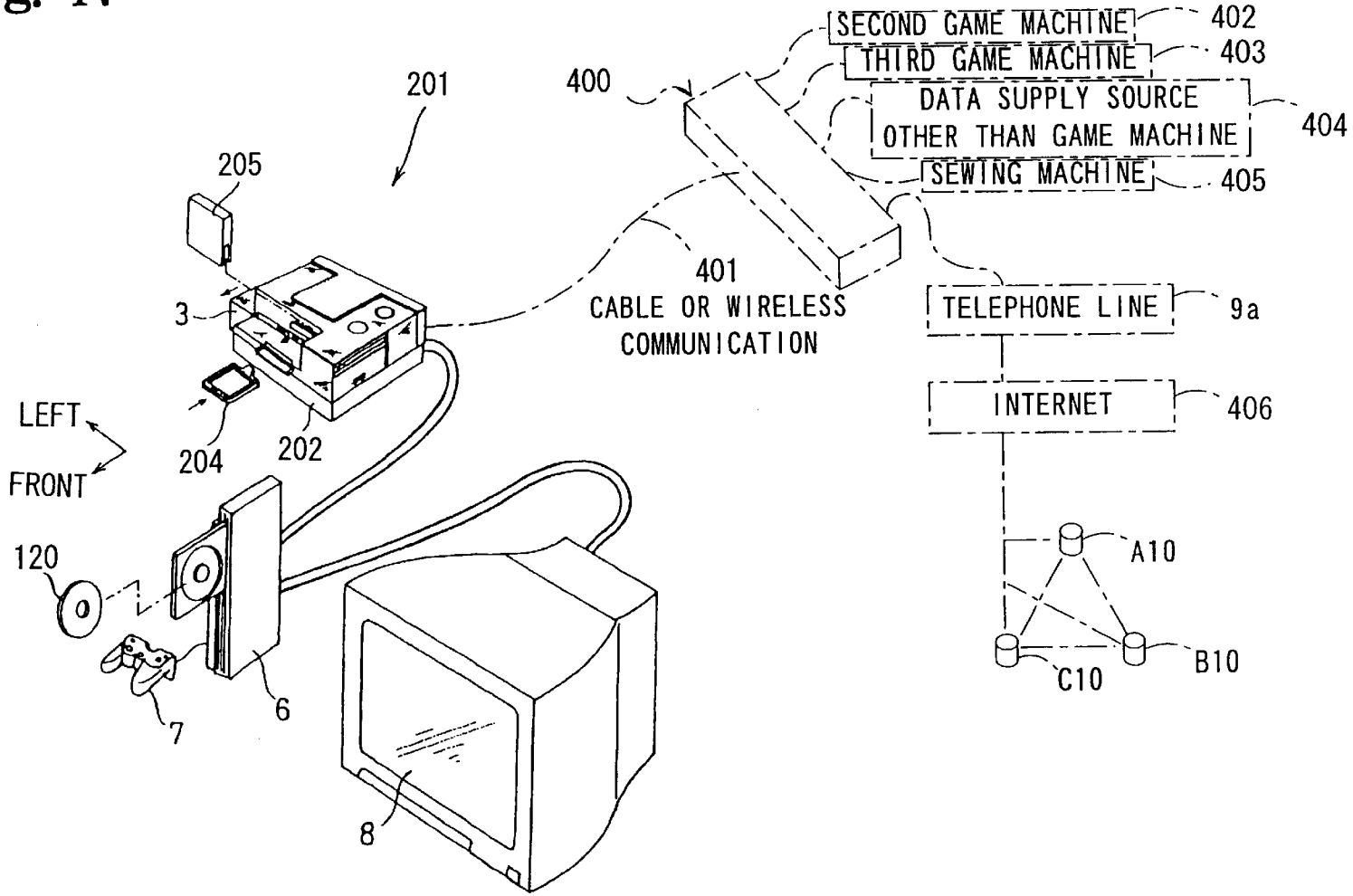
FIG. 47 is a perspective view of a sewing apparatus according to a second embodiment of the invention, a game machine and a display.

The hollow needle 281 is disposed at the right part (of FIG. 56, left part in use as shown in FIGS. 47–49) of the inside of the cover 280 in a substantially standing posture. At least the upper end portion of the hollow needle 281 is supported by a tube-like needle support member 290 fixedly attached to the cover 280. The lower end portion of the hollow needle 281 protrudes from the bottom of the sewing cartridge 205. The spool 282 is disposed (FIG. 56) at the left half of the inside of the cover 280. The spool 282 is rotatably supported by a shaft 282*a*, which is integrally formed with the cover 280 and extends in the front and back direction. The spool 282 is held by the spool holder 283 externally fit to the shaft 282*a*. A tip of the hollow needle 281 is pointed such that the tip is inclined leftwardly and downwardly from the right to the left. When the sewing cartridge 205 is installed in the sewing apparatus body 202 (FIGS. 47–49), an extreme tip of the hollow needle 281 is positioned at an end portion of the sewing cartridge 205 on a center-of-swing side of the swing arm 240 (at a right end side).

An upper thread 99 wound around the spool 282 is not very heavy. A thread hole of the hollow needle 281 is formed so that the thread 99 can be threaded through the hollow needle 281. The thread 99 drawn from the spool 282 is threaded through the hole of the hollow needle 281 via the thread looseness preventive mechanism 284 from above and is drawn toward outside the sewing cartridge 205 from the bottom of the hollow needle 281. A sewing operation is performed with a certain length of the thread 99 drawn from the lower end of the hollow needle 281. The spool 282 is preferably applied an appropriate rotational resistance from the spool holder 283, the shaft 282*a*, or other member in order to prevent the thread 99 from becoming tangled due to aimless rotation of the spool 282 when the thread 99 is drawn from the spool 282.

The thread looseness preventive mechanism 284 includes a guide pin 292 and a leaf spring piece 293 contacting the guide pin 292. The thread 99 is prevented from loosening at the time of sewing by the thread 99 being threaded between the guide pin 292 and the leaf spring piece 293. The guide pin 292 extends in a front and back direction and is fixedly disposed to the cover 280 at its ends, above the hollow needle 281. The guide pin 292 guides the thread 99 drawn from the spool 282 to the hollow needle 281.

The leaf spring piece 293, extending in the right and left direction, is disposed at the upper end of the cover 280. The left end portion of the leaf spring piece 293 is fixed to the cover 280. The right end portion of the leaf spring piece 293 contacts the guide pin 292 from the above. A swing plate 294 is disposed at a top of the cover 280. The swing plate 294 is rotatably supported at its left end via a pivot shaft 294*a* extending in the front to back direction. The guide pin 292 and the leaf spring piece 293 are fixedly provided to the swing plate 294. The guide pin 292 is regulated its vertical position even when the swing arm 240 swings up and down, because the guide pin 292 is supported by a fixing portion 231*c*. However, the spool 282 and the hollow needle 281 swing up and down together with the swing arm 240. Therefore, a path of the thread 99 from the spool 282 to the hollow needle 281 is changed by the guide pin 292.

An engagement piece 295 that can engage the lower end of the swing plate 294 is fixedly attached to the cover 280. In a state where the swing plate 294 is engaged with the engagement piece 295, the swing plate 294 is accommodated in the cover 280. Thus, the sewing cartridge 205 can be used. As the swing plate 294 is moved upward, as shown in FIG. 56, from this state, for example, the thread 99 can be relatively easily threaded through the hollow needle 281 when the thread 99 becomes unthreaded.

The presser foot 285 has a circular plate shape. The presser foot 285 is disposed under the lower end of the hollow needle 281 outside the cover 280. The presser foot 285 is formed with a guide hole 285*a* through which the hollow needle 281 can pass. A lower end of a guide pin 296 is fixedly attached to the right of the presser foot 285. The guide pin 296 slidably engages an engagement member 297 fixed to the right of the hollow needle 281 in the cover 280. The guide pin 296 and the presser foot 285 are vertically movably guided by the engagement member 297.

The coil compression spring 286 is provided to the guide pin 296 between the cover 280 and the presser foot 285, outside the cover 280. The presser foot 285 is elastically urged downward by the coil compression spring 286. A bent portion 296*a* of the upper end portion of the guide pin 296 engages a vertical groove 297*a* in the engagement member 297. Under normal conditions, the bent portion 296*a* engages the lower end portion of the vertical groove 297*a*. Therefore, the presser foot 285 is in a slightly lower position than the lower end portion of the hollow needle 281. Thus, the lower end portion of the hollow needle 281 protruding to the outside of the cover 280 is guarded by the presser foot 285.

When the sewing cartridge 205 descends during a sewing operation, the presser foot 285 presses the work cloth 270 and comes substantially to a standstill. Under this condition, the hollow needle 281 descends with respect to the presser foot 285 and the tip of the hollow needle 281 penetrates the work cloth 270. More specifically, the presser foot 285 is movable if the presser foot 285 is pushed upwardly against the elastic force from the coil compressing spring 286. The presser foot 285 is pushed upwardly when the sewing cartridge 205 is moved to the sewing position by the movement of the swing arm 240. At that time, the presser foot 285 is pushed against a needle plate (not shown, but similar to needle plate 31*d* of the first embodiment), having a hole, through which the hollow needle 281 can pass, formed on the support frame 231, via the work cloth 270. A plurality of sewing cartridges 205 that can be detachably attached to the swing arm 240 are prepared in advance. The cartridges 205 each accommodate a different color, so that a colorful embroidery pattern can be formed using several sewing cartridges 205.

Figure 59:
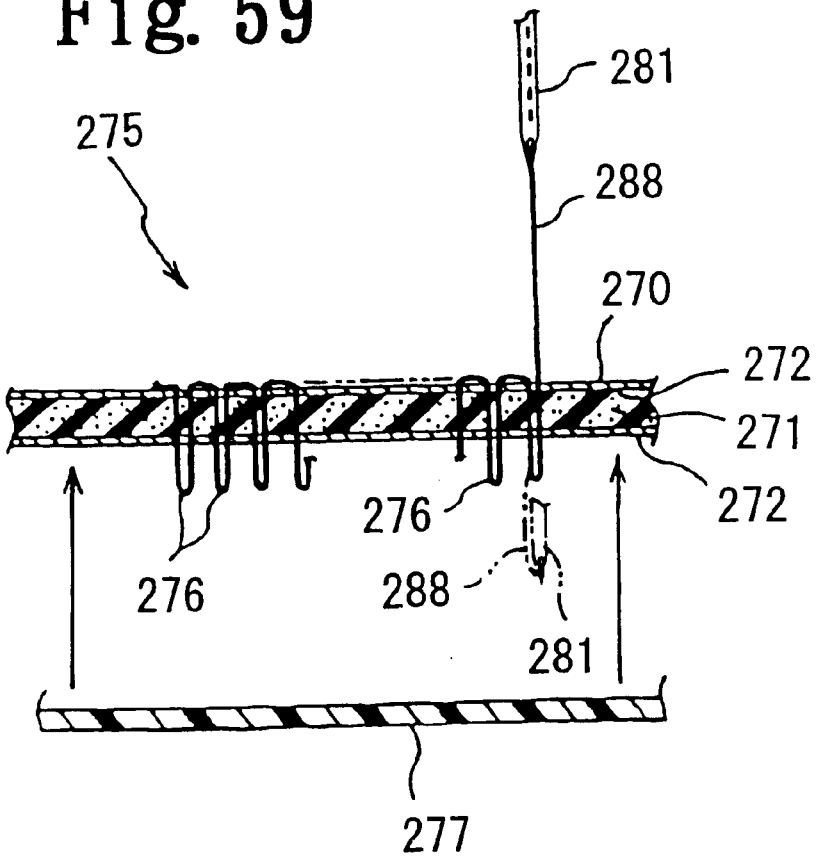
FIG. 59 is a sectional view of a work cloth, an embroidery pattern formed on the work cloth, and a double-sided adhesive tape.

Stitches to be formed on the work cloth 270 by sewing operation performed by the sewing apparatus 201 will be described with reference to FIG. 59. In a state where the embroidery frame 204 having the work cloth 270 and the sewing cartridge 205 are attached to the sewing apparatus body 202, the sewing cartridge 205 is vertically moved by the cartridge driving mechanism 212 while the embroidery frame 204 is being moved by the embroidery frame driving mechanism 211. However, in a state where the hollow needle 281 in the sewing cartridge 205 is penetrating the work cloth 270, the embroidery frame 204 is at a standstill. At that time, the extreme tip of the hollow needle 281 is positioned at the end portion of the sewing cartridge 205 on the center-of-swing side of the swing arm 240, so that the work cloth 270 is prevented from being displaced. The hollow needle 281 is substantially perpendicular to the work cloth 270 at the instant when the hollow needle 281 penetrates the work cloth 270.

When the hollow needle 281 in the sewing cartridge 205 descends and penetrates the work cloth 270, including the elastic film member 271, the thread 99 that extends from the tip of the hollow needle 281 and penetrates the work cloth 270 with the hollow needle 281 is held by the work cloth 270 due to frictional resistance applied from the elastic film member 271 of the work cloth 270. While the hollow needle 281 penetrates the work cloth 270 and reaches a lower limit position indicated in a dashed line, shown in FIG. 59, the thread 99 inside of the hollow needle 281 is not subjected to friction from the work cloth 270. Accordingly, the thread 99 is smoothly drawn from the tip of the hollow needle 281 without pulling out an embroidery pattern 275 formed on the work cloth 270.

Next, when the hollow needle 281 ascends from the lower limit position and the tip of the hollow needle 281 is pulled from the work cloth 270, the thread 99 that extends from the tip of the hollow needle 281 and penetrates the work cloth 270 with the hollow needle 281 from a reverse side of the work cloth 270 is held by the work cloth 270 as described above. Thus, a free loop 276 is formed on the reverse side of the work cloth 270 by the thread 99. Then, until the hollow needle 281 reaches an upper limit position, the thread 99 is drawn from the tip of the hollow needle 281 and then the work cloth 270 is moved in the X direction and the Y direction with the embroidery frame 204. When the hollow needle 281 descends from the upper limit position and penetrates the work cloth 270, a stitch, which is a part of the embroidery pattern 275, is formed on the surface of the work cloth 270.

Figure 60:
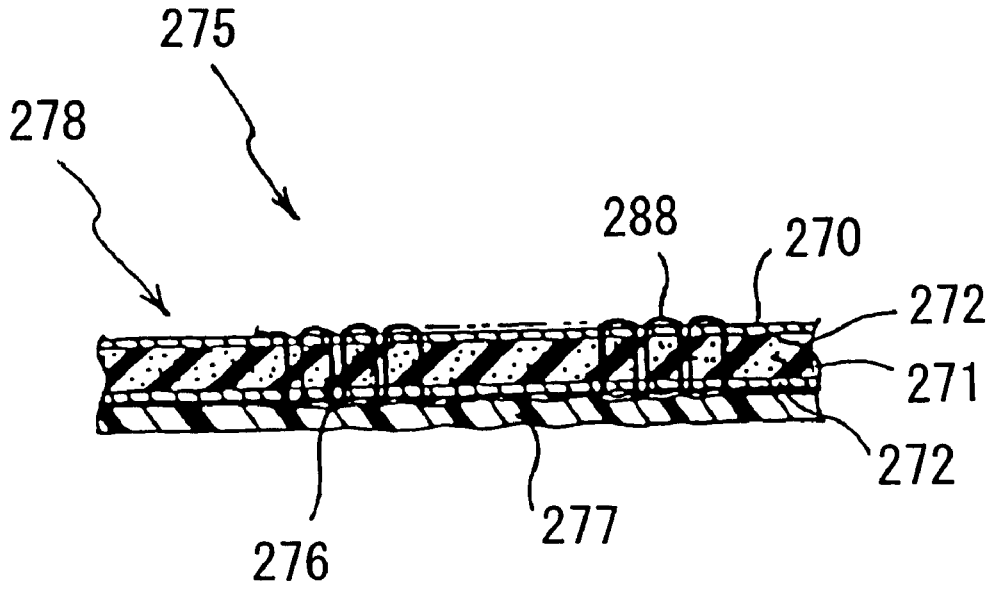
FIG. 60 is a sectional view of a patterned cloth.

The aforementioned operation is successively performed, so that the thread 99 penetrates the work cloth 270 a number of times. As a result, the embroidery pattern 275 is formed on the surface of the work cloth 270 and a plurality of free loops 276 are formed and remain on the reverse side of the work cloth 270. Then, a double-sided adhesive tape 277 is adhered to the reverse side of the work cloth 270 to fix the free loops 276. Thus, a patterned cloth 278, shown in FIG. 60, is formed.

Accordingly, the free loops 276 do not come off, so that the thread 99 does not need to be fixed by other thread or the thread in the previous stitch and following stitch. The embroidery pattern 275 formed on the work cloth 270 is stable without unraveling. The patterned cloth 278 can be attached to various items, via the double-sided adhesive tape 277, as an emblem. Instead of the double-sided adhesive tape 277, adhesive agent may be applied to the reverse side of the work cloth 270 in layers. A tape may be formed of the adhesive agent and the tape may be used to fix the free loops 276 on the reverse side of the work cloth 270.

There are a plurality of free loops 276 on the reverse side of the work cloth 270. Accordingly, unevenness develops in the double-sided adhesive tape 277 when the double-sided adhesive tape 277 is adhered to the reverse side of the work cloth 277. When the work cloth 270 is adhered to clothes via the double-sided adhesive tape 277 as an emblem, the emblem is liable to come off because the cloth is soft. However, adhesion of the work cloth 270 can be improved because of the unevenness on the double-sided adhesive tape 277. The unevenness is formed every free loop or every several free loops depending on the material of the thread and the double-sided adhesive tape used.

Figure 61:
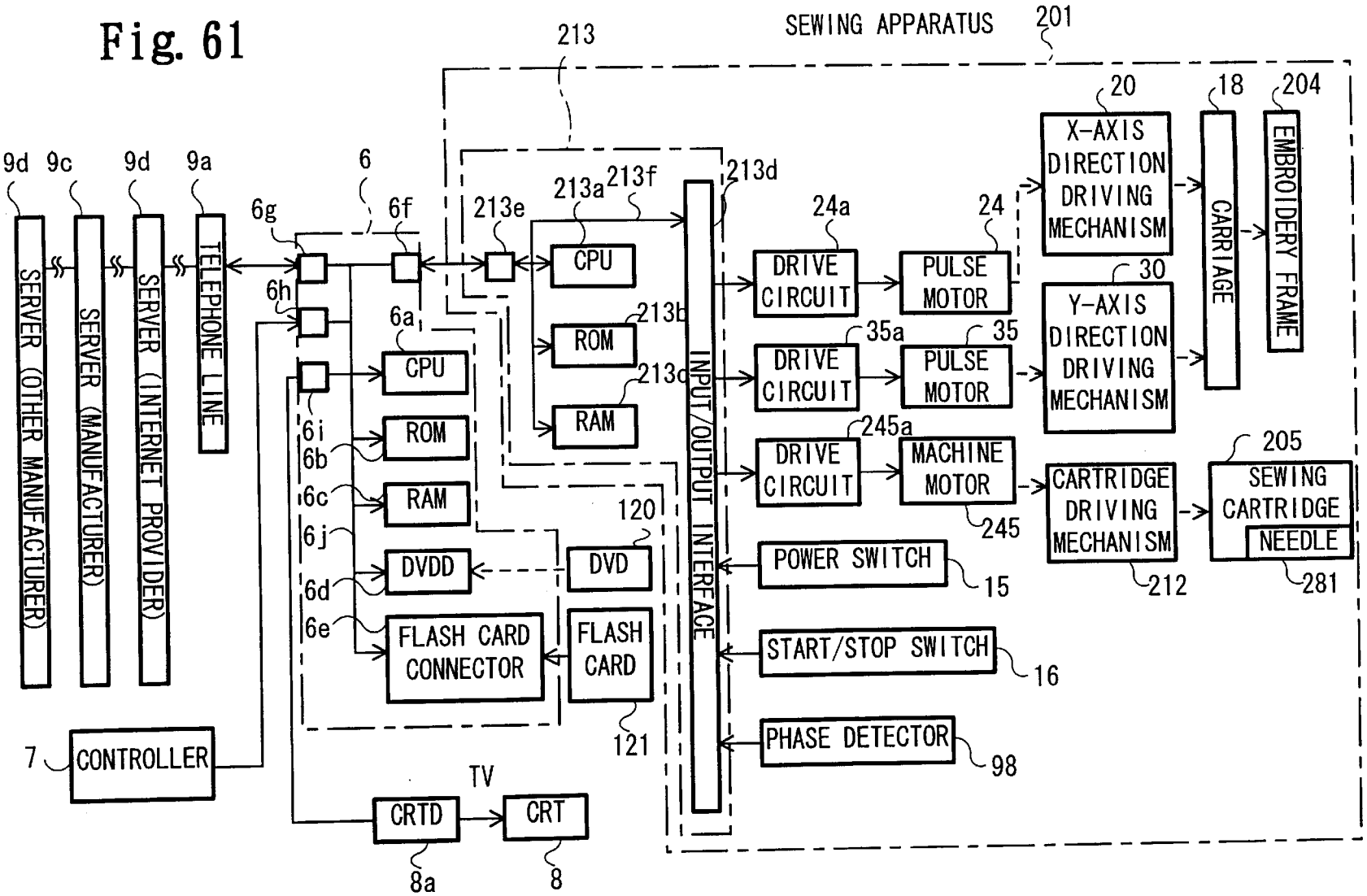
FIG. 61 is a block diagram showing a control system of the sewing apparatus and the game machine.

The controller 213 of the sewing apparatus 201, as shown in FIG. 61, has a computer including a CPU 213*a*, a ROM 213*b*, and a RAM 213*c*, an input/output interface 213*d*, and an input/output terminal 213*e*. The CPU 213*a*, the ROM 213*b*, the RAM 213*c*, the input/output interface 213*d*, and the input/output terminal 213*e* are connected each other via a bus 213*f*.

The ROM 213*b* stores a program for which the CPU 213*a* performs processing the same as the first embodiment. However, the program has been arranged based on the structure of the sewing apparatus 201 of the second embodiment. Therefore, in the sewing apparatus 201 of the second embodiment, the same sewing operation can be performed by implementing similar operations as performed by the sewing apparatus 1 of the first embodiment. Accordingly, details of such control will be omitted.

As described above, according to the sewing apparatus 1, 201, a desired embroidery pattern can be selected/edited from various kinds of embroidery patterns using the game machine 6. A selected/edited embroidery pattern can be sewn on a work cloth 70, 270 attached to the embroidery frame 4, 204. Further, a colorful embroidery pattern can be sewn using threads having different colors in several pattern sections forming the embroidery pattern. The work cloth 70, 270 on which the embroidery pattern is sewn is removed from the embroidery frame 4, 204 and is adhered with the double-sided adhesive tape 77, 277. Thus, a patterned cloth 78, 278 is formed and can be attached to various items as an emblem.

While the sewing operation is performed, the embroidery frame moving area 38, 238 can be covered with the safety cover 3 in the sewing position. Most of the sewing cartridge 5, 205, including the hollow needle 81, 281, and the swing arm 40, 240 can be also covered by the safety cover 3. The safety cover 3 cannot be removed from the sewing apparatus body 2, 202. In positions other than the sewing position, the safety cover 3 prevents the start/stop switch 16 from being operated. Thus, the sewing apparatus 1, 201 is prevented from an undesired operation occurring. Accordingly, the sewing apparatus 1, 201 offers a superior level of safety and operability.

The sewing apparatus 1, 201 is convenient to carry and store because the sewing apparatus 1, 201 is compact and lightweight. The embroidery frame 4, 204 and the sewing cartridge 5, 205 can be easily attached to and detached from the sewing apparatus 1, 201. In the sewing apparatus 1, 201, the safety cover 3 can be easily switched in its position between the storage position and the sewing position to attach/detach the embroidery frame 4, 204 and the sewing cartridge 5, 205 thereto/therefrom. The thread 99 between the hollow needle 81, 281 and the work cloth 70, 270 can be easily cut. Accordingly, the sewing apparatus 1, 201 can be easily handled and operated.

The sewing condition can be observed via the safety cover 3 made of a transparent or a translucent material, so that a user's interest will be raised. Accordingly, the sewing apparatus 1, 201 can be easily handled by all users, for example, by children. Further, the sewing apparatus 1, 201 offers a superior level of safety and operability. Because character emblems can be made by which desired characters are selected from game software and are embroidered on a work cloth, children will get a lot of pleasure from the sewing.

In the first and the second embodiments, the appearance and shape of the sewing apparatus 1, 201 and the safety cover 3 may be changed as described below. Similar reference numerals have been used in the several figures to denote similar parts and explanations for the similar parts will be omitted.

Figure 62:
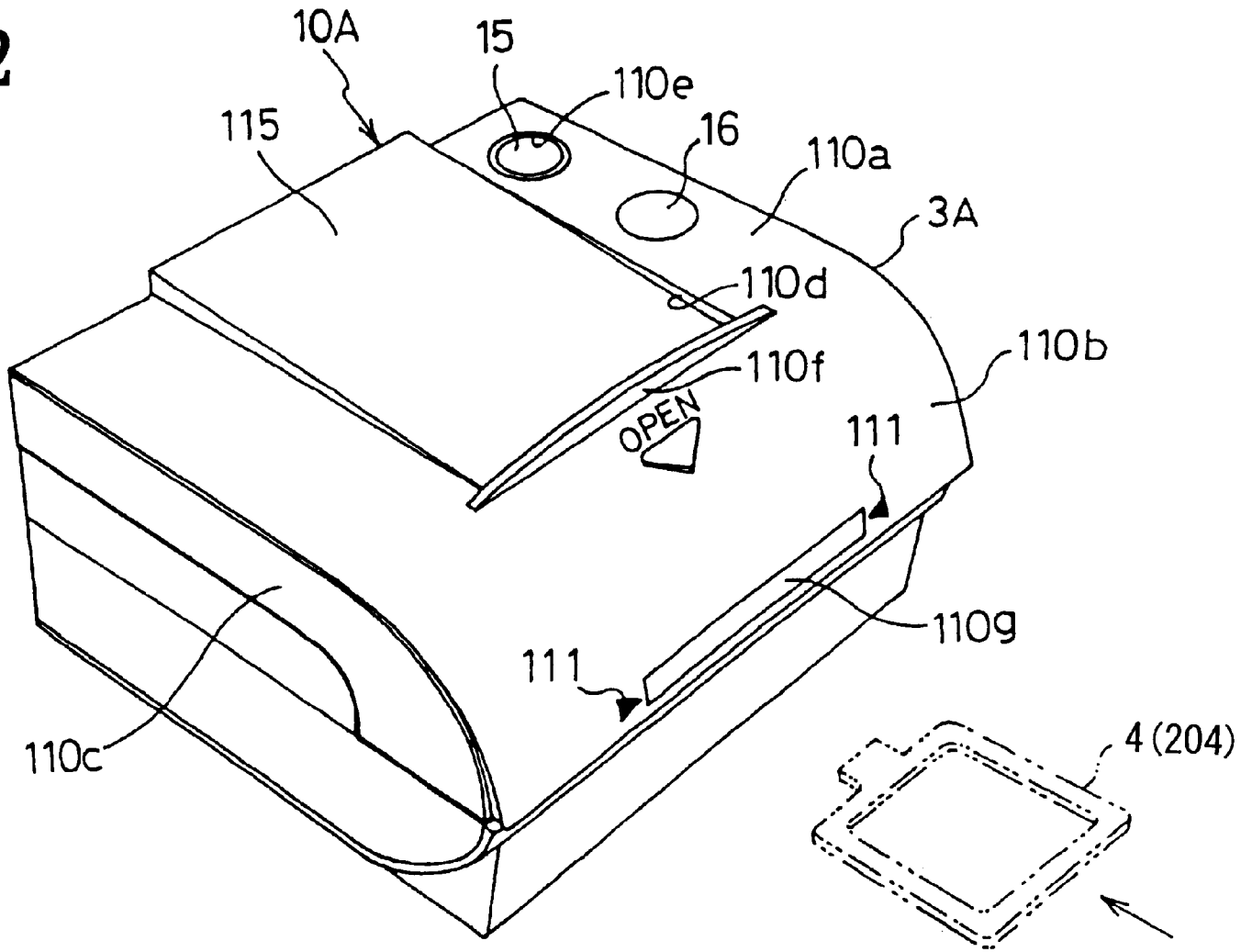
FIG. 62 is a perspective view of a sewing apparatus having a safety cover according to a variation.

A first variation will be described with reference to FIG. 62. In this variation, a safety cover 3A made of a transparent or a translucent material has an upper wall 110*a*, a curved front wall 110*b*, and right and left side walls 110*c*. The front wall 110*b* curvedly continues into the upper wall 110*a*. The safety cover 3A does not have a lower wall and a rear wall. The safety cover 3A can slide between a sewing position where the safety cover 3A covers the moving area of the embroidery frame 4, 204 at the time of sewing and a storage position (the position shown in FIG. 62) where the safety cover 3A is returned to its position from the sewing position.

A recessed area 110*d* is formed in the upper wall 110*a*. The recessed area 110*d* is recessed from a rear end of the upper wall 110*a*. A guide upper surface 115 of a casing 10A slidably engages the recessed area 110*d* so that the safety cover 3A can be slid back and forth. On the right of the upper wall 110*a*, a switch operating hole 110*e* is formed. When the safety cover 3A is in the sewing position, a cartridge insertion slot (not shown), into which a sewing cartridge 5, 205 is inserted, is formed with the recessed area 110*d* of the safety cover 3A and the guide upper surface 115.

A pull 110*f*, extending in the right and left direction, is formed integral with the upper wall 110*a*. The pull 110*f* protrudes upward along a front edge of the recessed area 110*d*. The safety cover 3A can be slid to switch its position between the sewing position and the storage position by grasping the pull 110*f*. In the front wall 110*b* of the safety cover 3A, an embroidery frame insertion slot 110*g*, extending in the right and left direction, is formed at substantially middle portion in the right and left direction. On both sides of the embroidery frame insertion hole 110*g*, formed in the front wall 110*b*, a pair of triangular marks 111, such as a seal, are adhered. The marks 111 indicate a position to which the embroidery frame 4, 204 is attached. In the first embodiment, as shown in FIG. 49, the marks 111 may be provided on the front of the safety cover 3 and the guide member 69. In other figures, the marks 111 are not illustrated.

The safety cover 3 described above is prohibited in its movement from the sewing position to the storage position by the sewing cartridge 5, 205. A member other than the sewing cartridge 5, 205 may be used to prohibit the movement of the safety cover 3 by which the sewing cartridge 5, 205 is attached to the sewing apparatus body 2, 202. The safety cover 3 cannot be removed from the sewing apparatus body 2, 202. However, the safety cover 3 may be detachably attached to the sewing apparatus body 2, 202 by omitting the engagement block piece 67.

Figure 63:
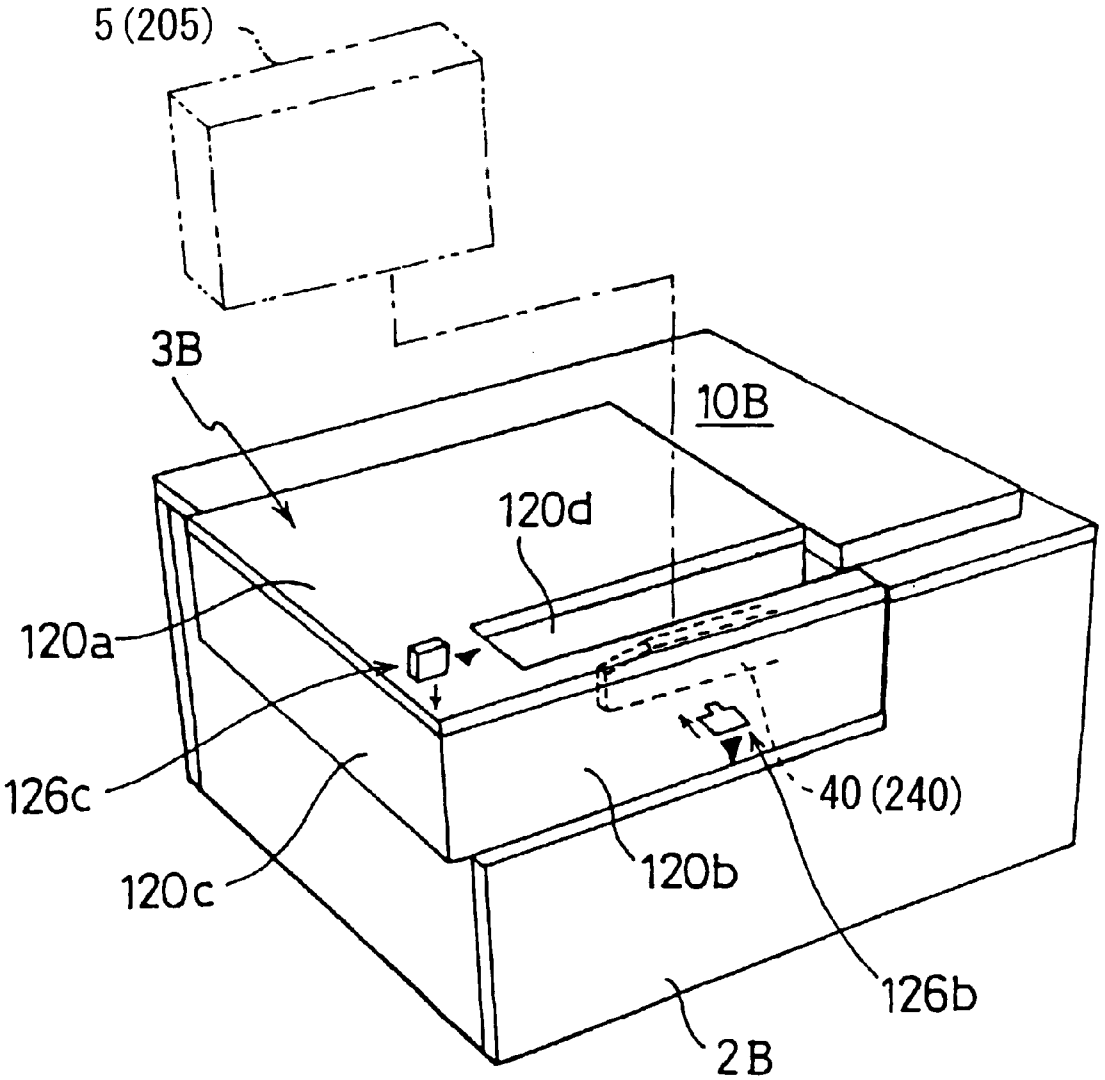
FIG. 63 is a perspective view of a sewing apparatus having a safety cover (in a closed position) according to another variation.
Figure 64:
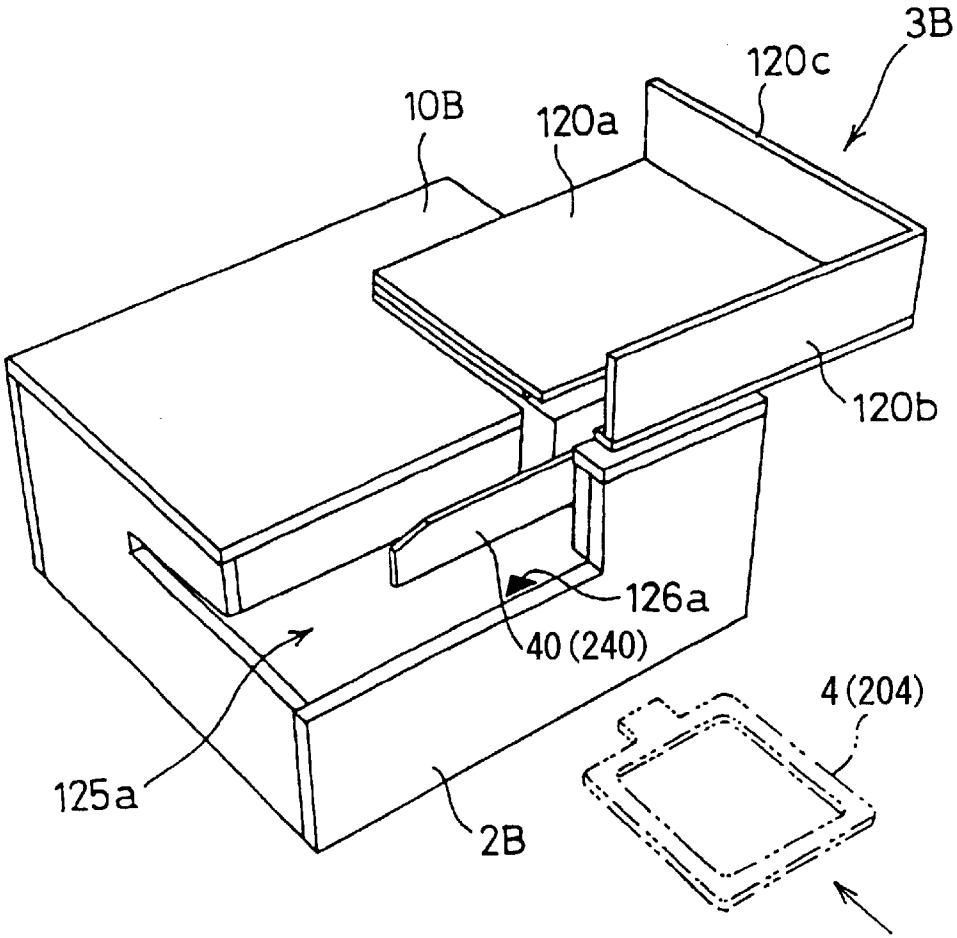
FIG. 64 is a perspective view of the sewing apparatus having the safety cover (in an open position) of FIG. 62.

A second variation will be described with reference to FIGS. 63 and 64 in which a safety cover 3B is made of a transparent or a translucent material. The safety cover 3B is connected to a sewing apparatus body 2B. The safety cover 3B can be opened and be closed about its right end portion as a center of rotation. The safety cover 3B can be in a closed position where the safety cover 3B covers the moving area of the embroidery frame 4, 204 (see FIG. 63) and in an open position where the safety cover 3B uncovers the moving area (see FIG. 64). The safety cover 3B has an upper wall 120*a*, a front wall 120*b*, and a left side wall 120*c*. In the closed position, the safety cover 3B does not have a lower wall, a rear wall, and a right wall.

In the upper wall 120*a*, a cartridge insertion slot 120*d* is formed by which the upper wall 120*a* is cut away from the right end. When the safety cover 3B is in the closed position, shown in FIG. 63, a rear part of the upper wall 120*a* partly covers the upper surface of the casing 10B of the sewing apparatus body 2B and the left side wall 120*c* partly covers a left side surface of the casing 10B. The sewing cartridge 5, 205 can be attached to the swing arm 40, 240 by insertion into the safety cover 3B using the cartridge insertion slot 120*d* and being guided thereby.

When the sewing cartridge 5, 205 is attached to the swing arm 40, 240, the left side surface of the sewing cartridge 5, 205 is closely opposed to the left end portion of the cartridge insertion slot 120*d*. Thus, when an attempt is made to open the safety cover 3B, the safety cover 3B cannot be opened because the sewing cartridge 5, 205 contacts the left end portion of the cartridge insertion slot 120*d*. That is, when the sewing cartridge 5, 205 is attached to the sewing apparatus body 2B, the safety cover 3B is regulated in its position to the closed position by the sewing cartridge 5, 205 for safety during sewing operations.

A triangular mark 126*a*, such as a seal, indicating a position where the embroidery frame 4, 204 is attached, is adhered to an upper surface of an upper wall of the casing 10B forming a cutaway space 125*a* of a casing 10B. The embroidery frame 4, 204 is attached to the carriage in a state where the safety cover 3B is switched to the open position, shown in FIG. 64. At that time, the embroidery frame 4, 204 can be easily attached to the carriage with reference to the mark 126*a*. Though a power switch and a start/stop switch are not illustrated in the drawing, they are provided to the casing 10B. In order to visually identify the attaching positions of the embroidery frame 4, 204 and the sewing cartridge 5, 205 in the sewing apparatus body 2B, marks 126*b*, 126*c* may be provided to the safety cover 3B.

Figure 65:
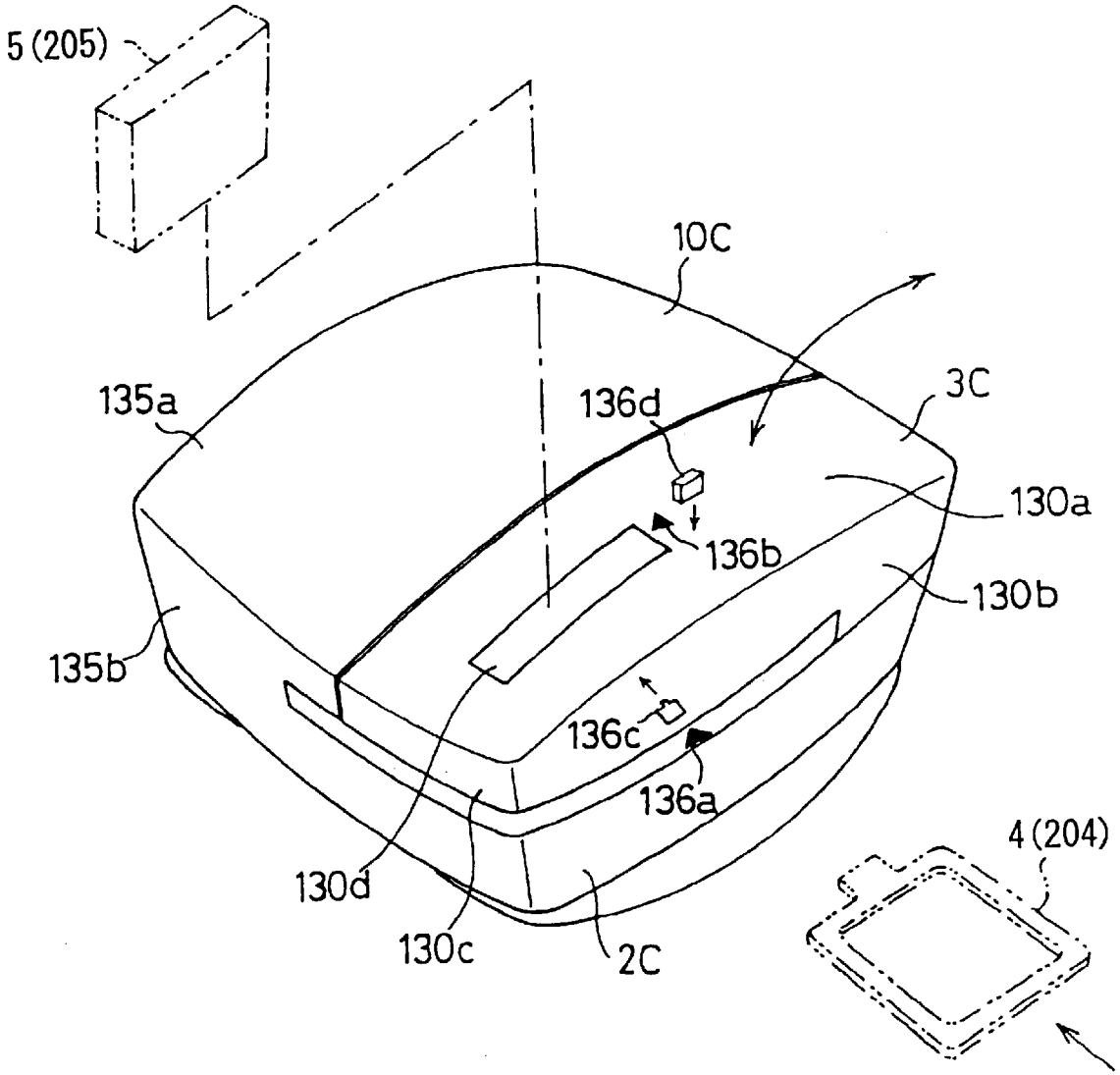
FIG. 65 is a perspective view of a sewing apparatus having a safety cover according to another variation.

A third variation will be described with reference to FIG. 65. In substantially the same fashion as the safety cover 3B, a safety cover 3C is connected to a sewing apparatus body 2C. The safety cover 3C can be opened and be closed about its right end portion as a center of rotation. The safety cover 3C can be in a closed position where the safety cover 3C covers the moving area of the embroidery frame 4, 204 (see FIG. 65) and an open position where the safety cover 3C uncovers the moving area. The safety cover 3C has an upper wall 130*a*, a front wall 130*b*, and left and right side walls 130*c*. In the closed position, the safety cover 3C does not have a lower wall, a rear wall, and a right wall.

In a state where the safety cover 3C is in the closed position, the upper wall 130*a* and the side walls 130*c* substantially continue into an upper wall 135*a* and outer surfaces of side walls 135 of a casing 10C of a sewing apparatus body 2C. The upper wall 130*a* of the safety cover 3C and the upper wall 135*a* of the casing 10C are convexly curved such that a substantially middle portion in the right and left direction are uplifted. Substantially middle portions of the side walls 130*c* of the safety cover 3C and the side walls 135*b* of the casing 10C in the back and forth direction are uplifted. Therefore, the safety cover 3C is rounded in its body.

On the safety cover 3C, marks 136*a*, 136*b* are provided which indicate attaching positions of the embroidery frame 4, 204 and the sewing cartridge 5, 205, respectively. Marks 136*d*, 136*e*, that visually indicate the type of member (the embroidery frame 4, 204 and the sewing cartridge 5, 205) to be attached to the sewing apparatus body 2, 202 are also provided. A reference numeral 130*d* designates a cartridge insertion slot.

Figure 66:
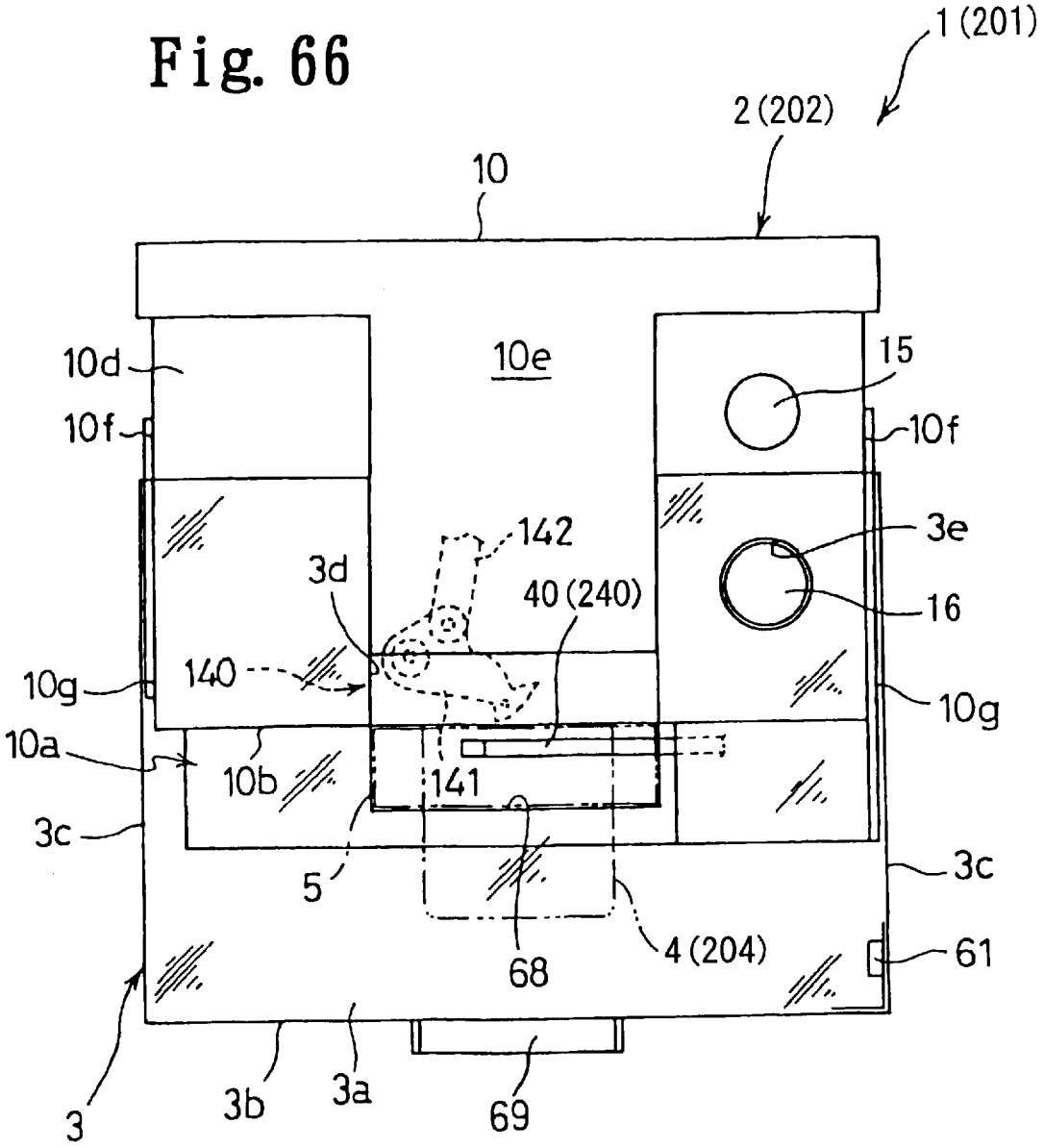
FIG. 66 is a plan view of a sewing apparatus including a thread cutting mechanism.

As shown in FIG. 66, a cutting mechanism 140, that cuts the thread 99 between the hollow needle 81, 281 and the work cloth 70, 270 after sewing operation is completed, may be provided. The cutting mechanism 140 has a cutter 141 and a link 142. The cutter 141 is rotatably supported by a vertically extending shaft. The link 142 is rotatably connected to one end of the cutter 141 and is supported by the vertically extending shaft. The link 142 is driven substantially back and forth by an actuator (not shown). Thus, the cutter 141 is rotated and the thread 99 between the hollow needle 81, 281 and the work cloth 70, 270 can be cut. The cutting mechanism 140 is similar in structure to a thread cutting device disclosed in U.S. Pat. No. 5,803,001, the disclosure of which is herein incorporated by reference.

After the thread loosening processing, the embroidery frame driving mechanism 11 is controlled so that the embroidery frame 4, 204 is moved to a thread cutting position where the loosened thread 99 can be cut by the cutting mechanism 140. Then, the cutting mechanism 140 is driven and thus the loosened thread 99 is cut.

A thread cutting control program for cutting the thread 99 by controlling the embroidery frame driving mechanism 11 and the cutting mechanism 140 may be stored in the ROM 13*b*, 213*b* in the sewing apparatus 1, 201. Further, the thread cutting control program may be stored in the DVD 120 and appropriately supplied to the controller 13, 213 in the sewing apparatus 1, 201. A thread cutting position of the embroidery frame 4, 204 is calculated based on such as a last stitch position where the hollow needle 81, 281 penetrates the work cloth 70, 270 last in one pattern section and data used for moving the embroidery frame 4, 204 to loosen the thread 99.

Figure 67:
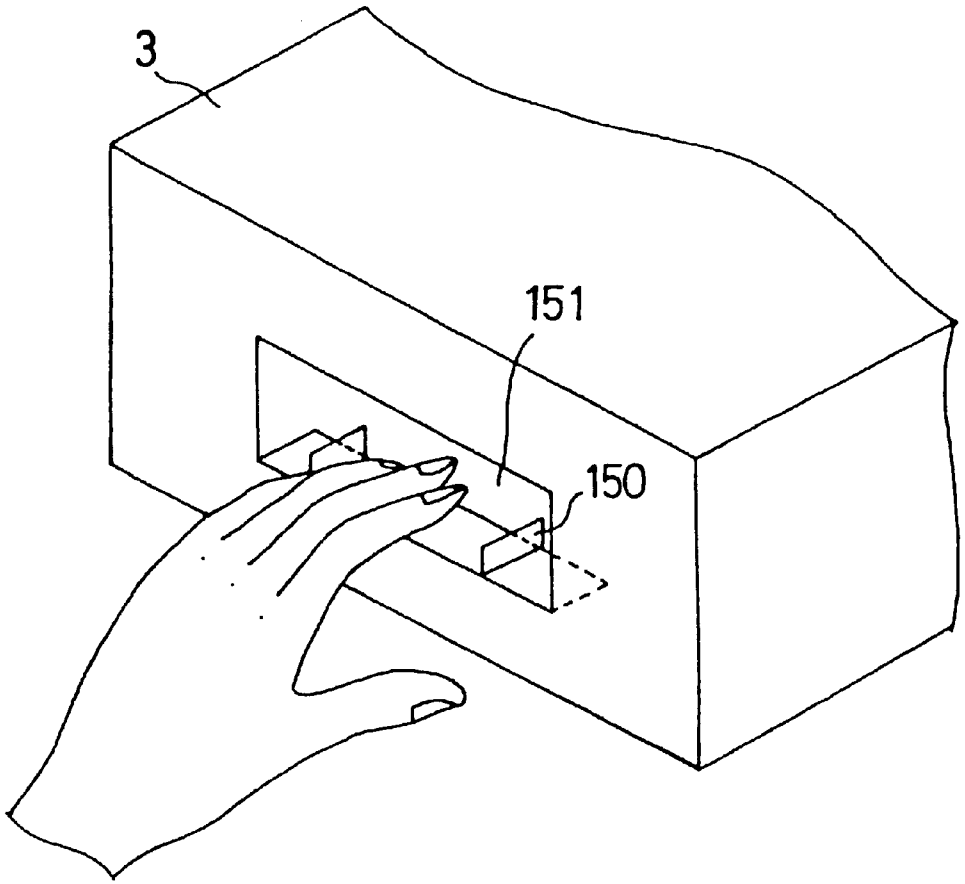
FIG. 67 is a fragmentary perspective view of a safety cover according to another variation.

In the aforementioned embodiments, as shown in FIGS. 3 and 49, the guide member 69 is provided so as to protrude outside of the safety cover 3. However, as shown in FIG. 67, a guide member 150 may be provided inside the safety cover 3. In this case, an embroidery frame insertion slot 151 requires a size sufficient for a hand to be inserted thereinto. In such a case, the embroidery frame insertion slot 151 becomes large in size, so that the function as a cover degrades somewhat. Accordingly, the guide member 69 is preferably provided outside the safety cover 3. By doing so, the inside of the safety cover 3 can be effectively used for the movement of the carriage 18 for the sewing operation.

Figure 68A:
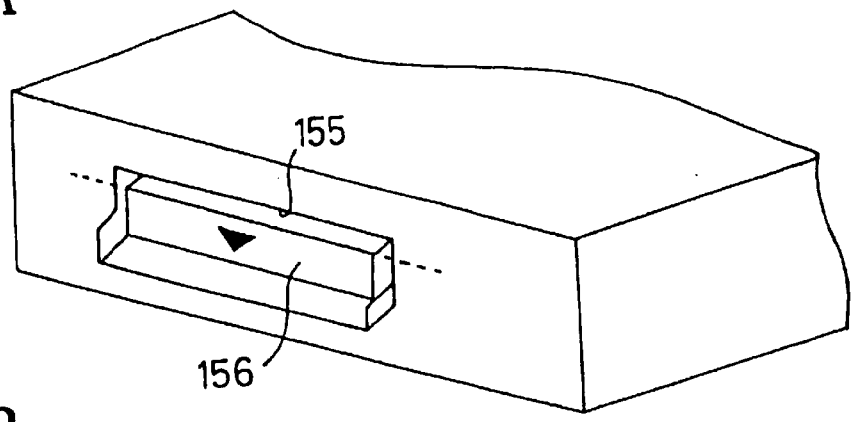
FIG. 68A is a perspective view of a part of a safety cover having a flap, according to another variation.
Figure 68B:
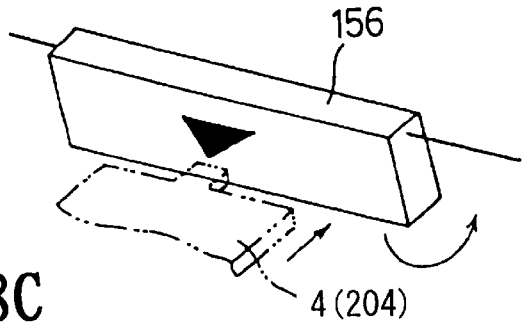
FIG. 68B is a perspective view of the flap of FIG. 68A when the embroidery frame is inserted into the safety cover.
Figure 68C:
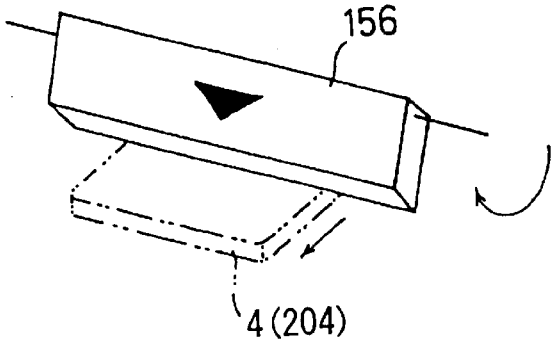
FIG. 68C is a perspective view of the flap of the FIG. 68A when the embroidery frame is removed.

In the embodiments described above, a portion where the embroidery frame 4, 204 is inserted is formed with an opening. However, as shown in FIG. 68A, a flap 156 may be rotatably provided to an opening 155. The flap 156 blocks passage of the embroidery frame 4, 204 under its own weight. As shown in FIGS. 68A and 68B, the flap 156 may be structured so that the flap 156 swings to open for the passage of the embroidery frame 4, 204 by which the flap 156 is pressed by the end of the embroidery frame 4, 204, when the embroidery frame 4, 204 is inserted or removed. Accordingly, safety can be improved by the provision of the flap 156.

In the aforementioned embodiments, even when the carriage 18 is in the foremost position, the carriage 18 is positioned directly below the hollow needle 81, 281 and is deep in the sewing apparatus body 2, 202. Therefore, the position of the carriage 18 is difficult to confirm. In order to easily attach the embroidery frame 4, 204 to the carriage 18, it may be structured that the carriage 18 is moved forward to a position where the carriage 18 is close to the safety cover 3. For example, the carriage 18 may be moved to a position immediately behind the guide member 69, or the carriage 18 may be moved to a position where the carriage 18 protrudes from the safety cover 3. In this case, the embroidery frame moving area 38 for sewing does not coincide with the moving limit area. It is inconceivable that the moving mechanism for the embroidery frame 4, 204 makes full use of the capability. Accordingly, the embroidery frame moving area 38 for sewing preferably coincides with the moving limit area.

Figure 69:
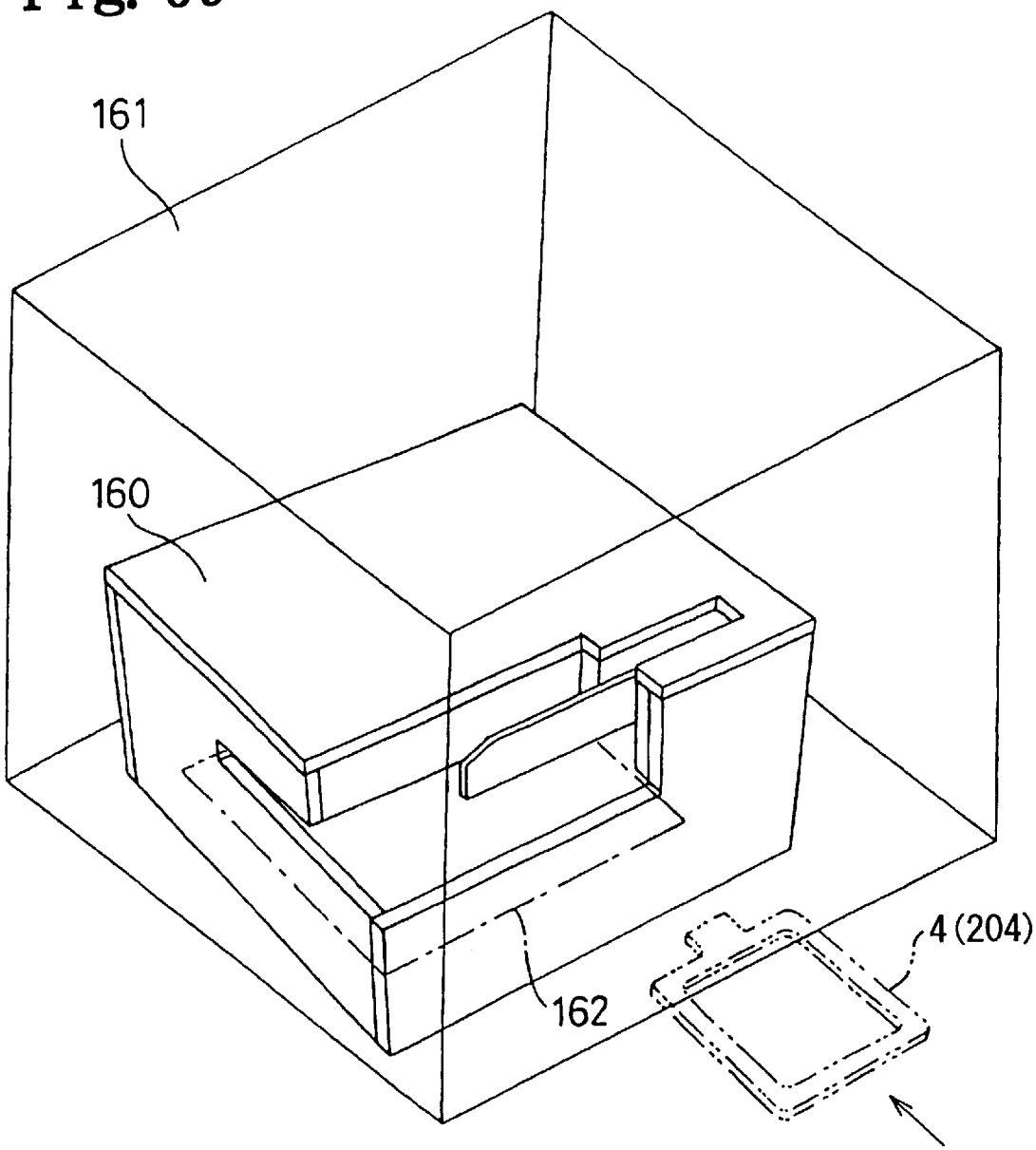
FIG. 69 is a perspective view of a sewing apparatus according to another variation.

The safety cover 3 may cover the entire moving limit area of the embroidery frame 4, 204 so that the embroidery frame 4, 204 cannot be touched by hand. However, as shown in FIG. 69, a cover 160 that covers at least a part of an embroidery frame moving area 162 may be provided. In this case, a cover 161 that covers the entire sewing apparatus body 2, 202 may be provided separately. The cover 161 is made of a transparent or a translucent material, so that a sewing condition can be observed.

Figure 70:
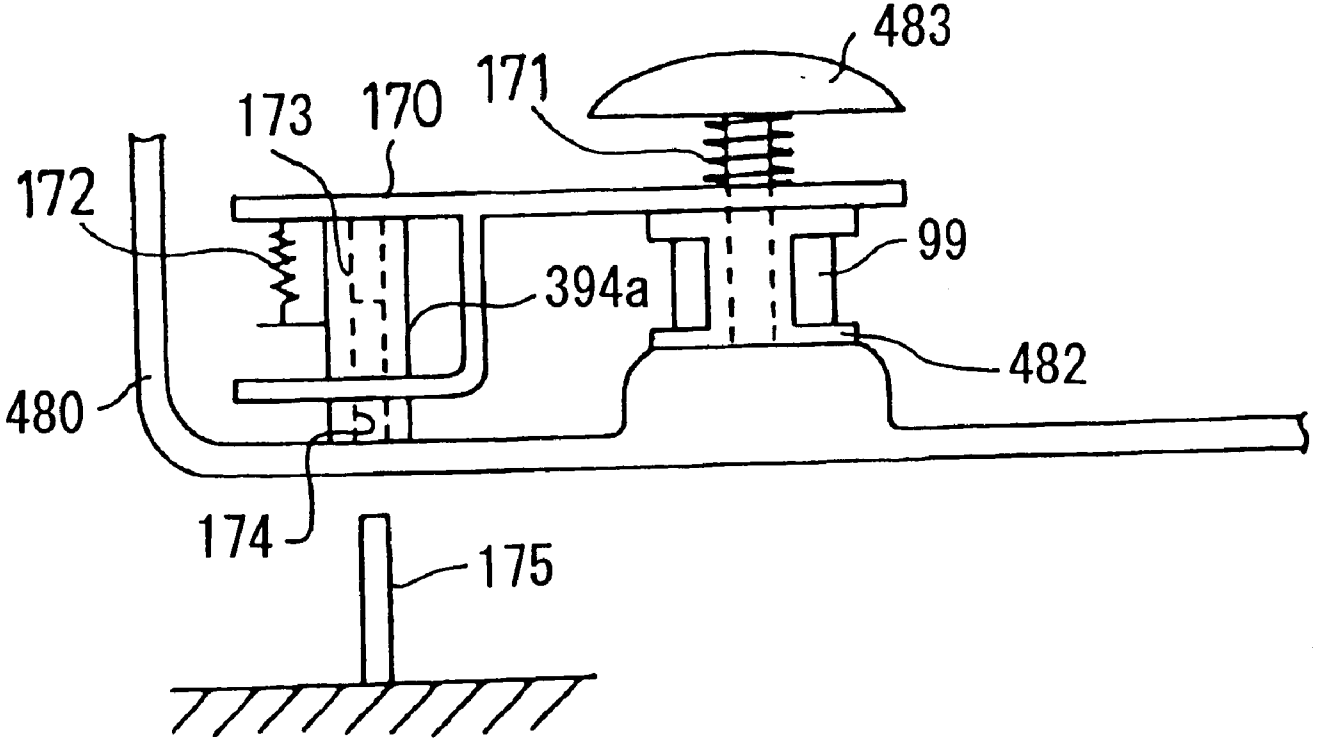
FIG. 70 is a diagram of a substantial part of the sewing cartridge.

The sewing cartridge 5, 205 of the aforementioned embodiments may be structured so that rotation of the spool 82, 282 is restricted when the sewing cartridge 5, 205 is not attached to the sewing apparatus body 2, 202 (when the sewing is not performed). For example, as shown in FIG. 70, when a sewing cartridge 480 is not attached to a sewing apparatus body, the rotation of a spool 482 is restricted by a member 170 for holding the spool 482. An elastic force from springs 171, 172 causes the member 170 to downwardly press the spool 482, so that the rotation of the spool 482 is restricted. Conversely, when the sewing cartridge 480 is attached to the sewing apparatus, a protrusion 175 provided to the sewing apparatus is inserted into an insertion hole 174 of a pivot shaft 394*a* of the sewing cartridge 480, so that a pressing member 173 is pressed upward in FIG. 70, thereby the member 170 for holding the spool 482, around which a thread 99 is wound, is lifted against the elastic force from the springs 171, 172. Accordingly, the spool 482 is automatically allowed to rotate as the sewing cartridge 480 is attached to the sewing apparatus body.

In the aforementioned embodiments, sewing data is supplied from a DVD, which is an external storage medium, via a home video game machine. However, sewing data may be supplied from other types of external storage mediums such as an optical recording medium (e.g., a CDROM, a CD-R), a magnetic recording medium (e.g. a floppy disk), and a semiconductor recording medium (e.g. a flash memory).

In the aforementioned embodiments, a desired embroidery pattern is selected from various kinds of embroidery patterns stored in the DVD 120 and pattern data of the desired embroidery pattern is sent to the sewing apparatus 1, 201 using the game machine 6. However, image data of a character in game software may be provided to the sewing apparatus 1, 201 using the game machine 6 and pattern data may be created in the sewing apparatus 1, 201, based on the image data.

In the aforementioned embodiments, it is assumed that sewing data is stored in an external storage medium in advance. However, sewing data may be created by calculation of a CPU in the sewing apparatus body 2, 202 or the game machine. For example, color image data of a game is divided by color and areas are specified by color. Then, the color-specific areas are specified as color-specific sewing areas. After that, sewing data for filling an area with Tatami stitches is created by color. Sewing data for stitching pattern sections so that boundary areas of the pattern sections overlap each other is created. Sewing data for stitching with Satin stitches as an outline of an embroidery pattern is created. A video capture function (a print screen function in a personal computer) can be used to capture image data as described above. A sequence of sewing of areas is determined based on size of areas and the lightness of the colors. However, an outline is preferably sewn last.

A data supply device connected to the sewing apparatus body 2, 202 of the sewing apparatus 1, 201 is not restricted to the home video game, but may be embroidery machines, computer sewing machines, radio-cassette players, satellite receiving tuners, karaoke terminals (including on-line and non on-line karaoke systems), facsimiles, cellar phones, televisions, videocassette recorders, music CD players, 8-millimeter video cameras, digital cameras, or computers, if the apparatus has a function of handling data. Data communications with the sewing apparatus body 2 may be implemented via a cable 401. However, wireless data communication (including infrared rays) may be implemented.

For example, when a satellite receiving tuner is used, main audio information is used in a commercial and the satellite receiving tuner receives data and programs for the sewing apparatus body 2, 202 through sub-audio information, which is not used for audio of the commercial while the commercial of the sewing apparatus 1, 201, a manufacturer of the sewing apparatus 1, 201, or other products is being run. Sewing may be performed by which data and programs received by the satellite receiving tuner is processed and the sewing apparatus body 2, 202 is controlled. Data may be supplied to the sewing apparatus body 2, 202 via other equipment, such as the home video game.

When the sub-audio information is used, advertising effectiveness may be ensured by which it is structured that the data and programs received by the satellite receiving tuner can be used only when the data is played back at a normal playback speed, in which the recorded commercial is watched, in a case where image data is recorded using a videocassette recorder. When a sewing machine is used as a data supply device, sewing can be performed using patterns installed in the sewing machine or patterns supplied from an external storage medium to be attached to the sewing machine. Sewing data is edited using a display and operating members provided on the sewing machine.

In the aforementioned embodiments, the sewing apparatus body 2, 202 of the sewing apparatus 1, 201 is directly connected with a data supply device via a cable. The sewing apparatus body 2, 202 may be connected with the data supply device via a converter 400 so as to be connected with other equipment described above. The converter 400 may be dedicated to various equipment described above, or may have several types of connecting portions. If such a converter 400 is used, there is a possibility of using a general-purpose cable for connection. The sewing apparatus body 2, 202 may be connected with one or more data supply devices, such as a second game machine 402, a third game machine 403, a data supply device 404 other than the game machine, and a sewing machine 405, at the same time. The converter 400 may contribute to only data transmission, or may be provided with a CPU so that data can be edited or converted in the converter 400.

In the aforementioned embodiments, because a patterned cloth, such as an emblem, is adhered to clothes using a double-sided adhesive tape, the patterned cloth can be easily attached to and detached from the clothes. Instead of the double-sided adhesive tape, hook-and-loop fasteners may be used. In a case where an emblem is attached to clothes via a double-sided adhesive tape or hook-and-loop fasteners, the emblem can be easily removed from the clothes when the clothes are washed.

In the aforementioned embodiments, the thread is manually cut using scissors separately provided from the sewing apparatus body 2, 202, or the thread is automatically cut by the thread cutting mechanism 140 having an actuator, such as a motor. Scissors having moving cutting edges may be provided at a predetermined portion in the safety cover. By operating a manual operating lever, a force applied from the operation is transmitted to the scissors via a link mechanism so that the moving cutting edges of the scissors are moved to cut a thread. In this case, the embroidery frame is moved to a predetermined area where the moving cutting edges are positioned before cutting the thread. A fixed cutting edge like a cutter may be used instead of the moving cutting edges. The sewing apparatus body 2 having such a thread cutting mechanism that does not have an actuator and can be simplified in structure.

Figure 71:
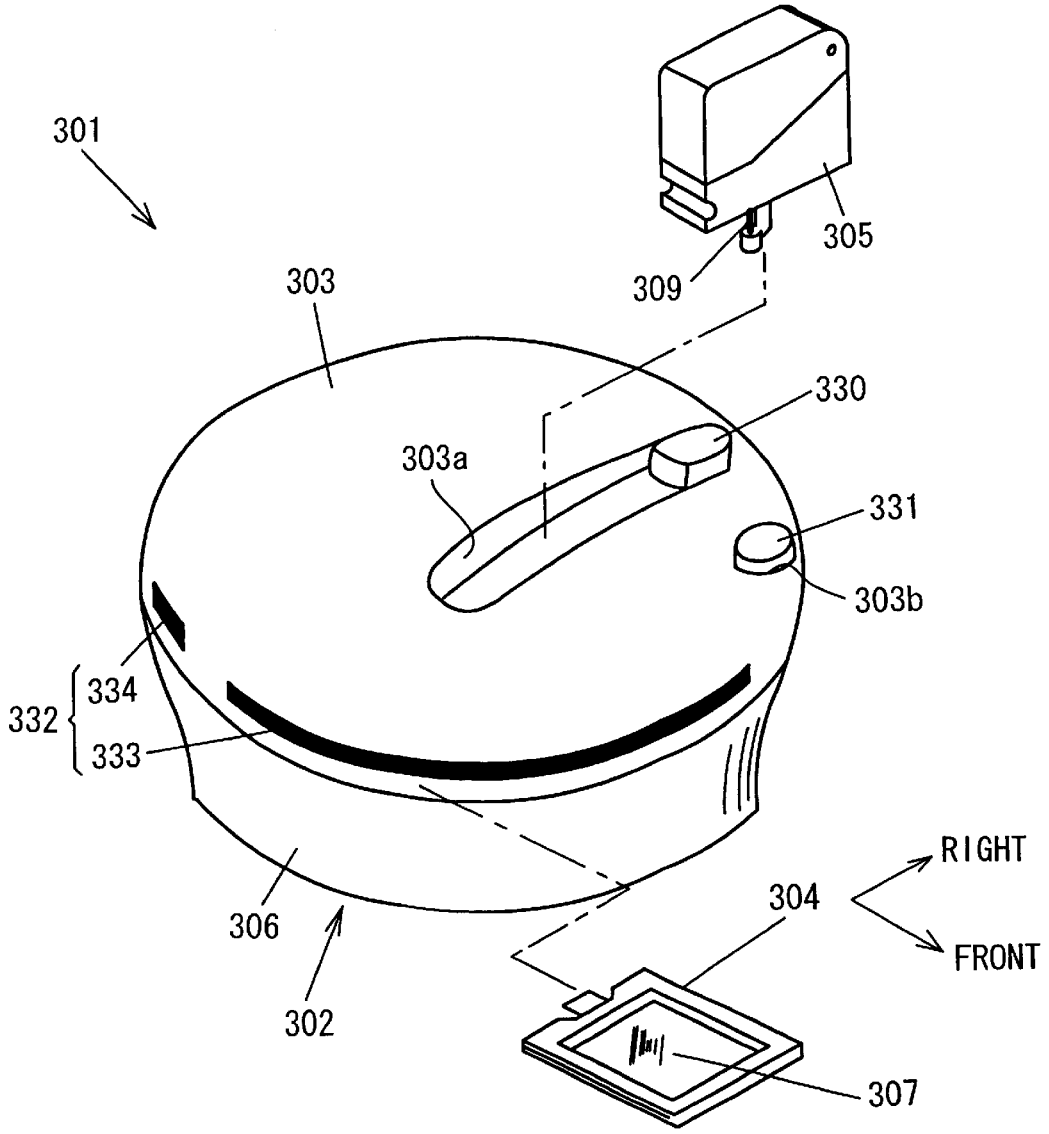
FIG. 71 is a perspective view of a sewing apparatus of a third embodiment of the invention.

A third embodiment of the invention will be described below with reference to FIGS. 71 to 78. In a sewing apparatus of the embodiment, a ROM card is detachably attached to a sewing apparatus body and an embroidery pattern is sewn on a cloth attached to an embroidery frame using embroidery pattern data stored in the ROM card. Description of the embodiments will use directions defined in FIG. 71 of the sewing apparatus 301 for application throughout several drawings. Orientation of a sewing cartridge is defined in a state where the sewing cartridge is attached to the sewing apparatus 301 shown in FIG. 71. As shown in FIG. 71, a sewing apparatus 301 includes a sewing apparatus body 302, a safety cover 303, an embroidery frame 304, and a sewing cartridge 305.

Figure 72:
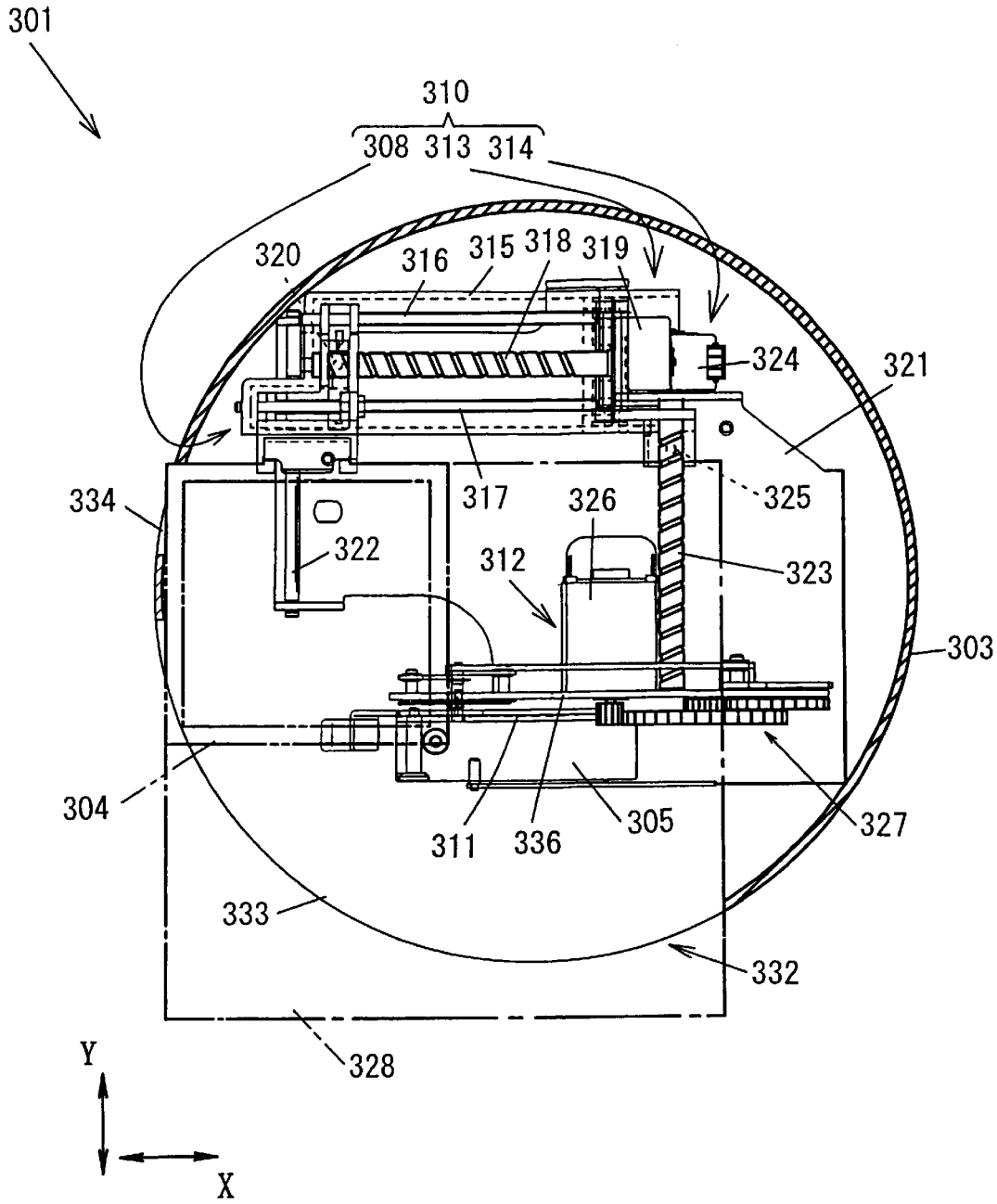
FIG. 72 is a transverse sectional view showing main mechanisms inside of the sewing apparatus.
Figure 73:
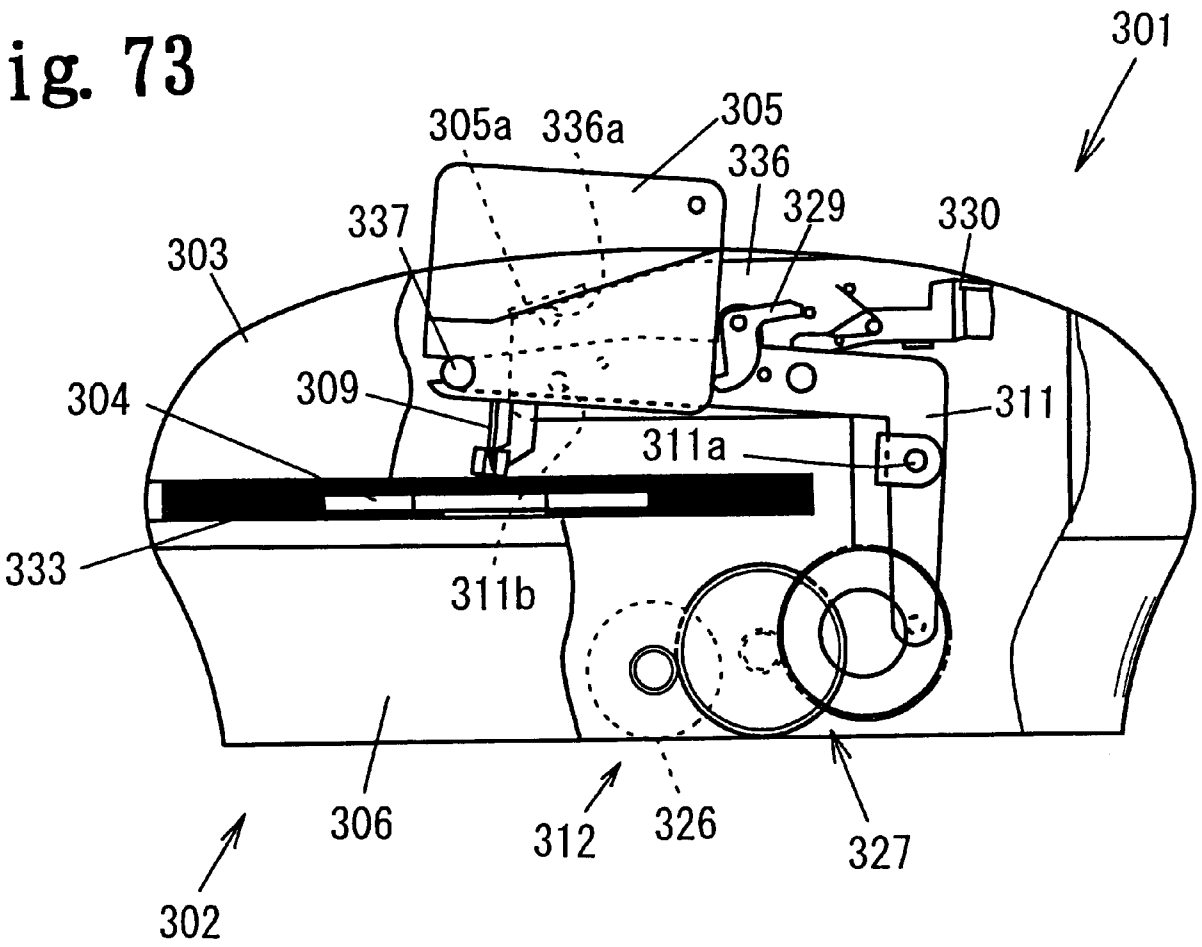
FIG. 73 is a front view with partial cutaway of essential parts of the sewing apparatus.

First, the sewing apparatus body 302 will be briefly described. As shown in FIGS. 71 to 73, the sewing apparatus body 302 includes a relatively small tubular casing 306 (for example, approximately 22 cm in diameter and 10 cm in height), an embroidery frame driving mechanism 310, a cartridge driving mechanism 312, and a controller (not shown). The casing 306 is made of a synthetic resin material and has a bottom. The embroidery frame driving mechanism 310 moves the embroidery frame 304, having a work cloth 307, attached to a carriage 308 in a horizontal plane with respect to a hollow needle 309 in the sewing cartridge 305. The cartridge driving mechanism 312 swings the sewing cartridge 305 detachably attached to a swing arm 311. The controller controls the embroidery frame driving mechanism 310 and the cartridge driving mechanism 312. Because the sewing apparatus 301 performs sewing using only a thread supplied from the sewing cartridge 305 without using a lower thread, a cloth that includes an elastic film member made of urethane sandwiched by a pair of cloths to make frictional resistance to the thread become higher is adopted for the work cloth 307 to be sewn.

As shown in FIG. 72, the casing 306 accommodates the main part of the embroidery frame driving mechanism 310 and the cartridge driving mechanism 312 and the controller. The embroidery frame driving mechanism 310 includes the carriage 308 that the embroidery frame 304 can be attached thereto and removed therefrom, an X-axis direction moving mechanism 313 that moves the carriage 308 in an X-axis direction (in a right and left direction) within a horizontal plane, and a Y-axis direction moving mechanism 314 that moves the carriage 308 in a Y-axis direction, perpendicular to the X-axis direction, within the horizontal plane together with the X-axis direction moving mechanism 313.

The X-axis direction moving mechanism 313 has a moving frame 315, guide rods 316, 317, a screw shaft 318, a pulse motor 319, and a guide pin 320. The screw shaft 318 is rotated by the pulse motor 319 and the guide pin 320 is guided along a spiral groove in the screw shaft 318, so that the guide pin 320 is moved from side to side. Thus, the carriage 308 is moved in the X-axis direction. The Y-axis direction moving mechanism 314 has a support frame 321, a pair of guide rods 322, a screw shaft 323, a pulse motor 324, and a guide pin 325. The screw shaft 325 is rotated by the pulse motor 324 and the guide pin 325 is guided along a spiral groove in the screw shaft 323, so that the guide pin 325 is moved back and forth. Thus, the carriage 308 is moved in the Y-axis direction together with moving frame 315.

As shown in FIGS. 72 and 73, the cartridge driving mechanism 312 has the swing arm 311, a static frame 336, a machine motor 326, a gear mechanism 327, and a cam mechanism (not shown). The sewing cartridge 305 can be attached to and removed from the swing arm 311. The swing arm 311 is pivotally attached to the static frame 336. The machine motor 326 is an AC motor that vertically swings the swing arm 311. The gear mechanism 327 reduces rotation speed of the machine motor 326. The cam mechanism converts a rotary motion, reduced in its rotation speed by the gear mechanism 327, into up-and-down movements of the swing arm 311.

The static frame 336 has an L-shape in a vertical direction when viewed from the front and is fixed to the sewing apparatus body 302. The swing arm 311 is pivotally attached to the static frame 336 at the middle point of its length by a pivot pin 311*a*. An engaging member 329 that holds the sewing cartridge 305 in an attaching position is pivotally attached to the swing arm 311. The engaging member 329 is urged in a clockwise direction by a spring member in FIG. 73. An operating member 330 that is to be operated to rotate the engaging member 329 in a counterclockwise direction to release the engagement is pivotally attached to the static frame 336.

As described later, the sewing cartridge 305 has a housing case 340 and an openable cover 341 as an upper cover. The housing case 340 and the openable cover 341 are rotatably connected to each other by a pin 342. The openable cover 341 can relatively open and close about the pin 342 with respect to the housing case 340. A pin 337 is fixedly attached to an end portion (left end portion) of the swing arm 311. A laterally U-shaped engagement recess 343 that engages the pin 337 is formed in a lower end portion of the left end portion (shown in reverse in FIG. 75) of the sewing cartridge 305.

The sewing cartridge 305 is brought into a leftwardly and downwardly inclined posture with respect to a cartridge insertion slot 303*a*. The sewing cartridge 305 is inclinatorily inserted into the cartridge insertion slot 303*a* from upper right to lower left, and the engagement recess 343 is engaged with the pin 337. Then, the sewing cartridge 305 is pushed to a horizontal posture, so that the engaging member 329 is also brought into engagement. As a result, an engaged portion 305*a* provided at the lower end of the openable cover 341 of the sewing cartridge 305 is engaged by an engaging pin 336*a* of the static frame 336 from bottom. The engaged portion 305*a* is a rib that slightly protrudes rearward straightly and is inclined along the lower end of the openable cover 341.

During sewing, as the swing arm 311 is reciprocally swung about the pivot pin 311*a*, the housing case 340 is reciprocally swung up and down by the swing arm 311 while the housing case 340 of the sewing cartridge 305 is reciprocally rotated about the pin 432 with respect to the openable cover 341. Thus, an embroidery can be sewn on the work cloth 307 attached to the embroidery frame 304.

Next, the safety cover 303 will be described. As shown in FIGS. 71 to 73, the safety cover 303 is made of a transparent or a translucent synthetic resin material. The safety cover 303 is formed into an inverted circular bowl form having a diameter the same as that of the casing 306, when viewed from above. A plurality of engaging pawls are formed on a lower periphery of the safety cover 303, so that the safety cover 303 can engage the casing 306 from above. The safety cover 303 partially covers a moving area 328 of the embroidery frame 304 and also covers an up-and-down moving area of the hollow needle 309 including a lower half of the sewing cartridge 305.

The upper surface of the safety cover 303 is formed with the substantially rectangular cartridge insertion slot 303*a* whose length and width are larger than those of the sewing cartridge 305. The static frame 336 and the swing arm 311 extend into the cartridge insertion slot 303*a*. By inserting the sewing cartridge 305 into the safety cover from the cartridge insertion slot 303*a*, the sewing cartridge 305 can be attached to the swing arm 311 while guided. The operating member 330 is disposed on the right end portion of the cartridge insertion slot 303*a* so as to protrude slightly upward. An operating window 303*b* is also formed to operate a start/stop switch 331 by penetrating the safety cover 303.

The moving area 328, in which the rectangular embroidery frame 304 attached to the carriage 308 can be horizontally moved by the embroidery frame driving mechanism 310, is a rectangular area that is approximately four times as large as the embroidery frame 304 and is shown by a dot and dashed chain line in FIG. 72. The hollow needle 309 in the sewing cartridge 305 attached to the sewing apparatus body 302 is in the substantially middle position of the moving area 328. As shown in FIGS. 71 to 73, a rim of the safety cover 303 is formed with a circular arc slit 332 that allows the embroidery frame 304 to move. The slit 332 includes a main slit 333 and an escape slit 334.

As described above, the sewing cartridge 305 has the housing case 340 and the openable cover 341. The openable cover 341 and the housing case 340 are rotatably connected to each other by the pin 342. A torsion spring 344, that elastically urges the openable cover 341 to a closed position, is externally attached to the pin 342. The openable cover 341 is a cover-like member that includes a front and a rear trapezoidal walls, an upper wall, and a left wall.

The openable cover 341 (shown in detail in FIG. 75 which is reversed from the normal, mounted position of the serving cartridge 305) is provided with a thread guide portion 349 that guides a thread 346 to be supplied from the spool 345. The thread guide portion 349 includes a metal guide pin 347 and a left spring 348 that applies a passing resistance to the thread 346 by sandwiching the thread 99 between the guide pin 347 and the leaf spring 348. During embroidery sewing, when the housing case 340 is rotated downward with respect to the openable cover 341, the thread 346 wound around the spool 345 is drawn. When the housing case 340 is returned upward, the thread between the thread guide portion 349 and the hollow needle 309 becomes loosened. The thread guide portion 349 has the functions of guiding the thread 346, applying the necessary tension to the thread 346 to be sewn, and preventing the thread 346 from being wound in reverse to the spool 345.

Figure 74:
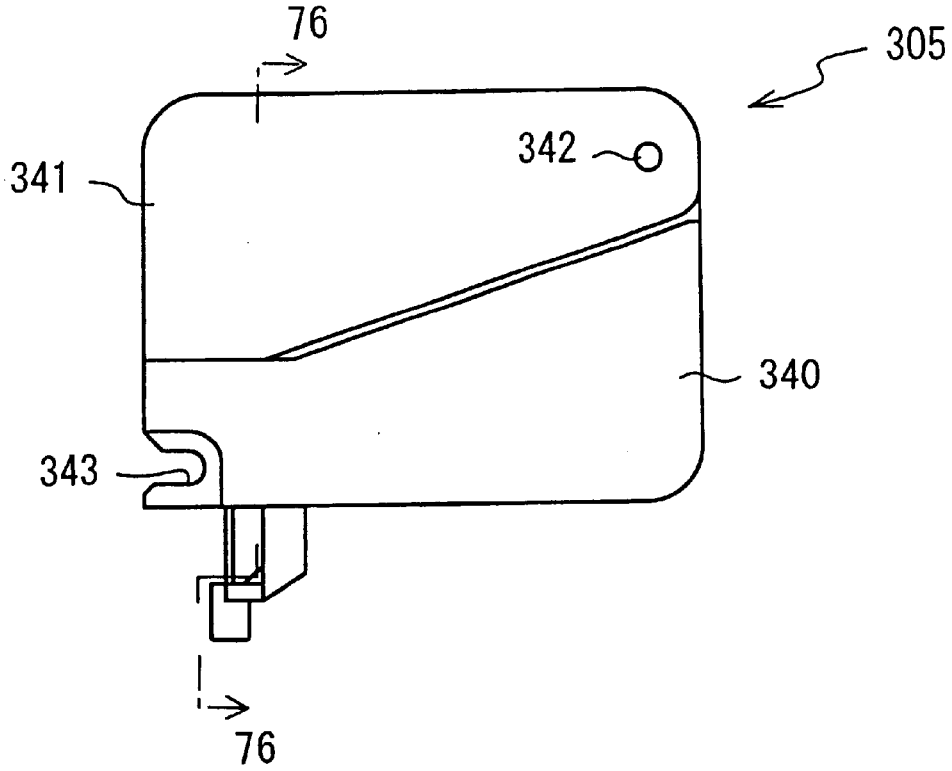
FIG. 74 is a front view of a sewing cartridge of the third embodiment of the invention.
Figure 75:
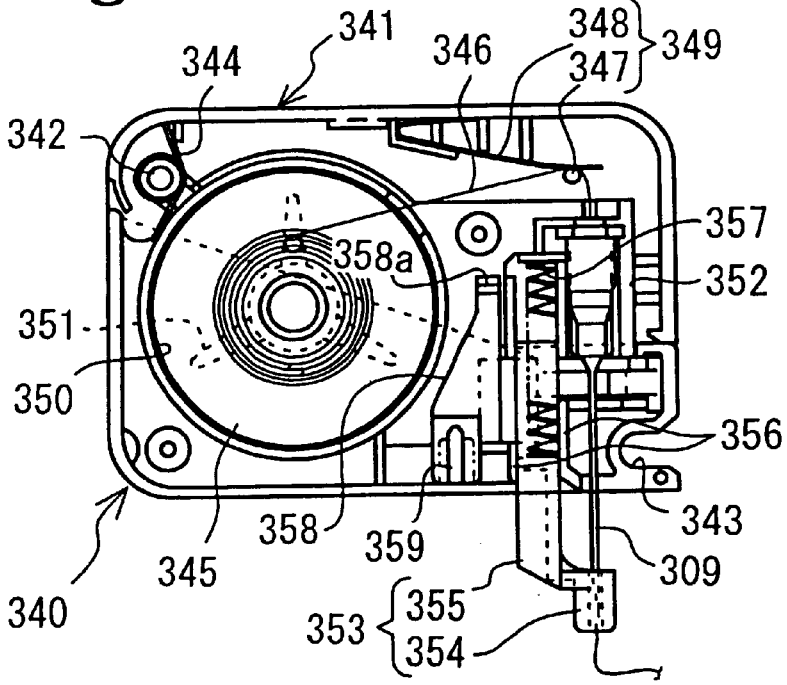
FIG. 75 is a back view showing an internal structure without a rear wall of the sewing cartridge.
Figure 76:
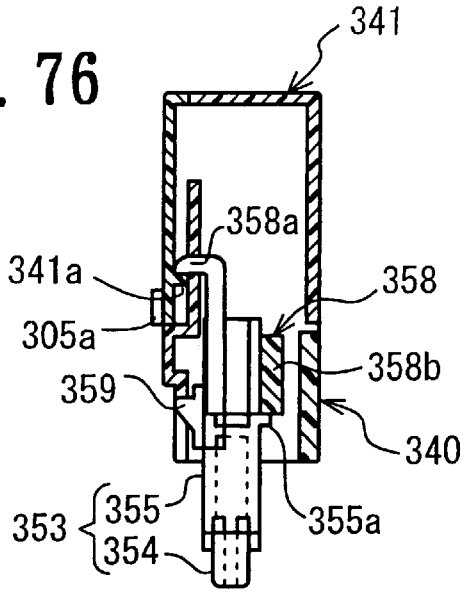
FIG. 76 is a schematic sectional view as taken along the lines 76—76 in FIG. 74.

As shown in FIGS. 74 to 76, the housing case 340 is provided with a thread housing portion 350 housing the spool 345, a leaf spring 351, the hollow sewing needle 309, a needle attaching portion 352, a needle cover 353, a guide portion 356, a coil compression spring 357, and a locking mechanism (FIGS. 75–78). The leaf spring 351 applies resistance to the spool 345. The hollow needle 309 is attached to the needle attaching portion 352. The guide portion 356 supports the needle cover 353 so it can move up and down. The locking mechanism locks the openable cover 341 and the needle cover 353.

The hollow needle 309 has the same structure as a syringe. A large-diameter portion of the upper end part of the hollow needle 309 is fixed to the needle attaching portion 352. The thread 346, that extends from the spool 345 and is hung from the thread guide portion 349, is installed into the inside of the hollow needle 309 and extends to the outside of the hollow needle 309 from the lower end. The needle cover 353 has a tubular cover 354 for covering the lower end part of the hollow needle 309 and a rod portion 355 that extends integrally upward from the tubular cover 354. The rod portion 355 is guided by the guide portion 356 so that the rod portion 355 can ascend and descend. As shown in FIG. 75, the needle cover 353 is downwardly urged by the coil compression spring 357. A regulated portion 355*a* of the rod portion 355 is engaged by the upper end of the guide portion 356, so that the needle cover 353 is in a lower limit position as shown in FIGS. 75 and 76.

As shown in FIGS. 75 to 78, the locking mechanism has a locking member 358, a switching member 359, and an urging member 360. The locking member 358 can move between a first position where the openable cover 341 is locked in a closed position and the needle cover 353 is locked in a cover position (a position shown in FIG. 75) and a second position where the openable cover 341 and the needle cover 353 can move. The switching member 359 switches the locking member 358 to the second position from the first position. The urging member 360 urges the locking member 358 to the first position.

A left end portion 358*c* (FIGS. 77 and 78) of the locking member 358 is pivotally attached to the housing case 340 so that the left end portion 358*c* can rotate about the standing shaft. An upper end portion of the locking member 358 is formed with an engaging pawl 358*a* that engages an engaged portion 341*a* of the openable cover 341 from above. A front arm portion of the locking member 358 is formed with an engaging portion 358*b* that engages the regulated portion 355*a* of the rod portion 355 of the needle cover 353. Further, a right end portion of the locking member 358 is integrally formed with the switching member 359 that extends to an operating hole 361 formed in a rear wall portion 340*a* of the housing case 340. The rear surface of the switching member 359 is formed with an inclined surface. The inclined surface inclines to protrude toward the rear (the width in the back and forth direction becomes wider) as neared to a top. The urging member 360 is structured by a torsion spring that includes an elastic body externally fit to a spring support portion 362 of the housing case 340. The urging member 360 urges the locking member 358 and the switching member 359 rearward (toward the first position) with respect to the housing case 340.

Figure 77:
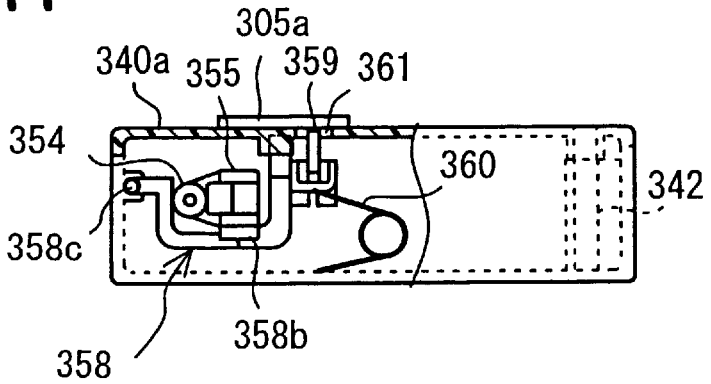
FIG. 77 is a partially cutaway transverse sectional view showing a locking mechanism and the like of the sewing cartridge.
Figure 78:
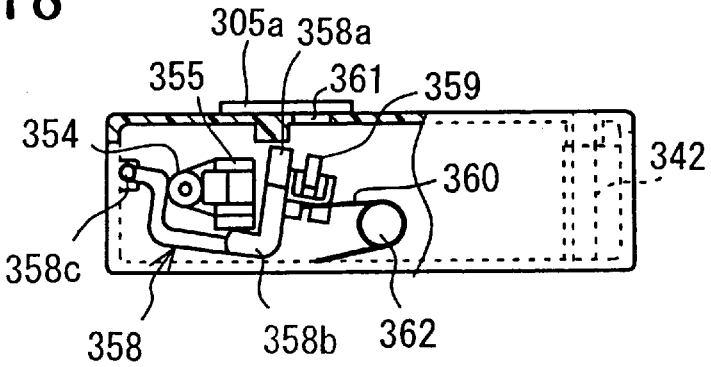
FIG. 78 is a partially cutaway transverse sectional view showing the locking mechanism and the like of the sewing cartridge.

FIGS. 76 and 77 shows a state where the locking member 358 is in the first position. When the locking member 358 is in the first position, the locking member 358 rotates counterclockwise to the fall extent, as shown in FIG. 77, so that the engaging pawl 358*a* of the locking member 358 abuts against the engaged portion 341*a* of the openable cover 341 from above. Accordingly, the openable cover 341 is prohibited in its upward movement. The engaging portion 358*b* of the locking member 358 abuts against the engaged portion 355*a* of the rod portion 355 of the needle cover 353 from above, so that the needle cover 353 is prohibited from upward movement.

When the sewing cartridge 305 is attached to the swing arm 311, a tip of a pin-shaped engaging portion 311*b* (which is a circular in cross section) (see FIG. 73), of the swing arm 311 enters the operating hole 361 and pushes the switching member 359 forward. Therefore, the locking member 358 is switched to the second position (an unlocked position), so that the openable cover 359 and the needle cover 353 are allowed to relatively move upward with respect to the housing case 340. The needle cover 353 is movable if the needle cover 353 is pushed upwardly against the elastic force from the coil compressing spring 357. The needle cover 353 is pushed upwardly when the sewing cartridge 305 is moved to the sewing position by the movement of the swing arm 311. At that time, the needle cover 353 is pushed against a needle plate (not shown but similar to the needle plate 31*d* of the first embodiment), having a hole, through which the hollow needle 309 can pass, formed on the support frame 321, via a work cloth. When the sewing cartridge 305 is removed from the swing arm 311, the engaging portion 311*b* of the swing arm 311 does not push the switching member 359, so that the locking member 358 is switched to the first position due to an urging force from the urging member 360. Accordingly, the openable cover 341 and the needle cover 353 are locked.

When embroidery sewing is performed on the work cloth 307 attached to the embroidery frame 304, the embroidery frame 304 is attached to the carriage 308. The sewing cartridge 305 is inserted into the safety cover 303 from the cartridge insertion slot 303*a* and is attached to the swing arm 311 of the cartridge driving mechanism 312. The engagement recess 343 of the sewing cartridge 305 is engaged with the pin 337 and the engaging portion 305*a* of the openable cover 341 of the sewing cartridge 305 is engaged by the engaging pin 336*a* of the static frame 336 from bottom. Then, the cartridge driving mechanism 312 is driven while the X-axis direction moving mechanism 313 and the Y-axis direction moving mechanism 314 are driven.

In the locking mechanism that locks the openable cover 341 and the needle cover 353, when the sewing cartridge 305 is not attached to the swing arm 311, the locking member 358 as urged by the urging member 360 is held at the first position and locks the openable cover 341 and the needle cover 353 so that they cannot move up and down. Accordingly, the thread 346 can be reliably prevented from being pulled out from the hollow needle 309.

Further, the needle cover 353 is also locked in the cover position, so that the tip of the hollow needle 309 is protected by the needle cover 353. Accordingly, damage to the hollow needle 309 can be avoided. In addition, possible injury to an operator's fingers by the hollow needle 309 can be prevented, so that the sewing cartridge 305 offers a superior level of safety.

When the sewing cartridge 305 is attached to the swing arm 311, the engaging portion 311*b* of the swing arm 311 pushes the switching member 359 forward, that is, toward the lock release side, so that the locking member 358 is automatically switched to the unlocked position. Thus, it becomes possible to perform embroidery sewing.

As described above, the locking member 358 for locking the openable cover 341 and the locking member 358 for locking the needle cover 353 are structured using a common member. As a result, the number of parts for locking the openable cover 341 and the needle cover 353 can be reduced and the structure of the locking mechanism can be simplified.

By operating the switching member 359 once by the engaging portion 311*b*, the locking member 358 can be switched to the second position from the first position and the openable cover 341 and the needle cover 353 become movable. Thus, the switching operation of the switching member 359 is simplified. Further, the urging member 360 for urging the locking member 358 to the first position is provided. Accordingly, in a state where the sewing cartridge 305 is removed from the swing arm 311, the locking member 358 is surely in the first position, the openable cover 341 is held at the closed position, and the needle cover 353 is held at the cover position. Therefore, the safety of the hollow needle 309 can be ensured and also the tip of the hollow needle 309 can be protected from being damaged.

The switching member 359 is structured so that, when the sewing cartridge 305 is attached to the swing arm 311, the switching member 359 is operated by the engaging portion 311*b* of the swing arm 311 and switches the locking member 358 to the second position. Accordingly, the switching member 359 automatically switches the locking member 358 to the second position in synchronization with the operation of attaching the sewing cartridge 305 to the swing arm 311, and also automatically switches the condition of the openable cover 341 and the needle cover 353 so that the openable cover 341 and the needle cover 353 can move.

The embodiment described above is an example of the invention. The invention can be implemented by other form to which partial changes are applied to the aforementioned embodiment. For example, various kinds of structures can be adopted to the sewing cartridge 305, except for the locking mechanism inside of the sewing cartridge 305.

The structure and shape of the locking member 358 in the locking mechanism are not restricted to those described above. However, a locking member of other form to which various changes are applied can be adopted. The variations that can be applied to the first and the second embodiments, such as the change of the appearance and shape of the sewing apparatus 1, 201, the safety cover 3 and the guide member 69, the provision of the thread cutting mechanism 140 and the flap 156, and the change of the position of the carriage 18, can be also applied to the third embodiment.

Although the invention has been described in detail with reference to specific embodiments thereof, it would be apparent to those skilled in the art that various changes and modifications may be made therein without departing from the spirit of the invention.

What is claimed is:

1. A method for manufacturing a patterned cloth by forming an embroidery pattern on a surface thereof, comprising the steps of:

passing a needle having a thread through a workpiece;

leaving a free loop on a reverse side of the workpiece;

repeating the passing step and the leaving step a number of times with changing a position where the thread is passed through the workpiece; and fixing the plurality of free loops left on the reverse side of the workpiece, wherein the passing step includes forming a cut surface having an arc shape in cross section in the workpiece and the leaving step includes pinching the thread between the cut surfaces by the elasticity of the workpiece, the needle moves downward along an arc to pass through the workpiece.

2. The method for manufacturing the patterned cloth according to claim 1, wherein the passing step includes reciprocating a hollow needle with the thread passed therethrough in a direction transverse to a plane including the workpiece.

3. The method for manufacturing the patterned cloth according to claim 2, wherein the passing step includes relatively moving the workpiece and the hollow needle in a direction in a plane transverse to a reciprocating direction of the hollow needle.

4. The method for manufacturing the patterned cloth according to claim 1, wherein the workpiece includes an elastic film member and the leaving step includes leaving each free loop on the reverse side of the workpiece with frictional resistance between the workpiece and the thread passed therethrough caused by elasticity of the elastic film member of the workpiece.

5. The method for manufacturing the patterned cloth according to claim 4, wherein the leaving step includes leaving each free loop on the reverse side of the workpiece without using any other thread or any thread in a previous stitch or a following stitch.

6. The method for manufacturing the patterned cloth according to claim 1, wherein the passing step includes reciprocating a hollow needle with the thread passed therethrough, and the forming step includes forming the cut surface having the arc shape in cross section in the workpiece by reciprocating the hollow needle whose tip is inclined with respect to an axis of the hollow needle.

7. The method for manufacturing the patterned cloth according to claims 6, wherein the forming step includes successively forming the cut surfaces so that a tangent to a middle of the arc shape in the cut surfaces is not perpendicular to a direction in which the cut surfaces are successively formed.

8. The method for manufacturing the patterned cloth according to claim 1, wherein the fixing step includes fixing the plurality of free loops left on the reverse side of the workpiece by attaching a fixing material to the reverse side after completion of leaving of the free loops on the reverse side of the workpiece.

9. A sewing apparatus for manufacturing a patterned cloth, comprising:

a sewing tool that passes a thread through a workpiece;

a sewing tool driving device that reciprocates the sewing tool in a direction passing through the workpiece;

a moving device that relatively moves a workpiece holder having the workpiece and the sewing tool in a direction in a plane transverse to a reciprocating direction of the sewing tool; and a controller that controls the sewing tool driving device and the moving device to cause a thread to pass through the workpiece a number of times in different positions so that a plurality of free loops are left on a reverse side of the workpiece by frictional resistance between the workpiece and the thread passed therethrough, thereby forming an embroidery pattern on a surface of the workpiece, wherein the sewing tool is a hollow needle, the hollow needle whose tip is inclined with respect to an axis of the hollow needle is swung and passes through the workpiece downwardly along an arc such that a cut surface having an arc shape in cross section is formed in the workpiece.

10. The sewing apparatus for manufacturing the patterned cloth according to claim 9, wherein the workpiece includes an elastic film member, and the plurality of free loops are left on the reverse side of the workpiece by frictional resistance between the workpiece and the thread passed therethrough, which is caused by elasticity of the workpiece itself.

11. The sewing apparatus for manufacturing the patterned cloth according to claim 9, a plurality of cut surfaces having an arc shape in cross section are formed in the workpiece and hold the thread at the plurality of cut surfaces by frictional resistance between the workpiece and the thread passed therethrough, which is caused by the elasticity of the workpiece.

12. The sewing apparatus for manufacturing the patterned cloth according to claim 11, wherein the cut surfaces having the arc shape in cross section are successively formed so that a tangent to a middle of the arc shape in the cut surfaces is not perpendicular to a direction in which the cut surfaces are successively formed.

13. The sewing apparatus for manufacturing the workpiece formed with a pattern according to claim 8, wherein a plurality of free loops formed on the reverse side of the workpiece by the sewing tool are left so as to be fixed by being attached with a fixing material after a sewing operation with the sewing tool is completed.

14. A patterned cloth with an embroidery pattern on a surface thereof manufactured by the method according to claim 1.

15. A method for manufacturing a patterned cloth by forming an embroidery pattern on a surface thereof, comprising the steps of:

passing a thread through a workpiece;

leaving a free loop on a reverse side of the workpiece;

repeating the passing step and the leaving step a number of times with changing a position where the thread is passed through the workpiece; and fixing the plurality of free loops left on the reverse side of the workpiece, wherein the passing step includes forming a cut surface having an arc shape in cross section in the workpiece and the leaving step includes pinching the thread between the cut surfaces by the elasticity of the workpiece, the workpiece includes an elastic film member, and the leaving step further includes leaving each free loop on the reverse side of the workpiece with frictional resistance between the workpiece and the thread passed therethrough caused by elasticity of the elastic film member of the workpiece.

16. A sewing apparatus for manufacturing a patterned cloth, comprising:

a sewing tool that passes a thread through a workpiece;

a sewing tool driving device that reciprocates the sewing tool in a direction passing through the workpiece;

a moving device that relatively moves a workpiece holder having the workpiece and the sewing tool in a direction in a plane transverse to a reciprocating direction of the sewing tool; and a controller that controls the sewing tool driving device and the moving device to cause a thread to pass through the workpiece a number of times in different positions so that a plurality of free loops are left on a reverse side of the workpiece by frictional resistance between the workpiece and the thread passed therethrough, thereby forming an embroidery pattern on a surface of the workpiece, wherein the sewing tool is a hollow needle, the hollow needle whose tip is inclined with respect to an axis of the hollow needle is swung and passes through the workpiece downwardly along an arc such that a cut surface having an arc shape in cross section is formed in the workpiece, the workpiece includes an elastic film member, and the plurality of free loops are left on the reverse side of the workpiece by frictional resistance between the workpiece and the thread passed therethrough, which is caused by elasticity of the workpiece itself.

17. A patterned cloth with an embroidery pattern on a surface thereof manufactured by the method according to claim 15.

* * * * *